US005120637A

United States Patent [19]

Furusawa et al.

[11] Patent Number: 5,120,637

[45] Date of Patent: Jun. 9, 1992

[54] SILVER HALIDE COLOR PHOTOGRAPHIC LIGHT-SENSITIVE MATERIAL CONTAINING AN EMULSIFIED DISPERSION OF OLEOPHILIC FINE PARTICLES OBTAINED BY DISPERSING A SOLUTION CONTAINING A CYAN COUPLER AND A POLYMER

[75] Inventors: Genichi Furusawa; Katsuyoshi Yamakawa, both of Kanagawa, Japan

[73] Assignee: Fuji Photo Film Co., Ltd., Kanagawa, Japan

[21] Appl. No.: 305,340

[22] Filed: Feb. 2, 1989

[30] Foreign Application Priority Data

Feb. 2, 1988 [JP] Japan ..... 63-22538
Apr. 28, 1988 [JP] Japan ..... 63-104212

[51] Int. Cl.[5] ..... G03C 1/08; G03C 7/32

[52] U.S. Cl. ..... 430/546; 430/552; 430/553; 430/558

[58] Field of Search ..... 430/546, 558, 552, 553

[56] References Cited

U.S. PATENT DOCUMENTS

| | | | |
|---|---|---|---|
| 4,199,363 | 4/1980 | Chen | 430/512 |
| 4,801,521 | 1/1989 | Ohki et al. | |
| 4,818,672 | 4/1989 | Masukawa et al. | 430/558 |
| 4,857,449 | 8/1989 | Ogawa et al. | 430/546 |
| 4,946,770 | 8/1990 | Takahashi et al. | 430/545 |

FOREIGN PATENT DOCUMENTS

276319A1 8/1988 European Pat. Off.

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A silver halide color photographic material having excellent color reproducibility and image storage stability, which comprises a support having thereon at least one silver halide photographic emulsion layer containing an emulsified dispersion of oleophilic fine particles obtained by dispersing a mixture solution containing at least one cyan coupler represented by formulae (I) or (II) and at least one water-insoluble and organic solvent-soluble polymer;

(I)

(II)

wherein $R_1$, $R_2$, $R_3$, and $R_4$ each represents hydrogen, an aliphatic group, an aromatic group, a heterocyclic group, an aromatic amino group, a heterocyclic amino group, an aliphatic amino group, an acylamino group, a sulfonamido group, a carbamoyl group, a sulfamoyl group, a ureido group, an aliphatic oxycarbonyl group, an aromatic oxycarbonyl group, an aliphatic oxycarbonylamino group, an aromatic oxycarbonylamino group, a carboxy group, or a cyano group; and $X_1$ and $X_2$ each represents hydrogen or an atom or a group capable of being released by a coupling reaction with the oxidation product of a color developing agent; provided that $R_2$ and $X_1$ and $R_3$ and $R_4$ each may be linked to form a 5- to 7-membered ring; said coupler may form a dimer or higher polymer at $R_1$, $R_2$, or $X_1$ or at $R_3$, $R_4$, or $X_2$; excluding that $R_1$ and $R_2$ or $R_3$ and $R_4$, are a combination of atoms and/or groups selected from hydrogen atoms, carboxyl groups, and cyano groups; and when $R_3$ and $R_4$ combine with each other to form a 5- to 7-membered ring, the ring does not have two or more double bonds.

12 Claims, No Drawings

SILVER HALIDE COLOR PHOTOGRAPHIC LIGHT-SENSITIVE MATERIAL CONTAINING AN EMULSIFIED DISPERSION OF OLEOPHILIC FINE PARTICLES OBTAINED BY DISPERSING A SOLUTION CONTAINING A CYAN COUPLER AND A POLYMER

FIELD OF THE INVENTION

This invention relates to a silver halide color photographic light-sensitive material, and more particularly to a silver halide color photographic light-sensitive material excellent in color reproducibility and image storage stability after processing.

BACKGROUND OF THE INVENTION

A multilayer silver halide color photographic material has on a support a multilayer structure of light-sensitive layers, composed of three kinds of silver halide emulsion layers selectively sensitized to have sensitivities for blue light, green light, and red light, respectively.

For forming color photographic images, the color photographic material containing yellow, magenta, and cyan photographic couplers in the light-sensitive layers, respectively, is imagewise exposed and processed by a color developer containing an aromatic primary amine color developing agent. Colored dyes are formed by the coupling reaction of these couplers and the oxidized product of an aromatic primary amine, and it is preferred to use couplers showing a coupling rate as high as possible and a good coloring property for giving a high color density in a limited development time. Furthermore, the colored dyes are required to be clear cyan, magenta, and yellow dyes having low side absorption and providing color photographic images with good color reproducibility.

The color photographic images formed are required to have a good storage stability under various conditions, including, for example, a dark storage condition under influences of humidity and heat and a light irradiation condition by sun light or room light. The occurrence of discoloring and fading of color images as well as yellowing of background portions (in particular, color photographic papers) is a very serious problem.

For meeting these requirements for color photographic materials, the role of couplers as the color image-forming agents is large and improvement of coupler structures has been made. As one such improvement, phenol derivatives or naphthol derivatives are mainly used as cyan couplers but since the color images formed therefrom have unnecessary absorption in not only the red region but also blue regions and green regions, it cannot be said that they have satisfactory performances.

The imidazole cyan couplers described in British Patent 1,545,507 and European Patent 249,453A are excellent in light absorption characteristics of the color images formed, and are preferred for color reproduction.

However, when the imidazole cyan couplers are used for color photographic materials, the image storage stability of the color images formed after processing is inferior and, in particular, the color images are greatly faded by heat and humidity to give serious problems in practical use.

Since dyes derived from the imidazole couplers easily change to leuco dyes, recoloring of a cyan dye image portion in a bleaching or blix solution having a high desilvering property and a comparatively low pH is extremely deteriorated when the solution becomes to be fatigued. Such a defect has been a serious problem for attaining a quick and simple processing.

SUMMARY OF THE INVENTION

An object of this invention is, therefore, to provide a color photographic light-sensitive material satisfying the above requirements for color photographic materials.

That is, a first object of this invention is to provide a color photographic light-sensitive material having excellent color reproducibility, in particular cyan color images having good light absorption characteristics.

A second object of this invention is to provide a color photographic light-sensitive material giving color images having improved fastness in dark storage and under light irradiation.

A third object of this invention is to provide a color photographic light-sensitive material which is improved in the re-coloring property.

As the result of various investigations, the inventors have discovered that these and other objects can be attained by a silver halide color photographic material composed of a support having thereon at least one silver halide photographic emulsion layer containing an emulsified dispersion of oleophilic fine particles obtained by dispersing a mixed solution of at least one cyan coupler represented by the following formulae (I) or (II) and at least one water-insoluble and organic solvent-soluble homopolymer or copolymer:

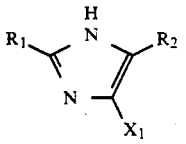

(I)

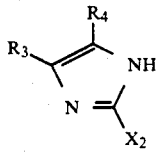

(II)

wherein $R_1$, $R_2$, $R_3$, and $R_4$ each represents hydrogen, an aliphatic group, an aromatic group, a heterocyclic group, an aromatic amino group, a heterocyclic amino group, an aliphatic amino group, an acylamino group, a sulfonamido group, a carbamoyl group, a sulfamoyl group, a ureido group, an aliphatic oxycarbonyl group, an aromatic oxycarbonyl group, an aliphatic oxycarbonylamino group, an aromatic oxycarbonylamino group, a carboxy group, or a cyano group; and $X_1$ and $X_2$ each represents hydrogen or an atom or a group capable of being released by a coupling reaction with the oxidized product of a color developing agent (hereinafter, the atom or the group is referred to as releasing group); provided that $R_2$ and $X_1$ or $R_3$ and $R_4$ may be linked to form a 5- to 7-membered ring; the cyan coupler may form a dimer or higher polymer at $R_1$, $R_2$ or $X_1$, or at $R_3$, $R_4$ or $X_2$; and excluding that $R_1$ and $R_2$ or $R_3$ and $R_4$ are a combination of the atoms and/or the groups selected from hydrogen atoms, carboxy groups, and cyano groups and excluding that $R_3$ and $R_4$ combine with each other to form a 5- to 7-membered ring containing two or more double bonds.

DETAILED DESCRIPTION OF THE INVENTION

In the present invention an alkyl and aryl groups (or moieties) represent a substituted and unsubstituted alkyl and aryl groups (or moieties), respectively.

Couplers represented by formula (I) or (II) have carbon atoms of such a number that the couplers are rendered to be non-diffusible in emulsion layers even under wet state.

In formula (I) or (II) described above, $X_1$ and $X_2$ each is, for example, hydrogen, a halogen atom, —$SO_3M$ and —COOM (wherein M represents H, an alkali metal atom (e.g., Na, K) and $NH_4$) an alkoxy group, an acyloxy group, an aryloxy group, a heterocyclic oxy group, an alkylthio group, an arylthio group, a heterocyclic thio group. $X_1$ and $X_2$ are preferably hydrogen, a halogen atom (e.g., fluorine, chlorine, and bromine), an alkoxy group, an aryloxy group, or an alkylthio group, more preferably hydrogen or a halogen atom, and particularly preferably a chlorine atom.

In the present invention examples of a heterocyclic group include a 5- to 7-membered ring containing at least one of N, O and S atoms as hetero atom.

$R_1$, $R_2$, $R_3$, and $R_4$ each represents preferably hydrogen, an aliphatic group having from 1 to 50 carbon atoms (e.g., methyl, propyl, and hexadecyl), an aromatic group having from 6 to 50 carbon atoms (e.g., phenyl and naphthyl), a heterocyclic ring having not more than 50 carbon atoms (e.g., 3-pyridyl and 2-furyl), an aromatic or heterocyclic amino group having not more than 50 carbon atoms (e.g., anilino, naphthylamino, 2-benzothiazolylamino, and 2-pyridylamino), an aliphatic amino group having from 1 to 50 carbon atoms (e.g., propylamino and butylamino), an acylamino group having from 1 to 50 carbon atoms (e.g., acetylamino, benzoylamino, and nicotinamido), a sulfonamido group having from 1 to 50 carbon atoms (e.g., methanesulfonamido and p-toluenesulfonamido), a carbamoyl group having from 1 to 50 carbon atoms (e.g., N-ethylcarbamoyl, N,N-diethylcarbamoyl, N-phenylcarbamoyl, and N-pyridylcarbamoyl), a sulfamoyl group having from 0 to 50 carbon atoms (e.g., N-methylsulfamoyl and N,N-dibutylsulfamoyl), a ureido group having from 1 to 50 carbon atoms (e.g., p-cyanophenylureido, naphthylureido, butylureido, and pyridylureido), an aliphatic oxycarbonyl group having from 2 to 50 carbon atoms (e.g., methoxycarbonyl, ibutoxycarbonyl, and dodecyloxycarbonyl), an aromatic oxycarbonyl group having from 7 to 50 carbon atoms (e.g., phenoxycarbonyl and naphthyloxycarbonyl), an aliphatic or aromatic oxycarbonylamino group (e.g., phenoxycarbonylamino, and hexadecyloxyphenoxycarbonylamino), a carboxy group, or a cyano group.

The aforesaid groups exclusive of the carboxy group and the cyano group may be substituted by an alkyl group, an aryl group, a heterocyclic group, an alkoxy group (e.g., methoxy and 2-methoxyethoxy), an aryloxy group (e.g., 2,4-di-tert-amylphenoxy, 2-chlorophenoxy, and 4-cyanophenoxy), an alkenyloxy group (e.g., 2-propenyloxy), an acyl group (e.g., acetyl and benzoyl), an ester group (e.g., butoxycarbonyl, phenoxycarbonyl, acetoxy, benzoyloxy, butoxysulfonyl, and toluenesulfonyloxy), an amido group (e.g., acetylamino), a carbamoyl group (e.g., ethylcarbamoyl, dimethylcarbamoyl), a sulfamoyl group (e.g., butylsulfamoyl), a sulfamido group (e.g., methanesulfonamido), a sulfamoylamino group (e.g., dipropylsulfamoylamino), a carbamoylamine group, an imido group (e.g., succinimido and hydantoinyl), a ureido group (e.g., phenylureido and dimethylureido), an aliphatic or aromatic sulfonyl group (e.g., methanesulfonyl and phenylsulfonyl), an aliphatic or aromatic thio group (e.g., ethylthio and phenylthio), a hydroxy group, a cyano group, a carboxy group, a nitro group, a sulfo group, or a halogen atom.

The term "aliphatic group" as used herein means a straight chain, branched or cyclic aliphatic hydrocarbon group including a saturated and unsaturated groups such as an alkyl group, an alkenyl group or an alkynyl group. Typical examples thereof are methyl, ethyl, butyl, dodecyl, octadecyl, eicosenyl, iso-propyl, tert-butyl, tert-octyl, tert-dodecyl, cyclohexyl, cyclopentyl, allyl, vinyl, 2-hexadecenyl, and propargyl.

$R_1$, $R_2$, $R_3$, and $R_4$ each more preferably represents hydrogen, an aromatic group having from 6 to 50 carbon atoms substituted by a halogen atom, an alkyl group, an alkoxy group, a carbamoyl group, a sulfamoyl group, an alkoxycarbonyl group, a carboxy group, a cyano group, a nitro group, —$NHCOR_5$, —$NHCONR_5R_6$, —$NHCOOR_5$, —$NHSO_2R_5$, —$NHSO_2NR_5R_6$, —$NHR_5$ (wherein $R_5$ and $R_6$ each represents hydrogen, an alkyl group, or an aryl group), or a hydroxy group; or an aliphatic group having from 1 to 50 carbon atoms.

In this case, at least one of $R_1$ and $R_2$ or at least one of $R_3$ and $R_4$ is preferably an aromatic group having from 6 to 50 carbon atoms substituted by —$NHCOR_5$, —$NHCONR_5R_6$, —$NHCOOR_5$, —$NHSO_2R_5$, —$NHSO_2NR_5R_6$, —$NHR_5$, or a hydroxy group, and particularly preferably a phenyl group having at least one of the aforesaid substituents at the ortho-position.

In formula (I) described above, $R_2$ and $X_1$ may combine with each other to form a 5- to 7-membered ring.

In formula (II), $R_3$ and $R_4$ may combine with each other to form a 5- to 7-membered ring excluding, however, the case that the ring has two or more double bonds.

The compound of formula (I) or (II) may form a dimer or high polymer coupler at $R_1$, $R_2$, or $X_1$ in formula (I) or at $R_3$, $R_4$, or $X_2$ in formula (II). When the coupler shown by the formula forms a dimer, the aforesaid group is a simple bond or a divalent linkage group (e.g., a divalent group such as an alkylene group, an arylene group, an ether group, an ester group, an amido group, or a divalent group composed of a combination thereof). When the coupler is an oligomer or a polymer, it is preferred that the group is the main chain of the oligomer or polymer or bonds to the main chain of the oligomer or polymer through the divalent group as described above for the dimer. Also, when the coupler forms a polymer, the coupler may be a homopolymer of the coupler derivative or may form a copolymer with other non-coloring ethylenically unsaturated monomer or monomers (e.g., acrylic acid, methacrylic acid, methyl acrylate, n-butylacrylamide, β-hydroxy methacrylate, vinyl acetate, acrylonitrile, styrene, crotonic acid, maleic anhydride, and N-vinylpyrrolidone).

Couplers represented by formula (I) or (II) and synthesis methods thereof are disclosed in, for example, EP0249453A2.

Specific examples of the preferred cyan couplers for use in this invention represented by formulae (I) or (II) are illustrated below but the invention is not to be construed as being limited to them.

(C-1)
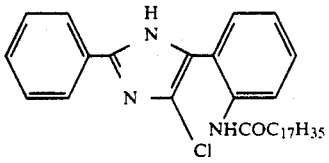
(C-2)
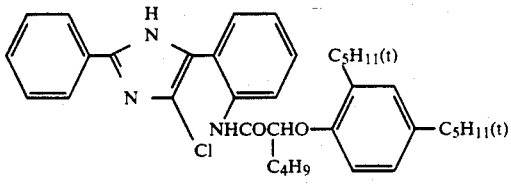
(C-3)
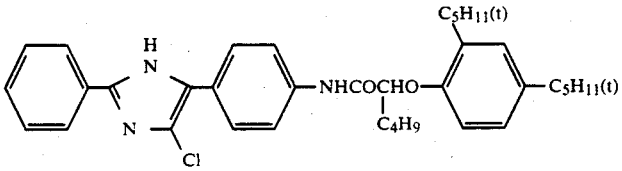
(C-4)
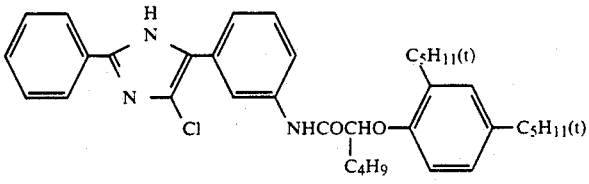
(C-5)
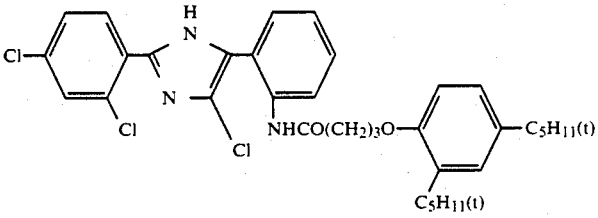
(C-6)
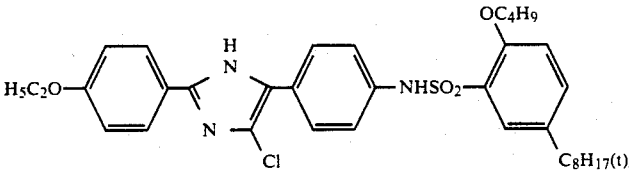
(C-7)
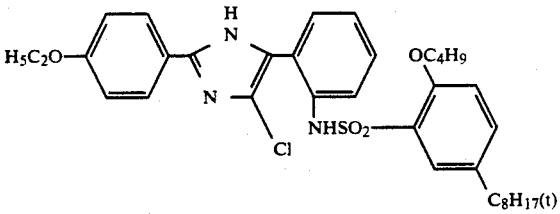
(C-8)
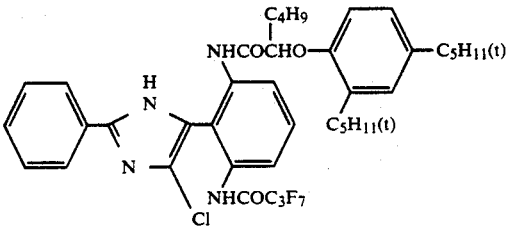

-continued
(C-9)
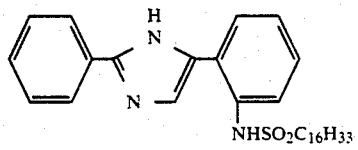
(C-9)
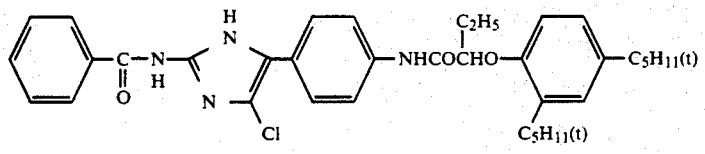
(C-10)
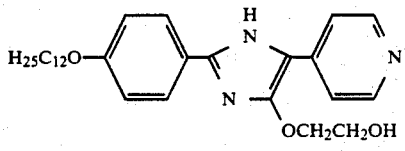
(C-11)
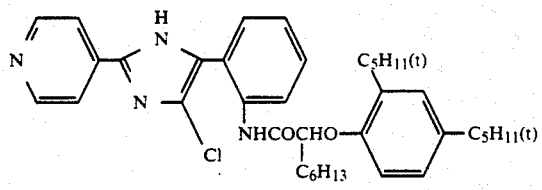
(C-12)
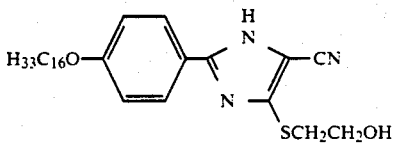
(C-13)
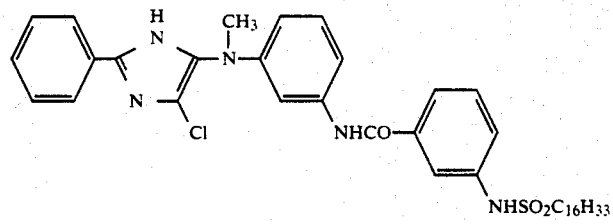
(C-14)
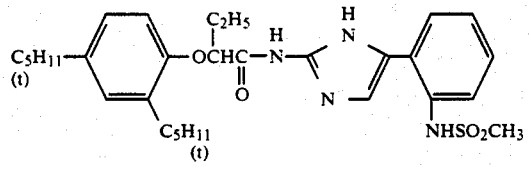
(C-15)
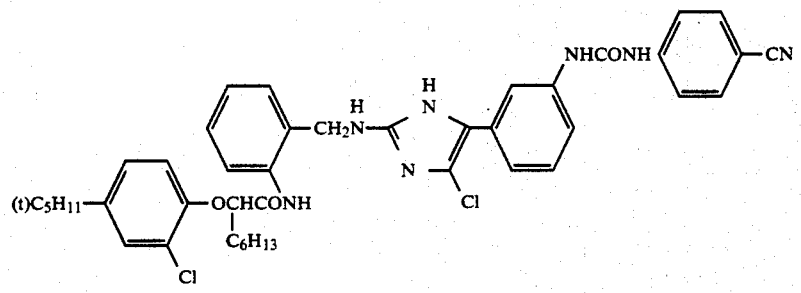
(C-16)
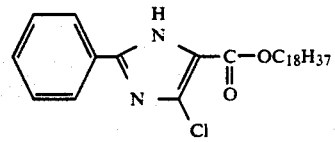

-continued
(C-17)
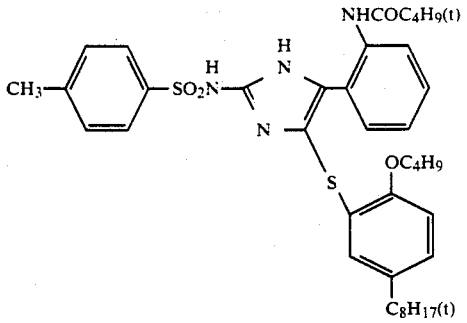
(C-18)
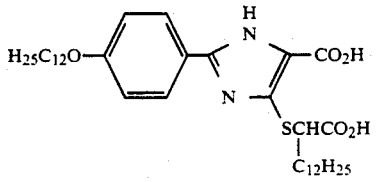
(C-19)
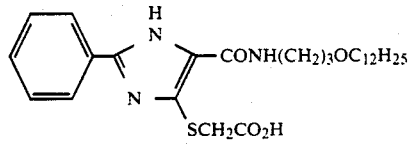
(C-20)
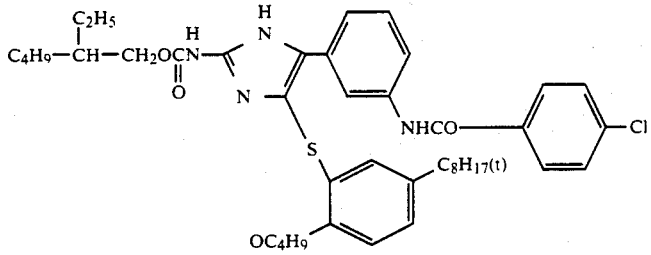
(C-21)
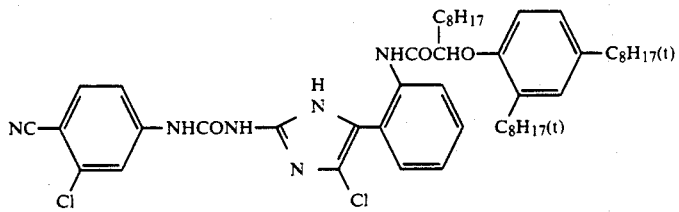
(C-22)
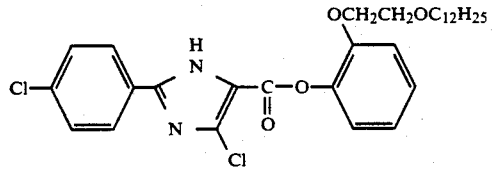
(C-23)
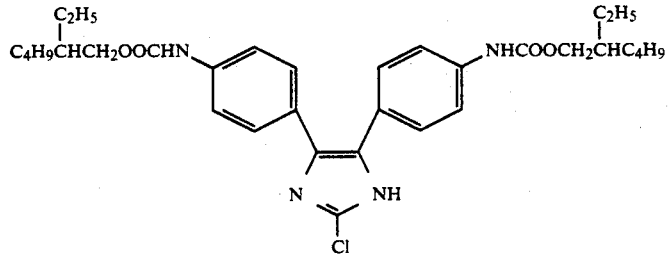

-continued
(C-24)
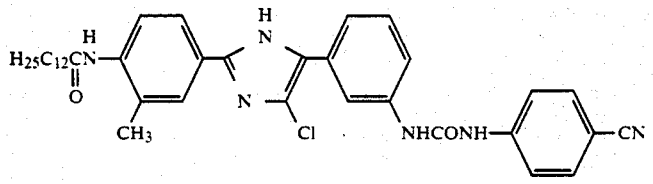
(C-25)
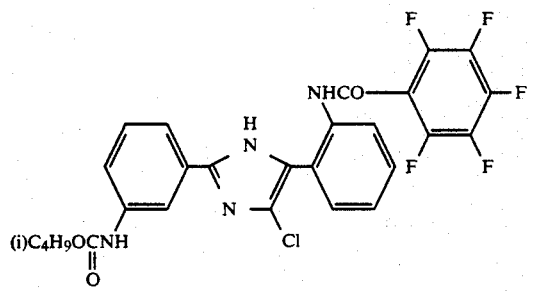
(C-26)
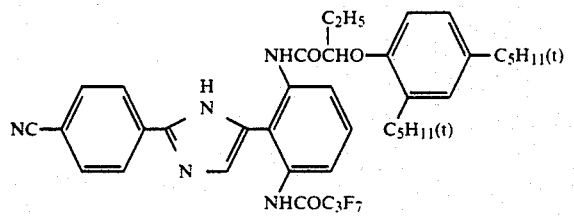
(C-27)
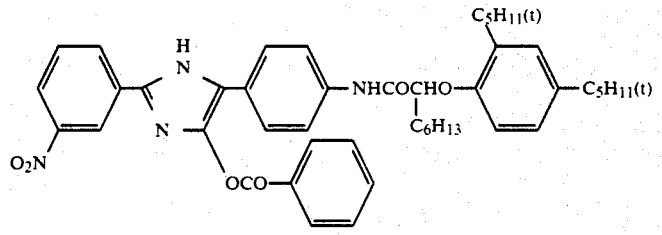
(C-28)
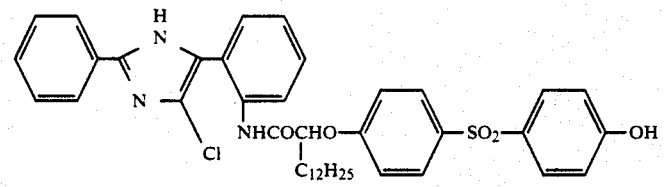
(C-29)
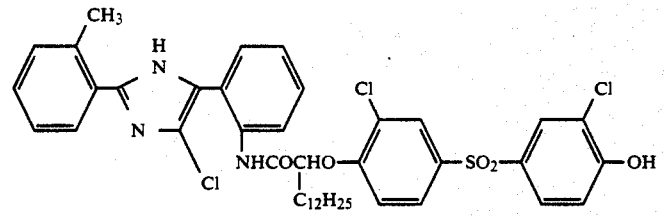
(C-30)
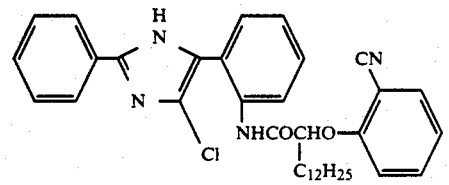

-continued
(C-31)
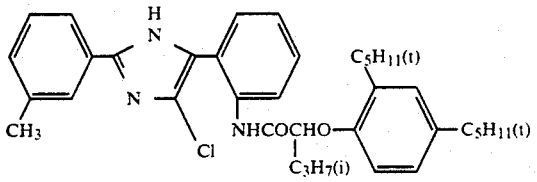
(Hereinafter the ratio of x and y, or x, y and z are shown by weight ratio.)
(C-32)
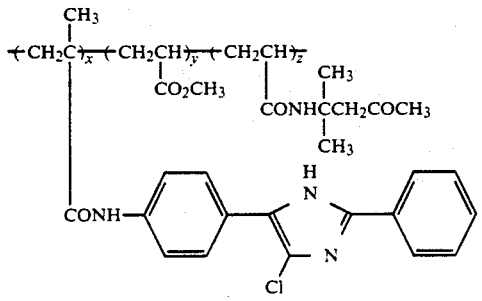
x/y/z = 50/20/30
(C-33)
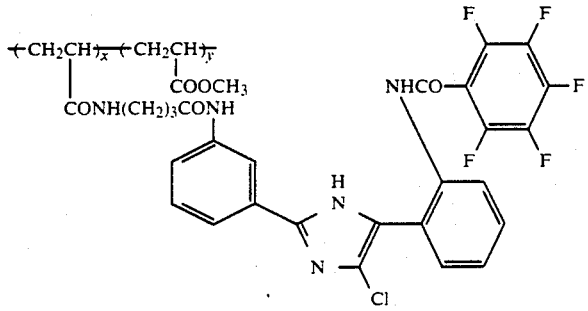
x/y = 55/45
(C-34)
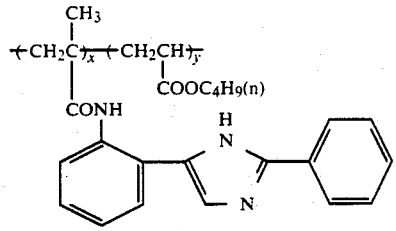
x/y = 60/40
(C-35)
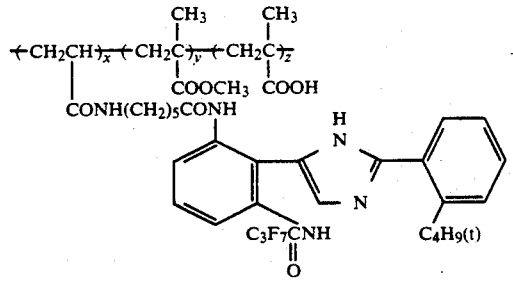
x/y/z = 55/40/5

-continued (C-36)

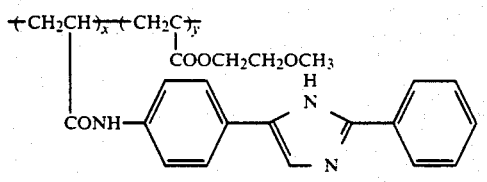

x/y = 60/40

(C-37)

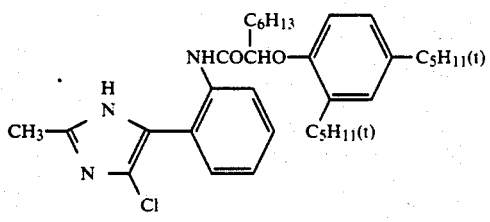

(C-38)

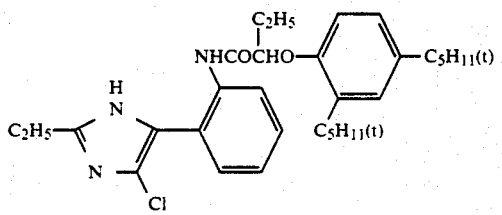

(C-39)

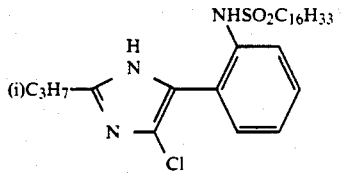

(C-40)

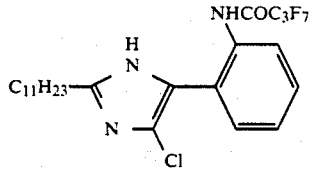

(C-41)

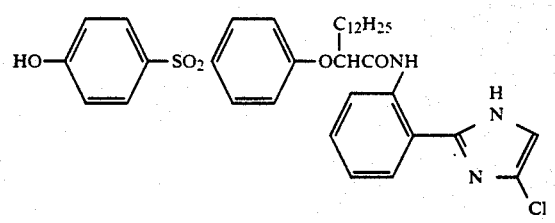

(C-42)

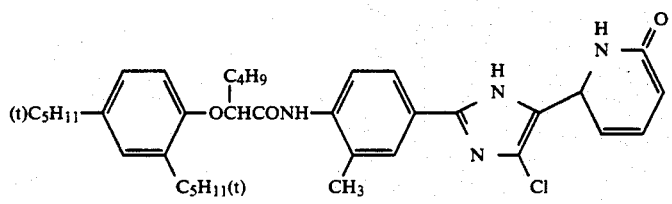

The water-insoluble and organic solvent soluble polymer for use in this invention has a glass transition point of preferably at least 60° C., and more preferably at least 90° C.

The preferred structure of the polymer described above is as follows.

1) A water-insoluble and organic solvent soluble homopolymer or copolymer wherein the recurring unit constituting the polymer has a bond

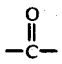

in the main chain or the side chain thereof.

The following polymers are more preferred.

2) A water-insoluble and organic solvent soluble homopolymer or copolymer wherein the recurring unit constituting the polymer has a bond

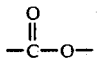

in the main chain or the side chain thereof,.

3) A water-insoluble and organic solvent soluble homopolymer or copolymer wherein the recurring unit constituting the polymer has a bond

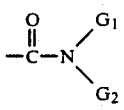

(wherein $G_1$ and $G_2$ each represents hydrogen, a substituted or unsubstituted alkyl group or a substituted or unsubstituted aryl group excluding the case that both of $G_1$ and $G_2$ are hydrogen in the main chain or the side chain thereof.

The more preferred polymer is polymer 3), wherein one of $G_1$ and $G_2$ is a hydrogen atom and the other is a substituted or unsubstituted alkyl group having from 3 to 12 carbon atoms or a substituted or unsubstituted aryl group having from 6 to 12 carbon atoms.

Specific examples of the polymers for use in this invention are described below, but the invention is not to be considered as being limited to them.

(A) Vinyl Polymers

When the polymer for use in this invention is a vinyl polymer, examples of the monomer forming the vinyl polymer are acrylic acid esters such as, methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-iso-propoxy acrylate, 2-butoxyethyl acrylate, 2-(2-methoxyethoxy)ethyl acrylate, 2-(2-butoxyethoxy)ethyl acerylate, ω-methoxypolyethylene glycol acrylate (addition mol number n=9), 1-bromo-2-methoxyethyl acrylate, and 1,1-dichloro-2-ethoxyethyl acrylate.

Other polymers for use in this invention are polymers formed by polymerizing the following monomers.

Methacrylic acid esters: Specific examples are methyl methacrylate, ethyl methacrylate, n-propyl methacrylate, isopropyl. methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate. triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-iso-propoxyethyl methacrylate, 2-butoxyethyl methacrylate, 2-(2-methoxyethoxy)ethyl methacrylate, 2-(2-ethoxyethoxy)ethylmethacrylate, 2-(2-butoxyethoxy)ethylmethacrylate, ω-methoxypolyethylene glycol methacrylate (addition mol number n=6), allyl methacrylate, and dimethylaminoethyl methacrylate methyl chloride salt.

Vinyl esters: Specific examples are vinyl acetate, vinyl propionate, vinyl butylate, vinyl isobutylate, vinyl caproate, vinyl chloroacetate, vinyl methoxy acetate, vinylphenyl acetate, vinyl benzoate, and vinyl salicylate.

Acrylamides: Specific examples are acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide, N-(2-acetoacetoxyethyl)acrylamide, and diacetoneacrylamide.

Methacrylamides: Specific examples are methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylate, β-cyanoethylmethacrylate, and N-(2-acetoacetoxyethyl)methacrylamide.

Olefins: Specific examples are dicyclopentadiene, ethylene, propylene, 1-butene, 1-pentene, vinyl chloride, vinylidene chloride, isoprene, chloroprene, butadiene, and 2,3-dimethylbutadiene.

Styrenes: Specific examples are styrene, methylstyrene, dimethylstyrene, trimethylstyrene, ethylstyrene, isopropylstyrene, chloromethylstyrene, methoxystyrene acetoxystyrene, chlorostyrene, dichlorostyrene, bromostyrene, and vinylbenzoic acid methyl ester.

Vinyl ethers: Specific examples are methyl vinyl ether, butyl vinyl ether, hexyl vinyl ether, methoxy ethylvinyl ether, and dimethylaminoethyl vinyl ether.

Other monomers for forming the polymers for use in this invention are butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, metacrylonitrile, vinylidene chloride, methylenemalonitrile, and vinylidene.

For the polymers for use in this invention, two or more kinds of monomers (e.g., the aforesaid monomers) can be used for improving, for example, the solubility of couplers. Also, for improving the coloring property and solubility of couplers, monomers having the following acid groups can be used as comonomers in amounts not rendering the copolymers formed water-soluble.

That is, there are acrylic acid; methacrylic acid; itaconic acid; maleic acid; monoalkyl itaconates such as monomethyl itaconate, monoethyl itaconate, monobutyl itaconate; monoalkyl maleates such as monomethyl maleate, monoethyl maleate, monobutyl maleate; citraconic acid; styrenesulfonic acid; vinylbenzylsulfonic acid; vinylsulfonic acid; acryloyloxyalkylsulfonic acids such as acryloyloxymethylsulfonic acid, acryloyloxyethylsulfonic acid, acryloyloxypropylsulfonic acid; methacryloyloxyalkylsulfonic acids such as methacryloyloxymethylsulfonic acid, methacryloyloxyethylsulfonic acid, methacryloyloxypropylsulfonic acid; acrylamidoalkylsulfonic acids such as 2-acrylamido-2-methylethanesulfonic acid, 2-acrylamido-2-methylpropanesulfonic acid, 2-acrylamido-2-methylbutanesulfonic acid; and methacrylamidoalkylsulfonic acids such as 2-methacrylamido-2-methylethanesulfonic acid, 2-methacrylamido-2-methylpropanesulfonic acid, and 2-methacrylamido-2-methylbutanesulfonic acid.

These acids may be in the form of salts of an alkali metal (e.g., Na and K) or ammonium ion.

When a hydrophilic vinyl monomer (the monomer gives a water-insoluble homopolymer when polymerized) in the aforesaid vinyl monomers and other vinyl monomers for use in this invention is used as the comonomer for the vinyl polymer in this invention, there is no particular restriction on the content of the hydrophilic monomer in the copolymer if the copolymer formed is not water-soluble, but the content thereof is usually less than 40 mol %, preferably less than 20 mol %, and more preferably less than 10 mol %. Also, when the hydropholic comonomer for forming the vinyl polymer for use in this invention has an acid group, the content of the comonomer in the copolymer is usually less than 20 mol %, preferably less than 10%, and most preferably absent from the viewpoint of the image storage stability.

The monomers in the polymers for use in this invention are preferably methacrylates, acrylamides and methacrylamides, and particularly preferably acrylamides and methacrylamides.

(B) Polymers obtained by Condensation Polymerization Reaction or Polyaddition Reaction As polymers obtained by a condensation polymerization reaction, there are generally known a polyester reaction product of a polyhydric alcohol and a polybasic acid, and a polyamide reaction product of a diamine and a dibasic acid, and ω-amino-ω-carboxylic acid. As polymers obtained by an polyaddition reaction, there is known a polyurethane reaction product of a diisocyanate and a dihydric alcohol.

As an effective polyhydric alcohol, there are glycols having the structure HO—$R_1$—OH (wherein $R_1$ represents a hydrocarbon chain having from 2 to about 12 carbon atoms, and particularly an aliphatic hydrocarbon chain) and polyalkylene glycols. As an effective polybasic acid, there are those having the structure HOOC—$R_2$—COOH (wherein $R_2$ represents a single bond or a hydrocarbon chain having from 1 to about 12 carbon atoms).

Specific examples of the polyhydric alcohol are ethylene glycol, diethylene glycol, triethylene glycol, 1,2-propylene glycol, 1,3-propylene glycol, trimethylolpropane, 1,4-butanediol, isobutyrenediol, 1,5-pentadiol, neopentylglycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, glycerol, diglycerol, triglycerol, 1-methylglycerol, erythrite, mannitol, and sorbitol.

Specific examples of the polyhydric acid are citric acid, succinic acid, glutaric acid, adipic acid, pimelic acid, cork acid, azelaic acid, sebacic acid, nonanedicarboxylic acid, decanedicarboxylic acid, undecandicarboxylic acid, dodecandicarboxylic acid, fumaric acid, maleic acid, itaconic acid, citraconic acid, phthalic acid, isophthalic acid, tetrachlorophthalic acid, isopimelic acid, a cyclopentadiene-maleic anhydride addition product, and a rosin-maleic anhydride addition product.

(C) Other Polymers

For example, there is a polyester obtained by the following ring-opening polymerization.

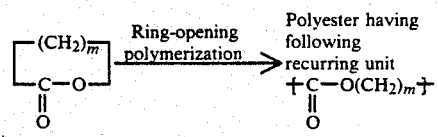

wherein m represents an integer of from 4 to 7 and the —$CH_2$— chain may be branched.

As a proper monomer which can be used for forming the polyester, there are, for example, β-propiolactone, ε-caprolactone, and dimethylpropiolactone.

The polymers described above may be used singly or as a mixture thereof.

The molecular weight and the polymerization degree of the polymer for use in this invention do not substantially affect this invention, but the increase of the molecular weight thereof causes problems, e.g., much time is required for dissolving the polymer in an auxiliary solvent (an organic solvent having a boiling point of lower than 140° C.) and the polymer is difficult to be emulsified and to disperse due to the high solution viscosity to form large particles, which results in reducing the coloring property and making the coating property inferior. For solving these problems, a large amount of an auxiliary solvent may be used for lowering the viscosity of the solution of the polymer, but this presents a new problem in the coating step. From these considerations, the viscosity of the polymer when 30 g of the polymer is dissolved in 100 ml of an auxiliary solvent (at 25° C.) being used is preferably lower than 5,000 cps, and more preferably lower than 2,000 cps. Also, the molecular weight of the polymer for use in this invention is preferably from 1,000 to 150,000, and more preferably from 10,000 to 100,000. When the molecular weight is less than 1,000 the effects of the present invention tends to be insufficient.

The term "water-insoluble polymer" in this invention means a polymer having a solubility in 100 g of distilled water (at 25° C.) not higher than 3 g, and more preferably not higher than 1 g.

The ratio of the polymer for use in this invention depends upon the kind of the polymer being used, and is selected in a wide range according to the solubility thereof in the auxiliary solvent, the polymerization degree, or the solubility of couplers. Usually, an auxiliary solvent is used in an amount necessary for imparting a sufficiently low viscosity to a solution prepared by dissolving at least a coupler, a high-boiling point solvent for coupler, and the polymer in the auxiliary solvent such that the solution is easily dispersed in water or a hydrophilic colloid aqueous solution. Since the viscosity of the solution of the polymer becomes higher as the polymerization degree of the polymer is higher, the ratio of the polymer to the auxiliary solvent differs but is preferably in the range of from 1/1 to 1/50 (by weight). The ratio of the polymer to a coupler being used is preferably from 1/20 to 20/1, and more preferably from 1/10 to 10/1 (by weight). When the amount of the polymer is too large dispersibility tends to be deteriorated and thickness of the emulsion layer becomes undesirably high.

The addition amount of the cyan coupler shown by formula (I) or (II) described above is generally from $2\times10^{-3}$ mol to $5\times10^{-1}$ mol, and preferably from $1\times10^{-2}$ to $5\times10^{-1}$ mol per mol of the silver halide in the silver halide emulsion layer containing the coupler.

Specific examples of the polymer for use in this invention are illustrated below, but the invention is not to be considered as being limited to them.

P-1 Polyvinyl acetate
P-2 Polyvinyl propionate
P-3 Polymethyl methacrylate
P-4 Polyethyl methacrylate
P-5 Polyethyl acrylate
P-6 Vinyl acetate-vinyl alcohol copolymer (95:5 by weight; the same hereinafter)
P-7 Poly-n-butyl acrylate
P-8 Poly-n-butyl methacrylate
P-9 Polyisobutyl methacrylate
P-10 Polyisopropyl methacrylate
P-11 Polydecyl methacrylate
P-12 n-Butyl acrylate-acrylamide copolymer (95:5)
P-13 Polymethyl chloroacrylate
P-14 1,4-Butanediol-adipic acid polyester
P-15 Ethylene glycol-sebacic acid polyester
P-16 Polycaprolactone
P-17 Poly(2-tert-butylphenyl acrylate)
P-18 Poly(4-tert-butylphenyl acrylate)
P-19 n-Butyl methacrylate-N-vinyl-2-pyrrolidone copolymer (90:10)
P-20 Methyl methacrylate-vinyl chloride copolymer (70:30)
P-21 Methyl methacrylate-styrene copolymer (90:10)
P-22 Methyl methacrylate-ethyl acrylate copolymer (50:50)
P-23 n-Butyl methacrylate-methyl methacrylate-styrene copolymer (50:30:20)
P-24 Vinyl acetate-acrylamide copolymer (85:15)
P-25 Vinyl chloride-vinyl acetate copolymer (65:35)
P-26 Methyl methacrylate-acrylonitrile copolymer (65:35)
P-27 Diacetonacrylamide-methyl methacrylate copolymer (50:50)
P-28 Vinyl methyl ketone-isobutyl methacrylate copolymer (55:45)
P-29 Ethyl methacrylate-n-butyl acrylate copolymer (70:30)
P-30 Diacetonacrylamide-n-butyl acrylate copolymer (60:40)
P-31 Methyl methacrylate-cyclohexyl methacrylate copolymer (50:50)
P-32 n-Butyl acrylate-styrene methacrylate-diacetonacrylamide copolymer (70:20:10)
P-33 N-Tert-butylmethacrylamide-methyl methacrylate-acrylic acid copolymer (60:30:10)
P-34 Methyl methacrylate-styrene-vinylsulfonamide copolymer (70:20:10)
P-35 Methyl methacrylate-phenyl vinyl ketone copolymer (70:30)
P-36 n-Butyl acrylate-methyl methacrylate-n-butyl methacrylate copolymer (35:35:30)
P-37 n-Butyl methacrylate-pentyl methacrylate-N-vinyl-2-pyrrolidone copolymer (38:38:24)
P-38 Methyl methacrylate-n-butyl methacrylate-isobutyl methacrylate-acrylic acid copolymer (37:29:25:9)
P-39 n-Butyl methacrylate-acrylic acid (95:5)
P-40 Methyl methacrylate-acrylic acid copolymer (95:5)
P-41 Bnezyl methacrylate-acrylic acid copolymer (90:10)
P-42 n-Butyl methacrylate-methyl methacrylate-benzyl methacrylate-acrylic acid copolymer (35:35:25:5)
P-43 n-Butyl methacrylate-methyl methacrylate-benzyl methacrylate copolymer (35:35:30)
P-44 Poly(3-pentylacrylate)
P-45 Cyclohexyl methacrylate-methyl methacrylate-n-propyl methacrylate copolymer (37:29:34)
P-46 Polypentyl methacrylate
P-47 Methyl methacrylate-n-butyl methacrylate copolymer (65:35)
P-48 Vinyl acetate-vinyl propionate copolymer (75:25)
P-49 n-Butyl methacrylate-sodium 3-acryloxybutane-1-sulfonate copolymer (97:3)
P-50 n-Butyl methacrylate-methyl methacrylate-acrylamide copolymer (35:35:30)
P-51 n-Butyl methacrylate-methyl methacrylate-vinyl chloride copolymer (37:36:27)
P-52 n-Butyl methacrylate-styrene copolymer (90:10)
P-53 Methyl methacrylate-N-vinyl-2-pyrrolidone copolymer (90:10)
P-54 n-Butyl methacrylate-vinyl chloride copolymer (90:10)
P-55 n-Butyl methacrylate-styrene copolymer (70:30)
P-56 Poly(N-sec-butylacrylamide)
P-57 Poly(N-tert-butylacrylamide)
P-58 Diacetonacrylamide-methyl methacrylate copolymer (62:38)
P-59 Polycyclohexyl methacrylate-methyl methacrylate copolymer (60:40)
P-60 N-tert-Butylacrylamide-methyl methacrylamide copolymer (40:60)
P-61 Poly(N-n-butylacrylamide)
P-62 Poly(tert-butyl methacrylate)-N-tert-butyl methacrylamide copolymer (50:50)
P-63 Tert-butyl methacrylate-methyl methacrylate copolymer (70:30)
P-64 Poly(N-tert-butylmethacrylamide)
P-65 N-Tert-butylacrylamide-methyl methacrylamide copolymer (60:40)
P-66 Methyl methacrylate-acrylonitrile copolymer (70:30)
P-67 Methyl methacrylate-vinyl methyl ketone copolymer (38:62)
P-68 Methyl methacrylate-styrene copolymer (75:25)
P-69 Methyl methacrylate-hexyl methacrylate copolymer (70:30)
P-70 Poly(benzyl acrylate)
P-71 Poly(4-biphenyl acrylate)
P-72 Poly(4-butoxycarbonylphenyl acrylate)
P-73 Poly(sec-butyl acrylate)
P-74 Poly(tert-butyl acrylate)
P-75 Poly[3-chloro-2,2-bis(chloromethyl)propyl acrylate]
P-76 Poly(2-chlorophnyl acrylate)
P-77 Poly(4-chlorophenyl acrylate)
P-78 Poly(pentachlorophenyl acrylate)
P-79 Poly(4-cyanobenzyl acrylate)

P-80 Poly(cyanoethylacrylate)
P-81 Poly(4-cyanophenyl acrylate)
P-82 Poly(4-cyano-3-butyl acrylate)
P-83 Poly(cyclohexyl acrylate)
P-84 Poly(2-ethoxycarbonylphenyl acrylate)
P-85 Poly(3-ethoxycarbonylphenyl acrylate)
P-86 Poly(4-ethoxycarbonylphenyl acrylate)
P-87 Poly(2-ethoxyethyl acrylate)
P-88 Poly(3-ethoxypropyl acrylate)
P-89 Poly(1H,1H,5H-octafluoropentyl acrylate)
P-90 Poly(heptyl acrylate)
P-91 Poly(hexadecyl acrylate)
P-92 Poly(hexyl acrylate)
P-93 Poly(isobutyl acrylate)
P-94 Poly(isopropyl acrylate)
P-95 Poly(3-methoxybutyl acrylate)
P-96 Poly(2-methoxycarbonylphenyl acrylate)
P-97 Poly(3-methoxycarbonylphenyl acrylate)
P-98 Poly(4-methoxycarbonylphenyl acrylate)
P-99 Poly(2-methoxyethyl acrylate)
P-100 Poly(4-methoxyphenyl acrylate)
P-101 Poly(3-methoxypropyl acrylate)
P-102 Poly(3,5-dimethyladamantyl acrylate)
P-103 Poly(3-dimethylaminophenyl acrylate)
P-104 Polyvinyl-tert-butyrate
P-105 Poly(2-methylbutyl acrylate)
P-106 Poly(3-methylbutyl acrylate)
P-107 Poly(1,3-dimethylbutyl acrylate)
P-108 Poly(2-methylpentyl acrylate)
P-109 Poly(2-naphthyl acrylate)
P-110 Poly(phenyl methacrylate)
P-111 Poly(propyl acrylate)
P-112 Poly(m-tolyl acrylate)
P-113 Poly(o-tolyl acrylate)
P-114 Poly(p-tolyl acrylate)
P-115 Poly(N,N-dibutyl acrylate)
P-116 Poly(isohexylacrylamide)
P-117 Poly(isooctylacrylamide)
P-118 Poly(N-methyl-N-phenylacrylamide)
P-119 Poly(adamantyl methacrylate)
P-120 Poly(benzyl methacrylate)
P-121 Poly(2-bromoethyl methacrylate)
P-122 Poly(2-N-tert-butylaminoethyl methacrylate)
P-123 Poly(sec-butyl methacrylate)
P-124 Poly(tert-butyl methacrylate)
P-125 Poly(2-chloroethyl methacrylate)
P-126 Poly(2-cyanoethyl methacrylate)
P-127 Poly(2-cyanomethylphenyl methacrylate)
P-128 Poly(4-cyanophenyl methacrylate)
P-129 Poly(cyclohexyl methacrylate)
P-130 Poly(dodecyl methacrylate)
P-131 Poly(diethylaminoethyl methacrylate)
P-132 Poly(2-ethylsulfinylethyl methacrylate)
P-133 Poly(hexadecyl methacrylate)
P-134 Poly(hexyl methacrylate)
P-135 Poly(2-hydroxypropyl methacrylate)
P-136 Poly(4-methoxycarbonylphenyl methacrylate)
P-137 Poly(3,5-dimethyladamantyl methacrylate)
P-138 Poly(dimethylaminoethyl methacrylate
P-139 Poly(3,3-dimethylbutyl methacrylate)
P-140 Poly(3,3-dimethyl-2-butyl methacrylate)
P-141 Poly(3,5,5-trimethylhexyl methacrylate)
P-142 Poly(octadecyl methacrylate)
P-143 Poly(tetradecyl methacrylate)
P-144 Poly(4-butoxycarbonylphenyl methacrylate)
P-145 Poly(4-carboxyphenylmethacrylamide)
P-146 Poly(4-ethoxycarbonylphenylmethacrylamide)
P-147 Poly(4-methoxycarbonylphenylmethacrylamide)
P-148 Poly(butoxycarbonylbutyl methacrylate)
P-149 Poly[butyl(2-chloro)acrylate]
P-150 Poly[butyl(2-cyano)acrylate]
P-151 Poly[cyclohexyl(2-chloro)acrylate]
P-152 Poly[ethyl(2-chloro)acrylate]
P-153 Poly(ethoxycarbonylethyl methacrylate)
P-154 Poly(ethyl ethacrylate)
P-155 Poly[ethyl(2-fluoro)acrylate]
P-156 Poly(hexyloxycarbonylhexyl methacrylate)
P-157 Poly[isobutyl(2-chloro)acrylate]
P-158 Poly[isopropyl(2-chloro)acrylate]
P-159 Trimethylenediamine-glutaric acid polyamide
P-160 Hexamethylenediamine-adipic acid polyamide
P-161 Poly(α-pyrrolidone)
P-162 Poly(ε-caprolactam)
P-163 Hexamethylenediisocyanate-1,4-ditandiolpolyurethane
P-164 p-Phenylenediisocyanate-ethylene glycol polyurethane It is considered that the polymer used in the present invention reduces the mutual action among dyes thereby discoloration of the dyes is prevented.

Synthesis examples of the aforesaid polymers are illustrated below.

SYNTHESIS EXAMPLE (1)

Synthesis of Methyl Methacrylate Polymer (P-3)

In a 500 ml three-neck flask were placed 50.0 g of methyl methacrylate, 0.5 g of sodium polyacrylate, and 200 ml of distilled water and the mixture was heated to 80° C. with stirring under a nitrogen gas stream. Then, 500 mg of dimethyl azobisisobutyrate was added to the mixture as a polymerization initiator to initiate the polymerization.

After performing the polymerization for 2 hours, the polymer solution formed was cooled and the bead-form polymer was collected by filtration and washed with water to provide 48.7 g of Polymer P-3 (M.W.: 100,000).

SYNTHESIS EXAMPLE (2)

Synthesis of t-Butylacrylamide Polymer (P-57)

In a 500 ml three-neck flask was placed a mixture of 50.0 g of t-butylacrylamide and 250 ml of toluene and the mixture thus obtained was heated to 80° C. with stirring under a nitrogen gas stream. Then, 10 ml of a toluene solution containing 500 ml of azobisisobutyronitrile as a polymerization initiator was added to the mixture to initiate polymerization.

After performing the polymerization for 3 hours, the polymer solution formed was cooled and poured into one liter of hexane to deposit solids, which were collected by filtration, washed with hexane, and dried by heating under reduced pressure to provide 47.9 g of Polymer P-57 (M.W.: 70,000).

The polymer for use in this invention is oil-soluble and it is preferred that the polymer is dissolved in a high-boiling point organic solvent together with the cyan coupler using, if necessary, a low-boiling point solvent, dispersed in water or an aqueous hydrophilic colloid solution, and added to a silver halide emulsion as the dispersion. In this case, if necessary, a hydroquinone derivative, an ultraviolet absorbent, or a conventional fading inhibitor, may be added thereto. Also, in this case, the polymers for use in this invention may be used as a mixture of two or more.

The addition method of the polymer(s) is now explained in more detail. One or more polymers for use in this invention and a coupler are simultaneously dissolved together with, if necessary, a hydroquinone derivative, an ultraviolet absorbent, or a fading inhibitor, in a high-boiling point solvent such as organic acid amides, carbamates, esters, ketones, or urea derivatives, and particularly in di-n-butyl phthalate, tricresyl phosphate, di-isooctyl azelate, di-n-butyl sebacate, tri-n-hexyl phosphate, N,N-diethylcaprylamidobutyl, n-pentadecyl phenyl ether, or fluorinated paraffin using, if necessary (for dissolving the polymer), a low-boiling point organic solvent such as ethyl acetate, butyl acetate, butyl propionate, cyclohexanol, cyclohexanetetrahydrofuran, (each of these high-boiling point solvents or low-boiling point solvents may be used singly or as a mixture thereof); the solution is mixed with an aqueous solution of a hydrophilic binder such as gelatin containing an anionic surface active agent such as alkylbenzenesulfonic acid, or alkylnaphthalenesulfonic acid, and/or a nonionic surface active agent such as sorbitansesquioleic acid ester, sorbitanmonolauric acid ester, followed by dispersing by emulsification using a high-speed rotary mixer, colloid mill, or supersonic dispersing means, and the dispersion is added to a silver halide emulsion.

Preferred examples of the high-boiling point organic solvent which can be used for dissolving the polymers and the coupler in this invention are those represented by following formulae (III) to (VII-2):

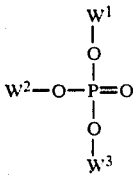
(III)

$W^1-COOW^2$ (IV)

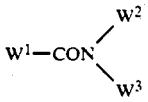
(V)

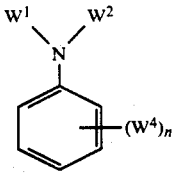
(VI)

$W^1-O-W^2$ (VII)

$HO-W^6$ (VII-2)

wherein $W^1$, $W^2$, and $W^3$ each represents an alkyl group, a cycloalkyl group, an alkenyl group, an aryl group, or a heterocyclic group, and each group may be substituted; $W^4$ represents $W^1$, O—$W^1$, or S—$W^1$; n represents an integer of from 1 to 5; when n is 2 to 5, plural $W^4$ groups may be the same or different, in formula (VII), $W^1$ and $W^2$ may be linked to form a condensed ring; and $W^6$ represents a substituted or unsubstituted alkyl group or a substituted or unsubstituted aryl group, the total number of carbon atoms constituting $W^6$ being 12 or more. The high-boiling point organic solvents have a boiling point of 140° C. or higher, preferably 160° C. or higher and more preferably 170° C. or higher.

Detailed descriptions with respect to formulae (III) to (VII-2) and examples thereof are disclosed in JP-A-215272.

Specific examples of the high-boiling point solvents shown which can be used in the present invention are shown below, but the invention is not to be considered as being limited to them.

$O{=}P{\leftarrow}C_4H_{9}\text{-}n)_3$ (S-1)

$O{=}P{\leftarrow}OCH_2CH_2CH(CH_3)_3)_3$ (S-2)

$O{=}P{\leftarrow}OC_6H_{13}\text{-}n)_3$ (S-3)

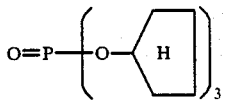
(S-4)

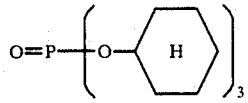
(S-5)

$O{=}P{\leftarrow}OC_8H_{17}\text{-}n)_3$ (S-6)

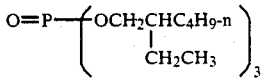
(S-7)

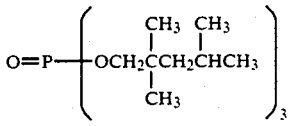
(S-8)

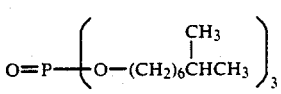
(S-9)

$O{=}P{\leftarrow}OC_9H_{19}\text{-}n)_3$ (S-10)

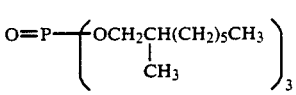
(S-11)

$O{=}P{\leftarrow}OC_{10}H_{21}\text{-}n)_3$ (S-12)

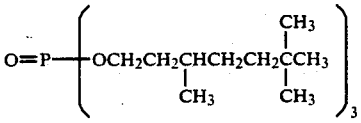
(S-13)

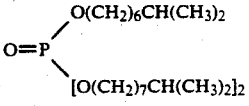
(S-14)

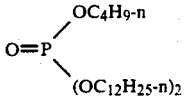
(S-15)

-continued
(S-16)
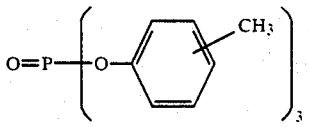
(S-17)
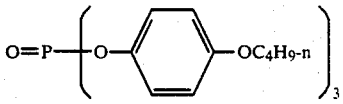
(S-18)
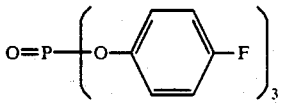
(S-19)
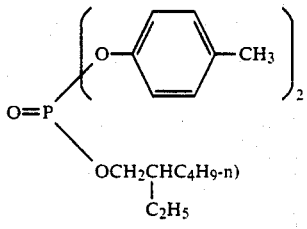
(S-20)
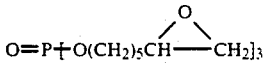
(S-21)
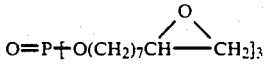
(S-22)
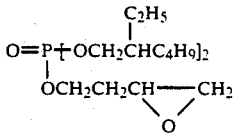
(S-23)
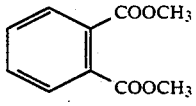
(S-24)
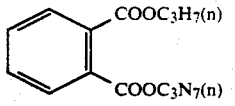
(S-25)
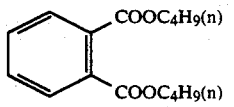
(S-26)
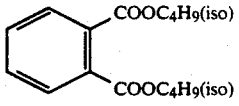
(S-27)
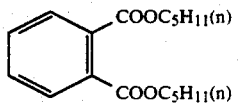
-continued
(S-28)
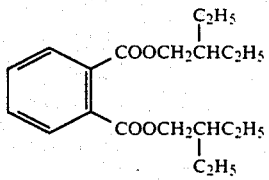
(S-29)
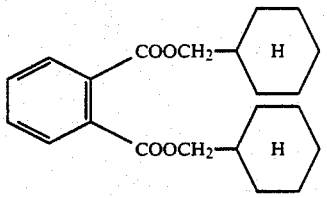
(S-30)
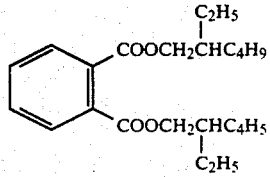
(S-31)
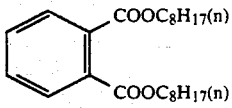
(S-32)
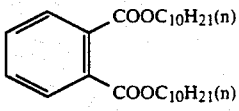
(S-33)
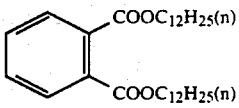
(S-34)
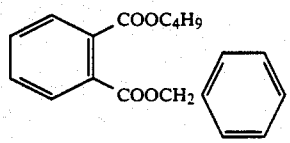
(S-35)
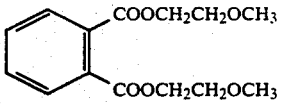
(S-36)
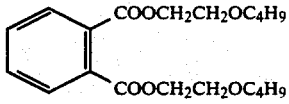
(S-37)
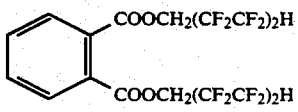
(S-38)
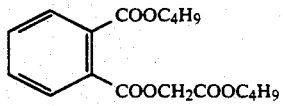

-continued
(S-39)
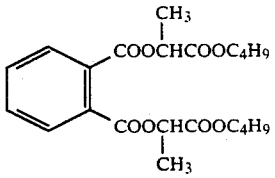
(S-40)
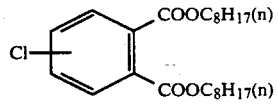
(S-41)
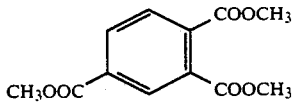
(S-42)
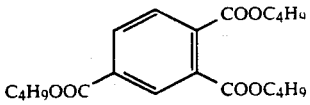
(S-43)
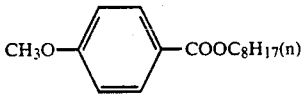
(S-44)
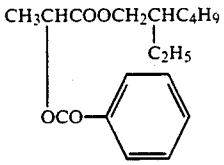
(S-45)
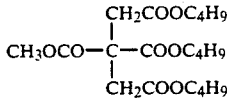
(S-46)
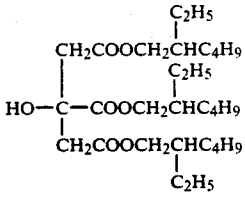
(S-47)
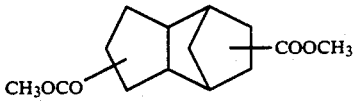
(S-48)
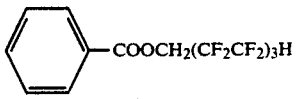
(S-49)
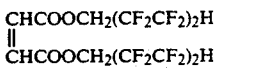
-continued
(S-50)
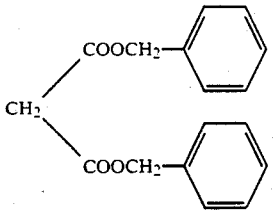
(S-51)
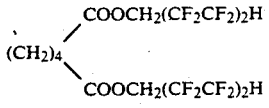
(S-52)
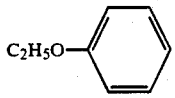
(S-53)
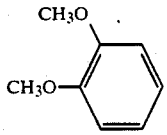
(S-54)
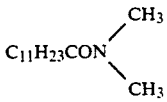
(S-55) $C_{12}H_{25}OH$
(S-56) $C_{16}H_{33}OH$
(S-57) $C_{18}H_{37}OH$
(S-58) $C_{10}H_{21}O(CH_2)_5O(CH_2)_2OH$
(S-59)
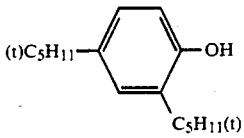
(S-60)
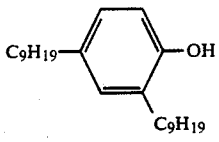
(S-61) $CH_3(CH_2)_{17}Cl$
(S-62) $CH_3(CH_2)_{15}Br$
(S-63)
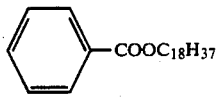
(S-64)
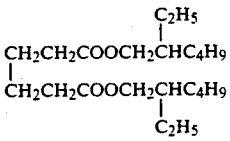

-continued (S-65)

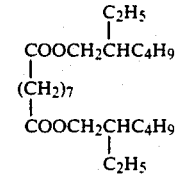

(S-66)

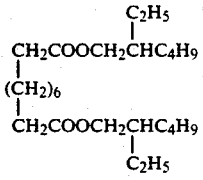

The amount of the high-boiling point solvent can be varied in a wide range depending on the polymer used and the amount thereof. A preferred weight ratio of the amount of the solvent to the amount of the coupler is from 0 to 20, and the more preferred ratio is from 0 to 10.

Preferred magenta couplers which can be used as a combination with the cyan coupler for use in this invention described above are shown by following formulae (VIII) and (IX);

(VIII)

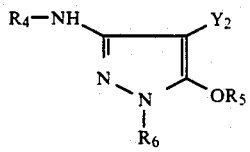

wherein $R_4$ and $R_6$ each represents an aryl group; $R_5$ represents hydrogen, an aliphatic acyl group, an aromatic acyl group, an aliphatic sulfonyl group, or an aromatic sulfonyl group; and $Y_2$ represents hydrogen or a releasing group;

(IX)

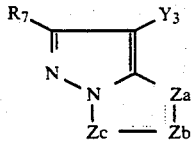

wherein $R_7$ represents hydrogen or a substituent; $Y_3$ represents hydrogen or a releasing group; Za, Zb, and Zc each represents methine, substituted methine, =N—, or —NH—; one of the Za—Zb bond and the Zb—Zc bond is a double bond and the other is a single bond, the double bond may be a part of an aromatic ring; the coupler may form a dimer or higher polymer at $R_7$ or $Y_3$, and when Za, Zb, or Zc is substituted methine, the coupler may form a dimer or higher polymer at the substituted methine.

It is known in the field of the art that when $R_5$ in formula (VIII) is a hydrogen, the magenta coupler of the formula has the following keto-enol form tautomerism which is known in this field:

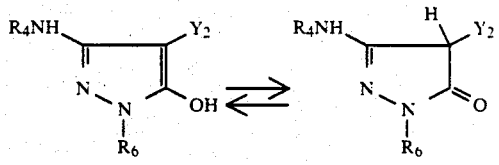

In formula (VIII), the substituents for the aryl group (preferably phenyl) represented by $R_4$ or $R_6$ are the same as the substituents for $R_1$ in formula (I) described above, and when two or more substituents are present, they may be the same or different.

In formula (VIII), $R_5$ is preferably hydrogen, an aliphatic acyl group, or an aliphatic sulfonyl group, and particularly preferably hydrogen. Also, $Y_2$ is preferably a group capable of releasing at a sulfur atom, an oxygen atom, or a nitrogen atom, and particularly preferably a group capable of releasing at a sulfur atom.

The compound represented by formula (IX) described above is a 5-membered-5-membered condensed nitrogen-containing hetero-type coupler (hereinafter, is referred to as 5,5N heterocyclic coupler) and the coloring mother nucleus thereof has aromaticity iso-electronic to naphthalene and has a chemical structure usually called "azapentalene".

Of the couplers represented by formula (IX), preferred couplers are 1H-imidazo[1,2-b]pyrazoles, 1H-pyrazolo[1,5-b]pyrazoles, 1H-pyrazolo[1,5-c][1,2,4]triazoles, 1H-pyrazolo[1,5-b][1,2,4]triazoles and 1H-pyrazolo[1,5-d]tetrazoles, which are represented by following formulae (IXa), (IXb), (IXc), (IXd) and (IXe), respectively.

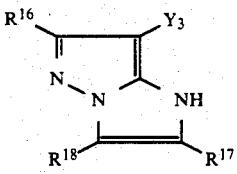

(IXa)

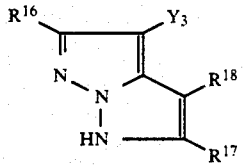

(IXb)

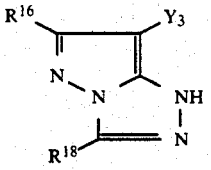

(IXc)

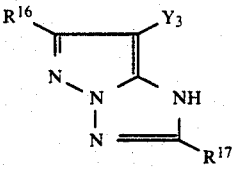

(IXd)

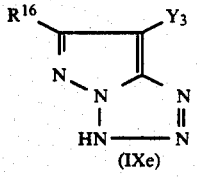

(IXe)

wherein $R^{16}$, $R^{17}$, and $R^{18}$ each represents an aliphatic group, an aromatic group, or a heterocyclic group and each group may be substituted by at least one substituent for $R_1$ in formula (I) described above. Also, $R^{16}$, $R^{17}$, and $R^{18}$ further may represent

RO—, RC(=O)—, RCO(=O)—, RSO—, $RSO_2$—, $RSO_2NH$—,

-continued $$\underset{\underset{O}{\|}}{RCNH}-,\quad RNH-,\quad RS-,\quad \underset{\underset{O}{\|}}{ROCNH}-,$$

hydrogen, a halogen atom, a cyano group, or an imido group (wherein R represents an alkyl group, an aryl group, or a heterocyclic group).

In the formulae, $R^{16}$, $R^{17}$, and $R^{18}$ may be a carbamoyl group, a sulfamoyl group, a ureido group, or a sulfamoylamino group and the nitrogen atom of each of these groups may have the substituent for $R_1$ in formula (I) described above.

Also, any one of $R^{16}$, $R^{17}$, $R^{18}$ and $Y^3$ may be a divalent group to form a dimer and may be a divalent group bonding the polymer chain to the coupler chromophore.

In the formulae, $R^{16}$, $R^{17}$, and $R^{18}$ are preferably hydrogen, a halogen atom, an aliphatic group, an aromatic group, a heterocyclic group, RO—, RCONH—, $RSO_2NH$—, RNH—, RS—, or ROCONH—. Also, $Y_3$ is preferably a halogen atom, an acylamino group, an imido group, an aliphatic sulfonamido group, an aromatic sulfonamido group, a 5-membered or 6-membered nitrogen-containing heterocylic ring bonded to the coupling active position by a nitrogen atom, an aryloxy group, an alkoxy group, an arylthio group, or an alkylthio group.

Specific examples of the magenta couplers are illustrated below, together with yellow couplers which can be also used with the aforesaid couplers in this invention, but the invention is not to be considered as being limited to them.

| Compound | $R_{33}$ | $R_{34}$ | $X_2$ |
|---|---|---|---|
| | | 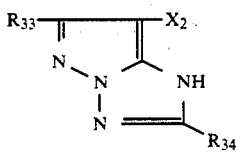 | |
| M-1 | $CH_3$— | 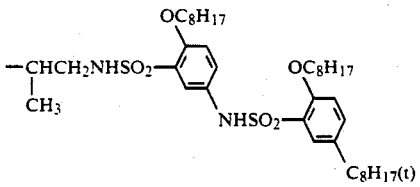 | Cl |
| M-2 | Same as above | 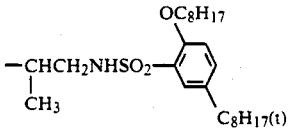 | Same as above |
| M-3 | Same as above | 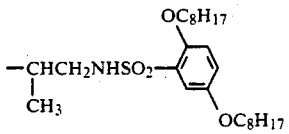 | 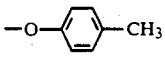 |
| M-4 | 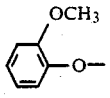 | 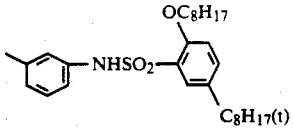 | 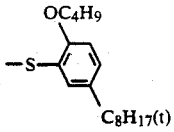 |
| M-5 | $CH_3$— | 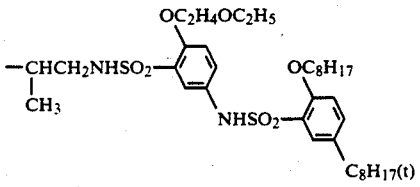 | Cl |
| M-6 | $CH_3$— | 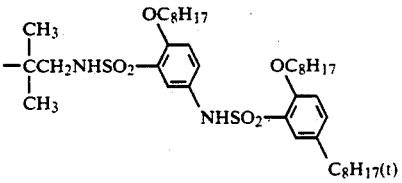 | Cl |

-continued
| Compound | $R_{33}$ | $R_{34}$ | $X_2$ |
|---|---|---|---|
| M-7 | 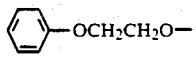 | 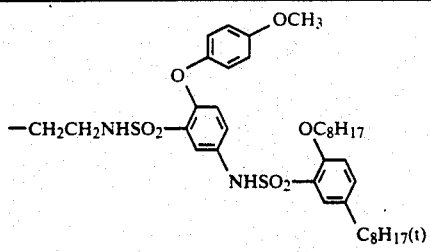 | 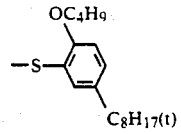 |
| M-8 | $CH_3CH_2O-$ | Same as above | Same as above |
| M-9 | 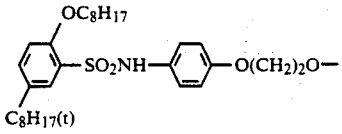 | 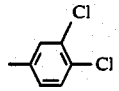 | 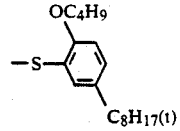 |
| M-10 | 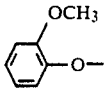 | 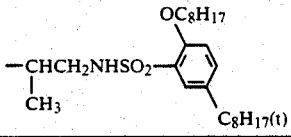 | Cl |
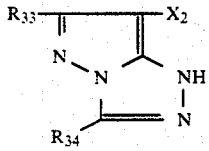
| | | | |
|---|---|---|---|
| M-11 | $CH_3-$ | 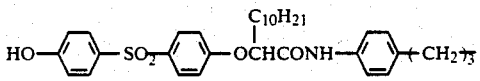 | Cl |
| M-12 | Same as above | 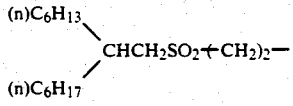 | Same as above |
| M-13 | 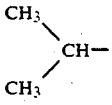 | 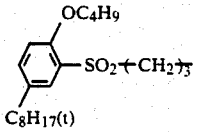 | Same as above |
| M-14 | 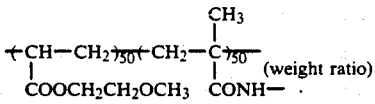 (weight ratio) | 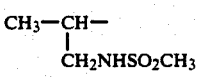 | Same as above |
| M-15 | 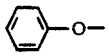 | 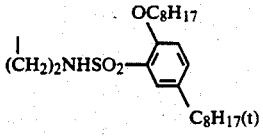 | Cl |
| M-16 | 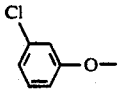 | 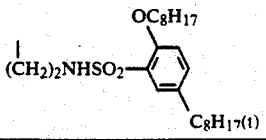 | 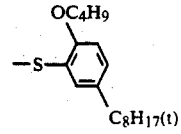 |

(M-17)
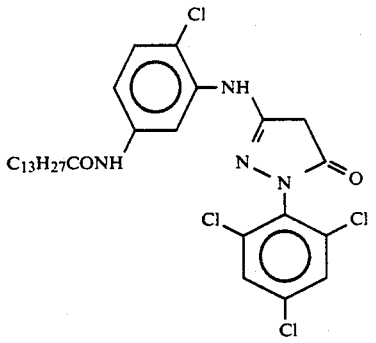
(M-18)
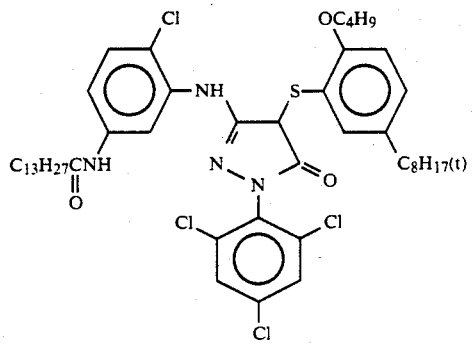
(M-19)
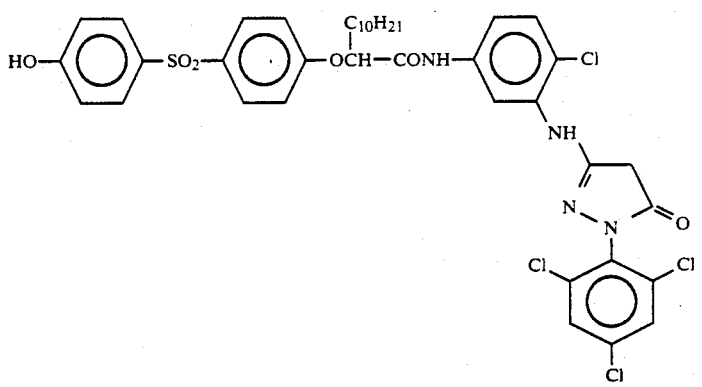
(M-20)
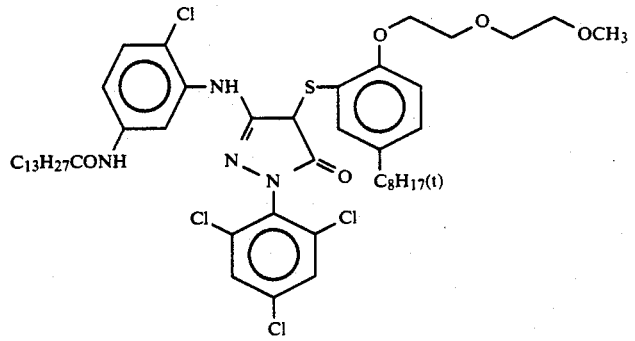

-continued
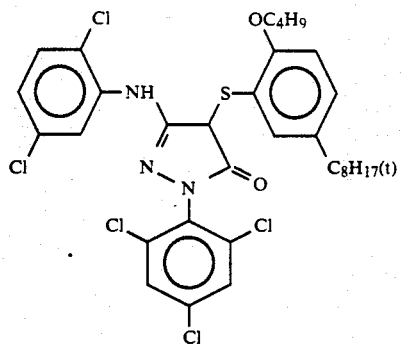
(M-21)
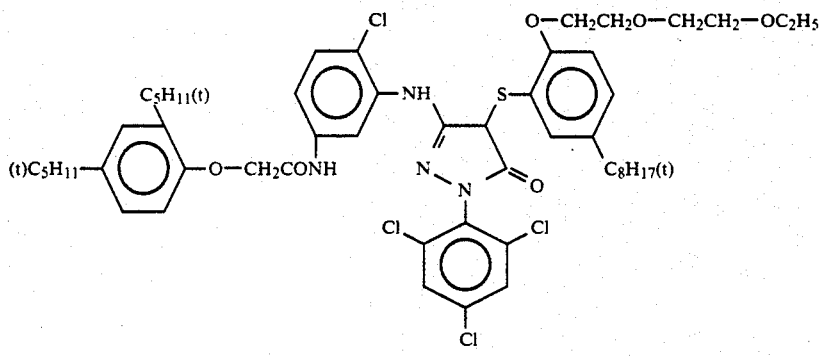
(M-22)
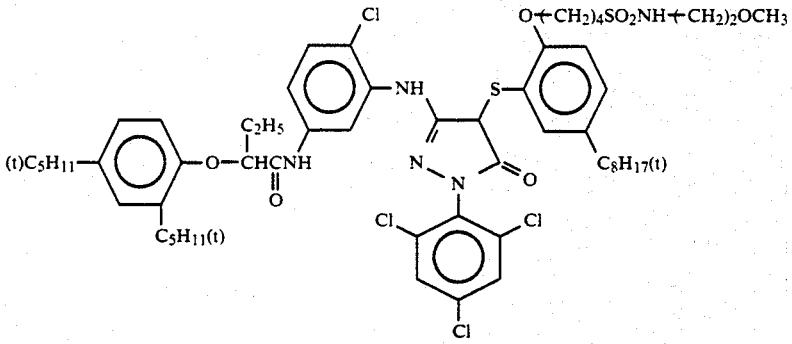
(M-23)
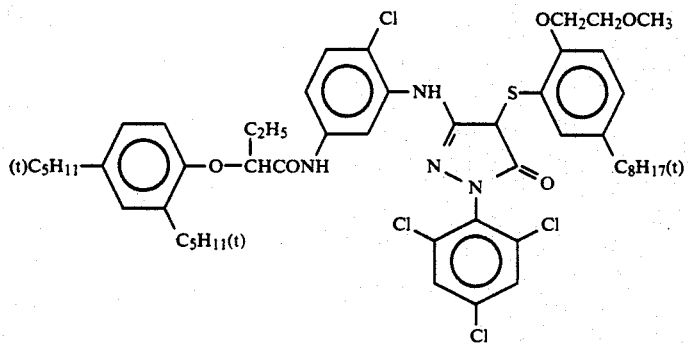
(M-24)

-continued
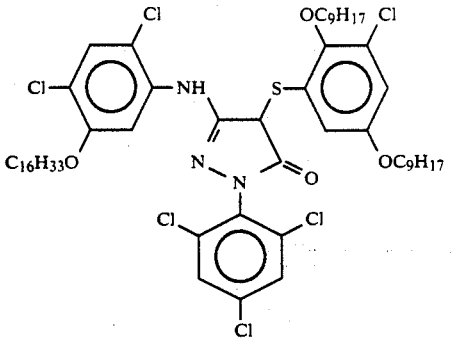
(M-25)
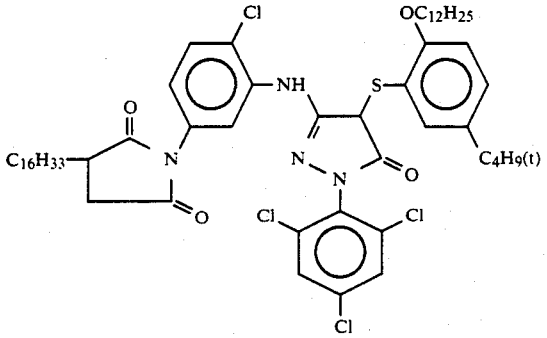
(M-26)
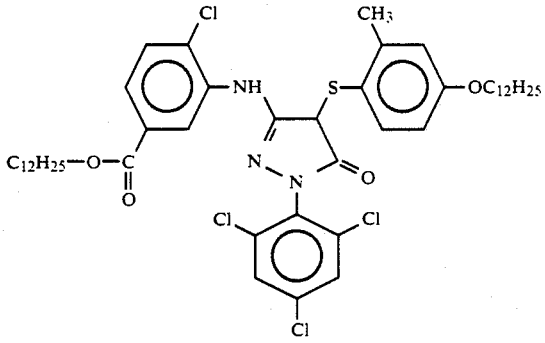
(M-27)
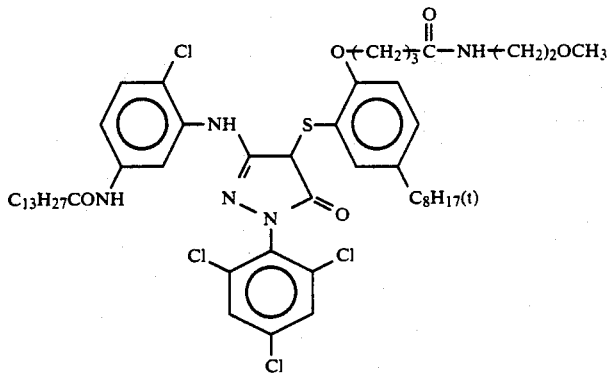
(M-28)

-continued
(M-29)
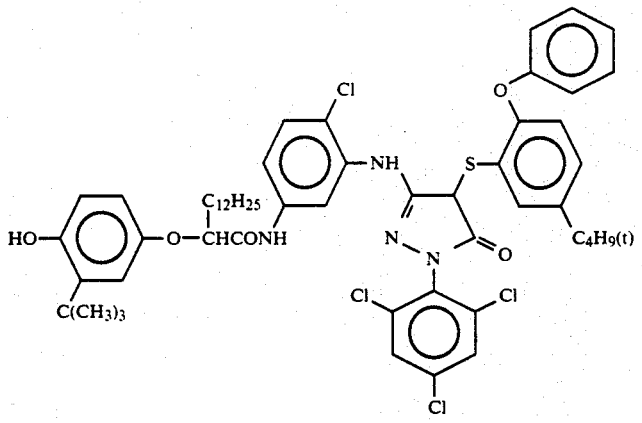
(M-30)
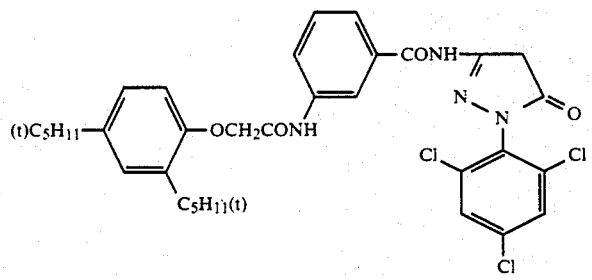
(M-31)
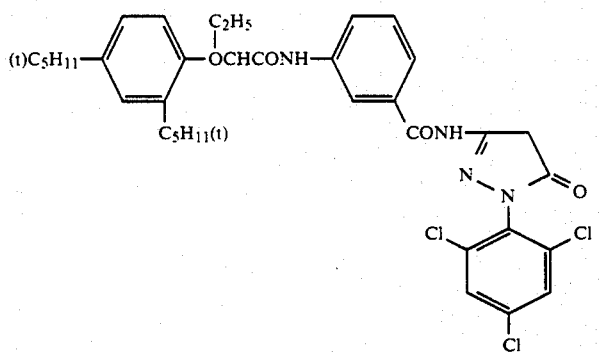
(M-32)
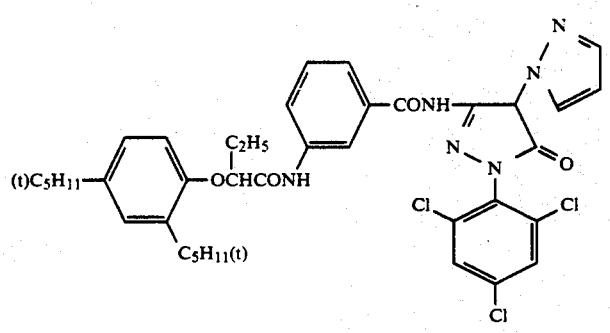

Yellow Coupler:
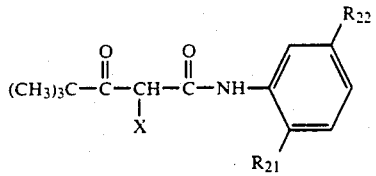
| Compound | $R_{22}$ | X | $R_{21}$ |
|---|---|---|---|
| Y-1 | $-COOCH(CH_3)COOC_{12}H_{25}$ | 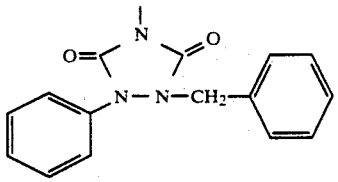 | Cl |
| Y-2 | $-COOCH(C_4H_9)COOC_{12}H_{25}$ | Same as above | Cl |
| Y-3 | 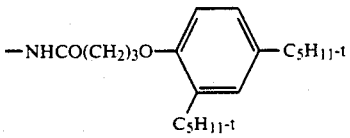 | 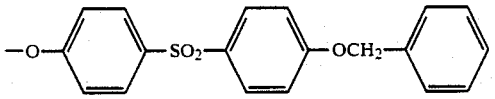 | Cl |
| Y-4 | 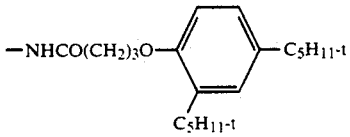 | 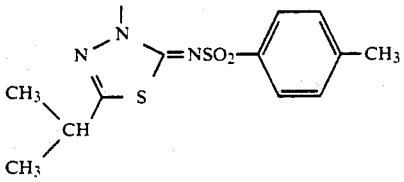 | Cl |
| Y-5 | 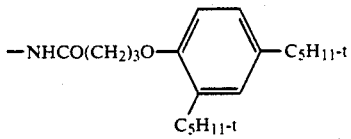 | 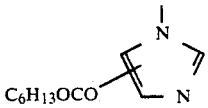 | Cl |
| Y-6 | $-NHSO_2C_{12}H_{25}$ | 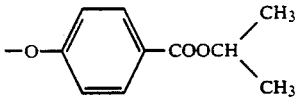 | Cl |
| Y-7 | $-NHSO_2C_{16}H_{33}$ | 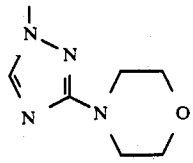 | Cl |
| Y-8 | $-COOC_{12}H_{25}(n)$ | 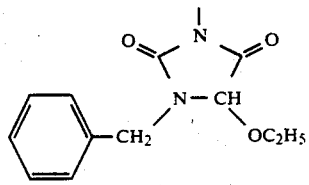 | Cl |

-continued
Yellow Coupler:
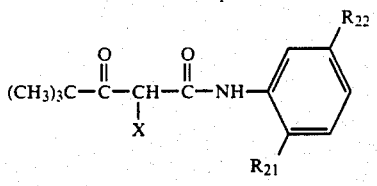
| Compound | $R_{22}$ | X | $R_{21}$ |
|---|---|---|---|
| Y-9 | 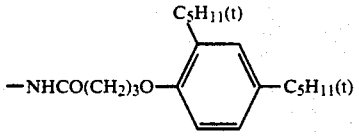 | 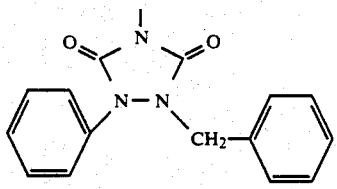 | Cl |
| Y-10 | 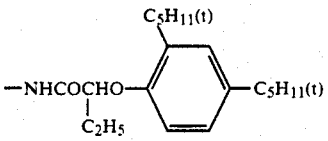 | 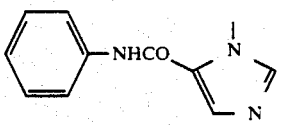 | $OCH_3$ |
| Y-11 | 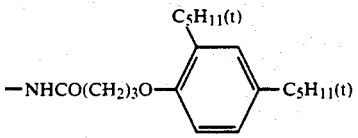 | 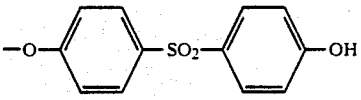 | Cl |
| Y-12 | 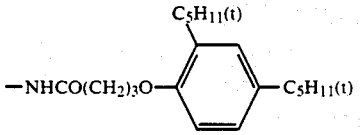 | 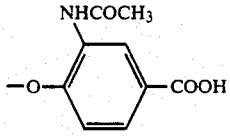 | Cl |
| Y-13 | 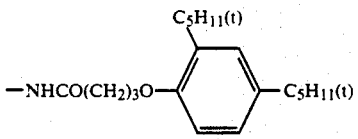 | 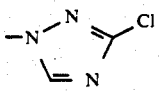 | Cl |
| Y-14 | 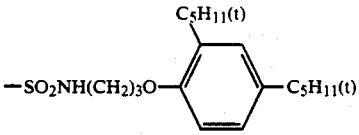 | 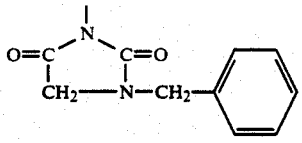 | Cl |
| Y-15 | 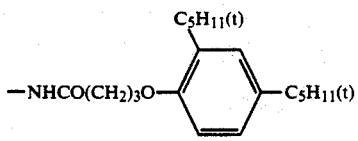 | 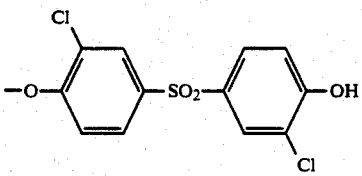 | Cl |
| Y-16 | 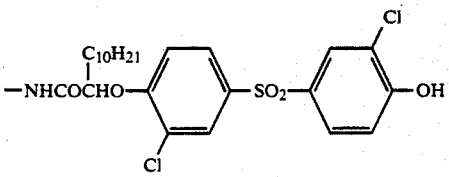 | 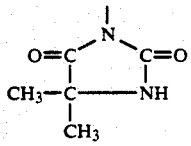 | Cl |

-continued
Yellow Coupler:
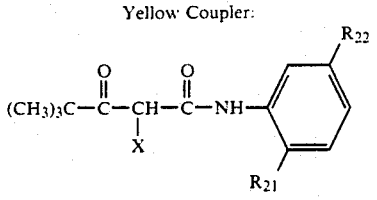
| Compound | $R_{22}$ | X | $R_{21}$ |
|---|---|---|---|
| Y-17 | 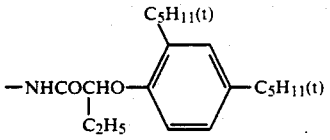 | 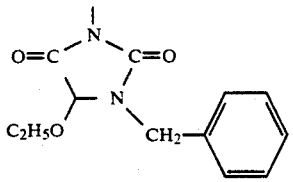 | Cl |
| Y-18 | 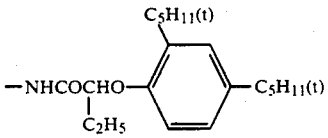 | 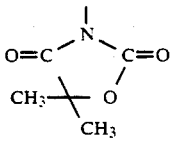 | Cl |
| Y-19 | $-NHSO_2C_{16}H_{33}$ | 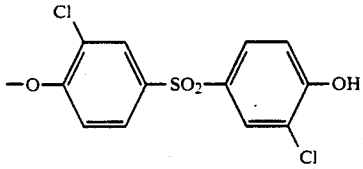 | Cl |
| Y-20 | 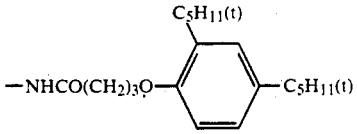 | 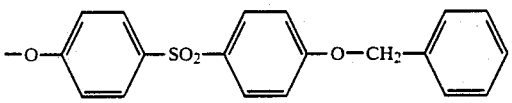 | Cl |
| Y-21 | 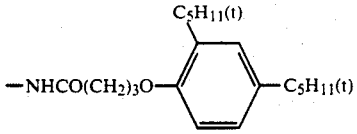 | 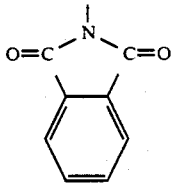 | Cl |
| Y-22 | 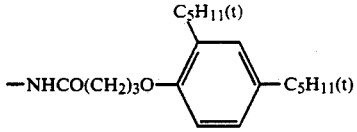 | 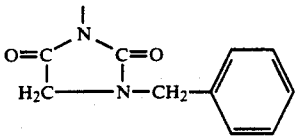 | Cl |
| Y-23 | 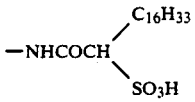 | 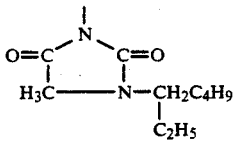 | Cl |
| Y-24 | 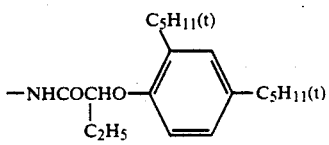 | 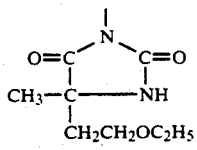 | Cl |

-continued
Yellow Coupler:
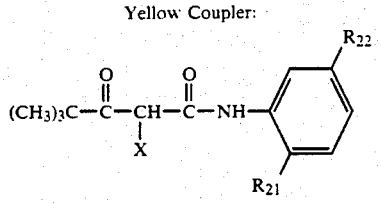
| Compound | $R_{22}$ | X | $R_{21}$ |
|---|---|---|---|
| Y-25 | $-NHCOCH(CH_3)CH_2SO_2C_{12}H_{25}(n)$ | 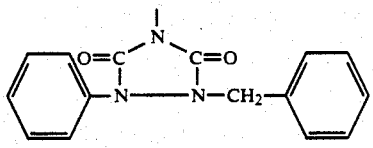 | Cl |
| Y-26 | $-NHSO_2C_{16}H_{33}(n)$ | 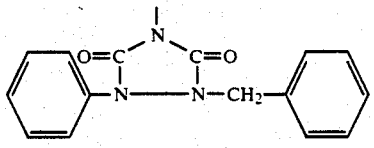 | Cl |
| Y-27 | 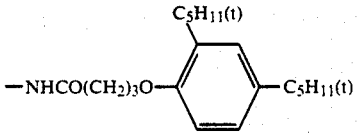 | 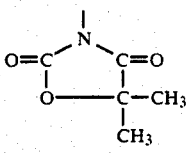 | Cl |
| Y-28 | Same as above | 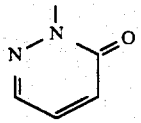 | Cl |
| Y-29 | Same as above | 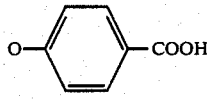 | Cl |
| Y-30 | $-NHSO_2-C_{16}H_{33}(n)$ | 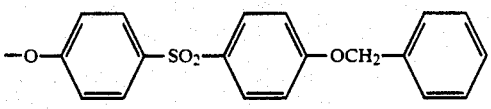 | Cl |
| Y-31 | $-NHSO_2-C_{16}H_{33}(n)$ | 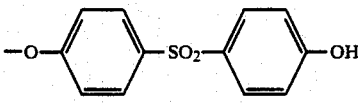 | Cl |
| Y-32 | $-SO_2-NHCH_3$ | 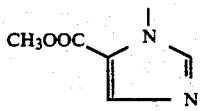 | $-OC_{16}H_{33}$ |
| Y-33 | 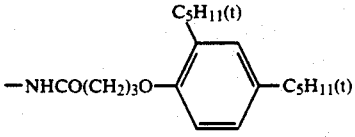 | 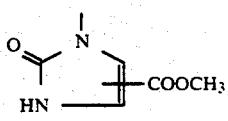 | Cl |

-continued
Yellow Coupler:
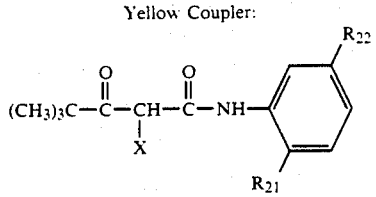
| Compound | $R_{22}$ | X | $R_{21}$ |
|---|---|---|---|
| Y-34 | 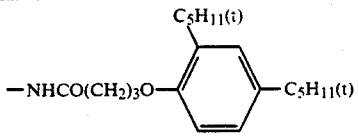 | 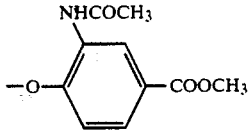 | Cl |
| Y-35 | 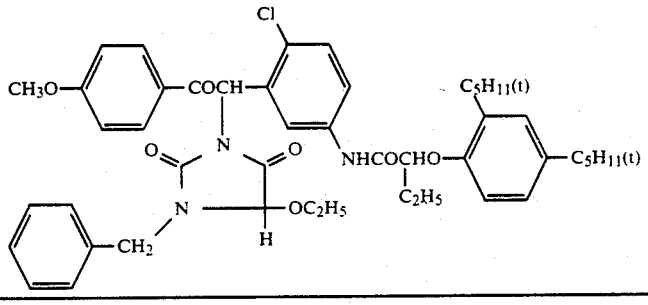 | | |
In this invention, the cyan couplers represented Formulae (I) or (II) described above can be, if necessary, used together with other cyan couplers, and specific examples of such cyan couplers which can be used together with the cyan couplers of this invention are illustrated below.
(CC-1)
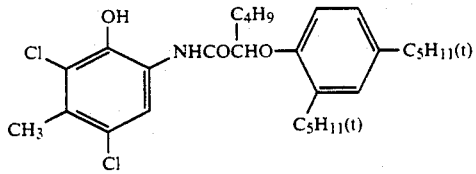
(CC-2)
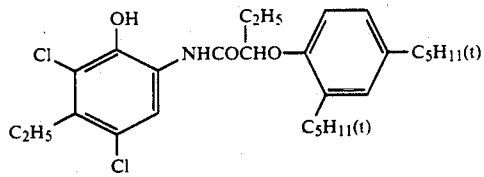
(CC-3)
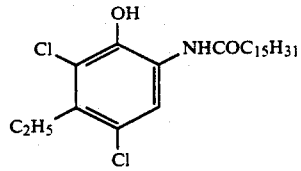
(CC-4)
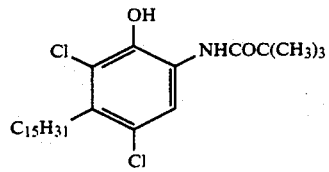

-continued
(CC-5)
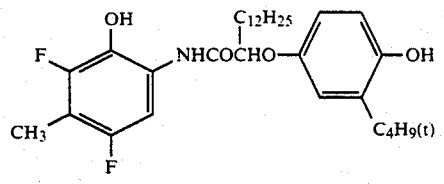
(CC-6)
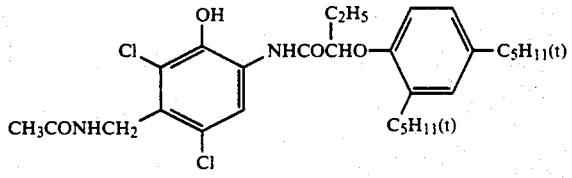
(CC-7)
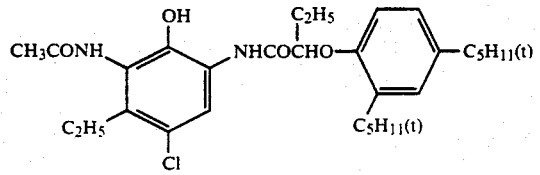
(CC-8)
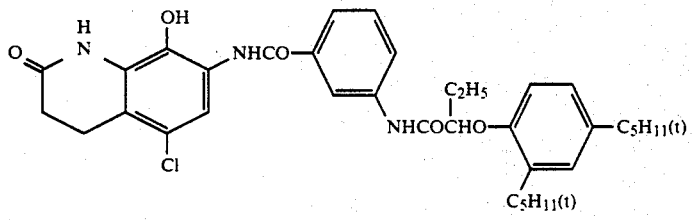
(CC-9)
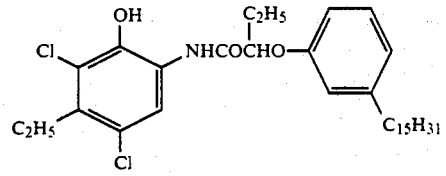
(CC-10)
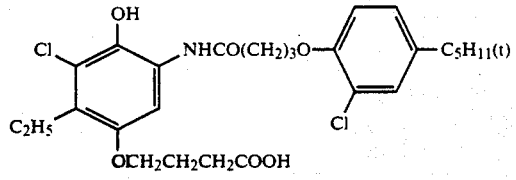
(CC-11)
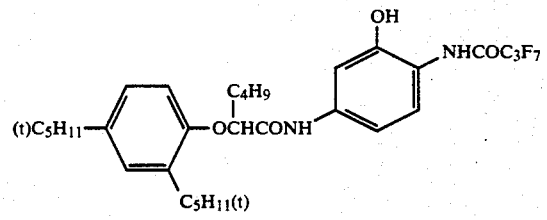
(CC-12)
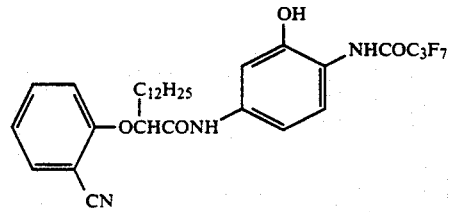

-continued
(CC-13)
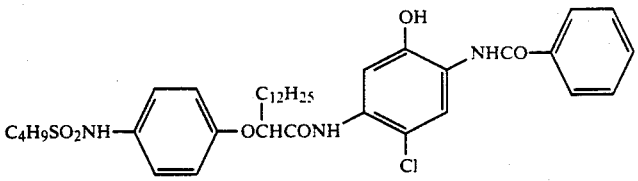
(CC-14)
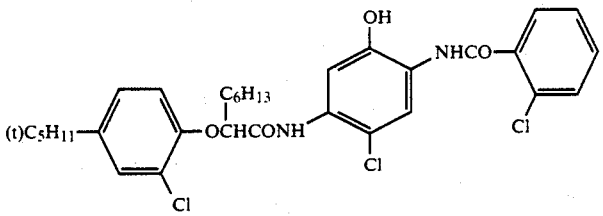
(CC-15)
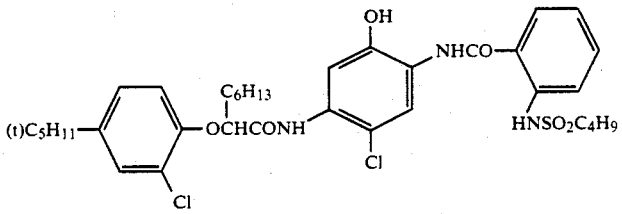
(CC-16)
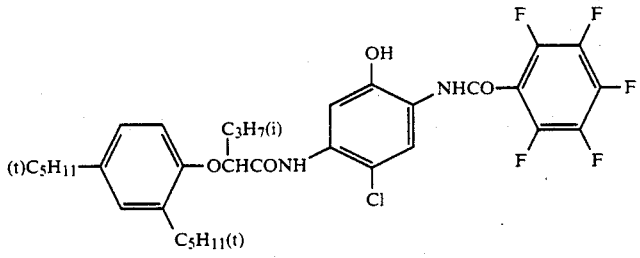
(CC-17)
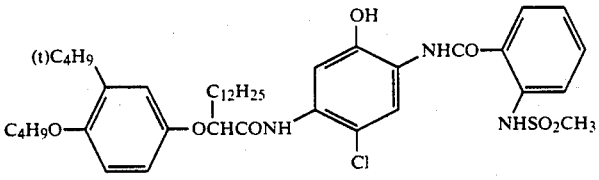
(CC-18)
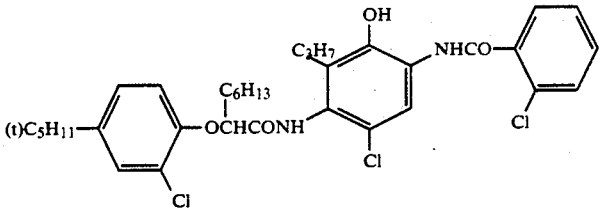
(CC-19)
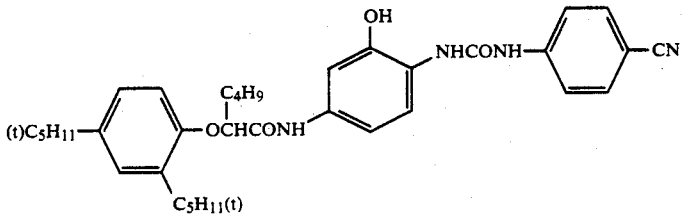

-continued
(CC-20)
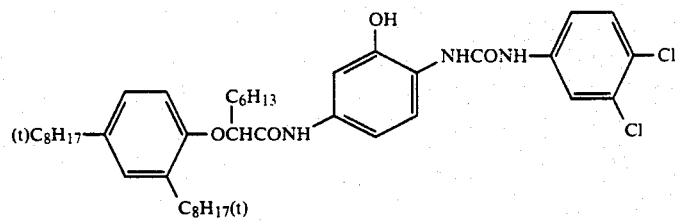
(CC-21)
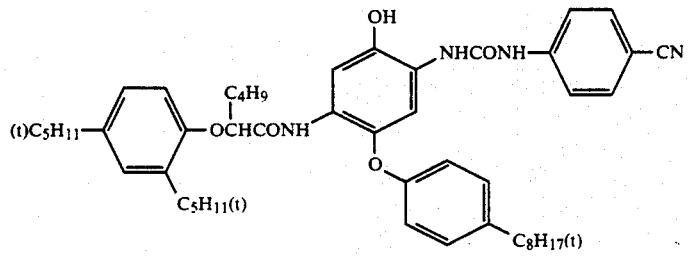
(C-22)
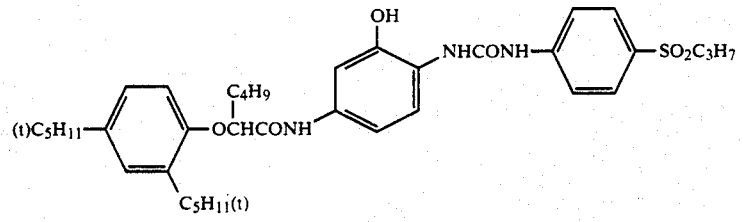
(CC-23)
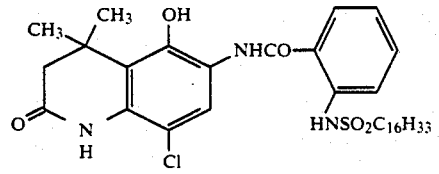
(CC-24)
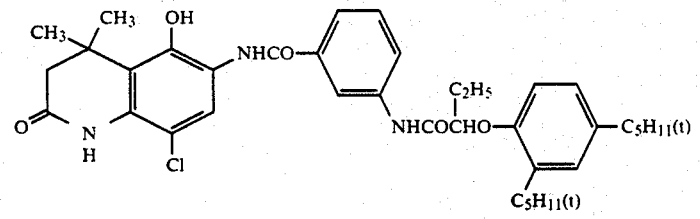
(CC-25)
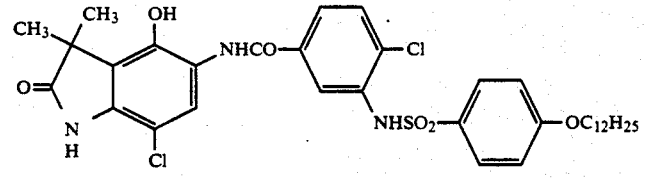
(CC-26)
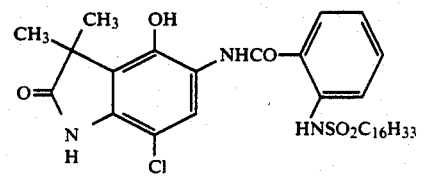

-continued
(CC-27)
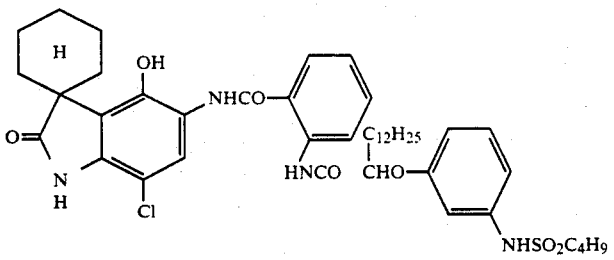
(CC-28)
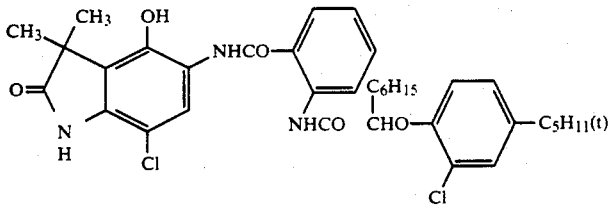
(CC-29)
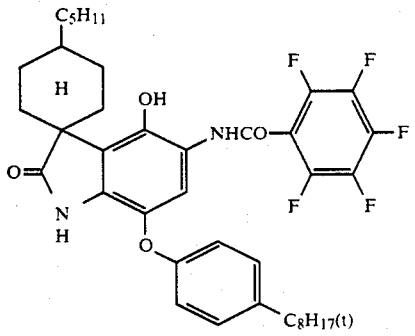
(CC-30)
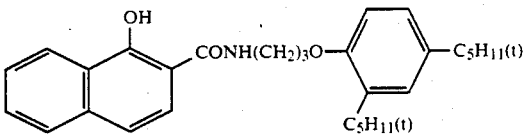
(CC-31)
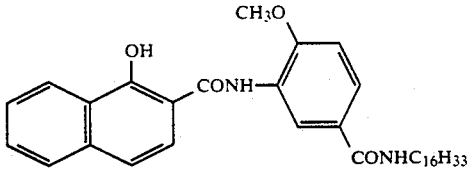
(CC-32)
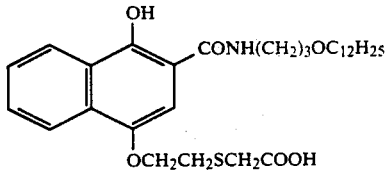
(CC-33)
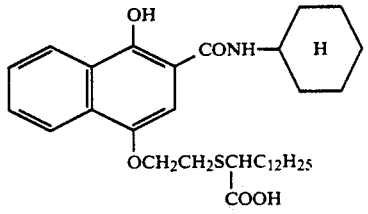

-continued (CC-34)

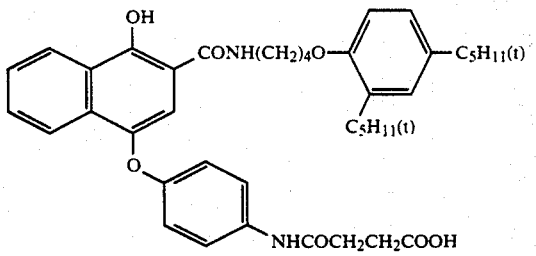

(CC-35)

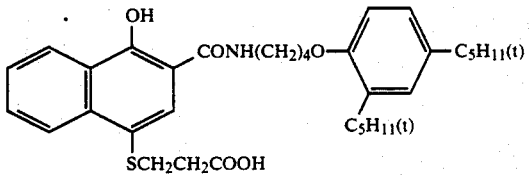

(CC-36)

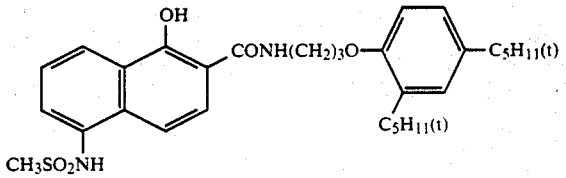

(CC-37)

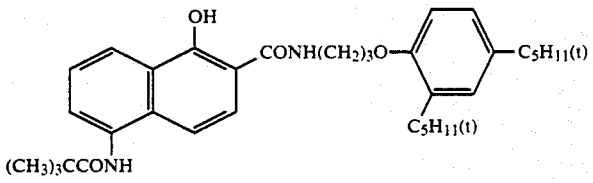

(CC-38)

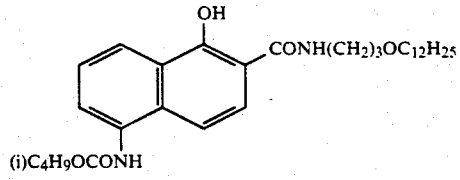

(CC-39)

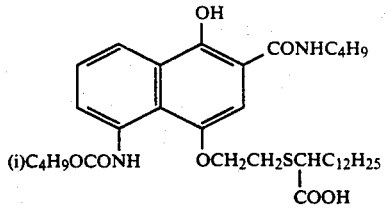

(CC-40)

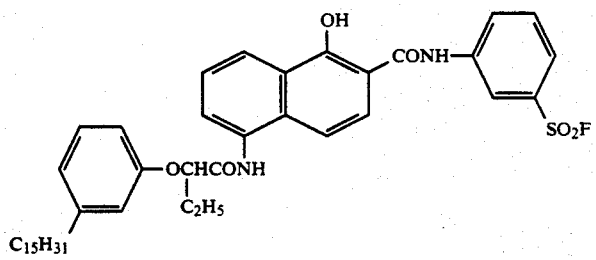

The mean particle size of the oleophilic fine particles for use in this invention is preferably from 0.04 μm to 2 μm, and more preferably from 0.06 μm to 0.4 μm. The particle sizes of the oleophilic fine particles can be measured by, e.g., a Nanosizer made by the Coal Tar Co. in England.

For the silver halide in this invention, silver bromide, silver iodobromide, silver iodochlorobromide, silver chlorobromide, or silver chloride can be used. In particular, in materials for quick processing, silver chlorobromide containing at least 90 mol % (more preferably from 98 to 99.9 mol %) silver chloride is preferably used.

The silver chlorobromide may contain a slight amount of silver iodide but preferably contains no silver iodide.

The mean grain size (the diameter of grains when the grain is spherical or similar to spherical, and the mean value based on the projected area using, in the case of cubic grains, the long side length as the grain size) of the silver halide grains in the silver halide emulsion for use in this invention can be desirably varied, but is preferably less than 2 μm, and particularly preferably from 0.2 to 1.5 μm.

The silver halide grains in the photographic emulsion layers may have a regular crystal form such as cubic, tetradecahedral, octahedral (normal crystal emulsion), an irregular crystal form such as spherical, tabular, or a composite form of them. The silver halide grains may be further composed of a mixture of grains having various crystal forms. In these grains, the use of a normal silver halide crystal emulsion is preferred in this invention.

A silver halide emulsion wherein tabular silver halide grains having a ratio of grain length to thickness of at least 5 account for at least 50% of the total projected area of the silver halide grains can be used in this invention.

The silver halide emulsion contained in at least one of the light-sensitive emulsion layers of the color photographic material of this invention is preferably a mono-dispersed silver halide emulsion having a coefficient of variation (the statistic standard deviation divided by the mean grain size, the value being shown by percentage) of not more than 15% (more preferably not more than 10%).

The mono-dispersed emulsion having this coefficient of variation may be used singly, and a mixture of two or more kinds of mono-dispersed emulsions each having the coefficient of variation of not more than 15% (preferably not more than 10%) separately prepared may be used. In the latter case, the difference in the grain sizes of these silver halide emulsions and the mixing ratio of these emulsions can be optionally selected, but the difference in the mean grain sizes of the emulsions is preferably in the range of from 0.2 μm to 1.0 μm.

The definition and the measurement method for the coefficient of variation is described in T. H. James, *The Theory of The Photographic Process*, page 39, (3rd Edition, Macmillan 1966).

The silver halide grains for use in this invention may have different phase between the inside and the surface layer thereof. Also, the silver halide grains may be of a type forming latent images mainly on the surface thereof or of a type forming latent images mainly in the inside thereof. Silver halide grains of the latter type are particularly useful for direct positive emulsions.

The silver halide emulsions may be formed or physically ripened in the presence of a cadmium salt, a zinc salt, a thallium salt, a lead salt, an iridium salt or a complex salt thereof, a rhodium salt or a complex salt thereof, or an iron salt or a complex salt thereof.

The silver halide emulsions for use in this invention are usually chemically sensitized by conventional method. Details of the chemical sensitization are described, e.g., in JP-A-62-215272, page 12, left lower column, line 18 to the same page, right lower column, line 16. The term "JP-A" as used herein means an "unexamined published Japanese patent application".

Also, the silver halide emulsions are usually spectrally sensitized.

For the spectral sensitization, ordinary methine dyes can be used, and details thereof are described in JP-A-62-215272, page 22, right upper column, line 3 up to page 38 and Amendments (filed on Mar. 16, 1987) attached sheet (B).

The photographic emulsions for use in this invention can contain various kinds of compounds for inhibiting the formation of fog during the production, storage, and/or photographic processing of the color photographic materials of this invention or stabilizing the photographic performance thereof. That is, there are azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiazoles, aminotriazoles, benztriazoles, nitrobenztriazoles, mercaptotetrazoles (in particular, 1-phenyl-5-mercaptotetrazole), mercaptopyrimidines, mercaptotriazines; thioketo compounds such as oxadolinethione,; azaindenes such as triazaindenes, tetraazaindenes (in particular, 4-hydroxy-substituted (1,3,3a,7)tetraazaindene), pentaazaindenes; benzenethiosulfonic acid, benzenesulfinic acid, benzenesulfonic acid amide, which are known as antifoggants or stabilizers.

The color photographic light-sensitive materials of this invention may further contain hydroquinone derivatives, aminophenol derivatives, amines, gallic acid derivatives, catechol derivatives, ascorbic acid derivatives, non-coloring couplers, or sulfonamidophenol derivatives, as color fog inhibitors or color mixing inhibitors.

The color photographic materials of this invention can contain various fading inhibitors. As organic fading inhibitors for cyan, magenta, and/or yellow images, there are typically hydroquinones, 6-hydroxychromans, 5-hydroxycoumarans, spirochromans, p-alkoxylphenols, hindered phenols (such as bisphenols), gallic acid derivatives. methylenedioxybenzenes, aminophenols, hindered amines, and the ether or ester derivatives of these compounds obtained by silylating or alkylating the phenolic hydroxy groups thereof. Also, metal complexes such as (bis-salicylaldoxymato)nickel complexes and (bis-N,N-dialkyldithiocarbamato)nickel complexes can be used for this purpose.

Specific examples of the organic fading inhibitors are hydroquinones described in U.S. Pat. Nos. 2,360,290, 2,418,613, 2,700,453, 2,701,197, 2,728,659, 2,732,300, 2,735,765, 3,982,944, 4,430,425, 2,710,801, and 2,816,028, and British Patent 1,363,921; 6-hydroxychromans, 5-hydroxycoumarans, and spirochromans described in U.S. Pat. Nos. 3,432,300, 3,573,050, 3,574,627, 3,698,909, and 3,764,337 and JP-A-52-152225; spiroindanes described in U.S. Pat. No. 4,360,589; p-alkoxyphenols described in U.S. Pat. No. 2,735,765, British Patent 2,066,975, JP-A-59-10539, and JP-B-57-19764 (the term "JP-B" as used herein means an "examined published Japanese patent application"); hindered phenols described in U.S. Pat. Nos. 3,700,455 and 4,228,235, JP-A-52-72225, and JP-B-52-6623; gallic acid derivatives, methylenedioxybenzenes, and aminophenols described in U.S. Pat. Nos. 3,457,079 and 4,332,886, and JP-B-56-21144; hindered amines described in U.S. Pat. Nos. 3,336,135 and 4,268,693, British Patents 1,326,889, 1,354,313 and 1,410,846, JP-B-51-1420, and JP-A-58-

114036, JP-A-59-53846, JP-A-59-78344; the ether and ester derivatives of a phenolic hydroxy group described in U.S. Pat. Nos. 4,155,765, 4,174,220, 4,254,216, 4,264,720, JP-A-54-145530, JP-A-55-6321, JP-A-58-105147, and JP-A-59-10539, JP-B-57-37865 and JP-B-53-3263, and U.S. Pat. No. 4,279,990; and metal complexes described in U.S. Pat. Nos. 4,050,938 and 4,241,155, and British Patent 2,027,731(A).

This compound is usually co-emulsified with a corresponding color coupler in an amount of from 5 to 100% based on the coupler by weight and incorporated in a light-sensitive emulsion layer. For inhibiting the deterioration of cyan dye images by heat and, in particular, light, it is more effective to introduce an ultraviolet absorbent in the layers adjacent to both sides of a cyan coloring layer.

Of the above fading inhibitors, spiroindanes and hindered amines are particularly preferred.

Examples of the ultraviolet absorbent which can be used for the color photographic materials of this invention are benzotriazole compounds substituted by an aryl group described in U.S. Pat. No. 3,533,794; 4-thiazolidone compounds described in U.S. Pat. Nos. 3,314,794 and 3,352,681; benzophenone compounds described in JP-A-46-2748; cinnamic acid ester compounds described in U.S. Pat. Nos. 3,705,805 and 3,707,375; butadiene compounds described in U.S. Pat. No. 4,045,229; and benzoxydol compounds described in U.S. Pat. No. 3,700,455. Also, ultraviolet absorptive couplers (e.g., α-naphtholic cyan dye forming couplers) and ultraviolet absorptive polymers may be used. These ultraviolet absorbents may be mordanted to a specific layer of the color photographic material.

The color photographic material of this invention may contain in the hydrophilic colloid layer(s) a water-soluble dye as a filter dye, an irradiation inhibitor or for other various purposes. Examples of such dyes are oxonol dyes, hemioxonol dyes, styryl dyes, merocyanine dyes, cyanine dyes, and azo dyes. Of these dyes, oxonol dyes, hemioxonol dyes and merocyanine dyes are useful. Details of the useful oxonol dyes are described, for example, in JP-A-62-215272, page 158, upper right column to page 163.

As a binder or protective colloid which can be used for the emulsion layers of the color photographic materials of this invention, gelatin is advantageously used but other hydrophilic colloids may be used alone or with gelatin.

The gelatin for use in this invention may be lime-treated gelatin or acid-treated gelatin. Details of the production of gelatin are described, e.g., in Arther Weiss, *The Macromolecular Chemistry of Gelatin*, published by Academic Press, 1964.

As the support for the color photographic materials of this invention, there are cellulose nitrate films, cellulose acetate films, cellulose acetate butyrate films, cellulose acetate propionate films, polystyrene films, polyethylene terephthalate films, polycarbonate films, the laminates of these films, thin glass sheets, and papers, which are usually used for photographic materials. Furthermore, supports such as papers coated or laminated with baryta or an α-olefin polymer, in particular, a polymer of an α-olefin having from 2 to 10 carbon atoms, such as polyethylene, polypropylene, an ethylene-butene copolymer, films of a vinylchloride resin containing a reflective material such as $TiO_2$, and plastic films the surface of which is roughened for improving the adhesive property for other polymers as described in JP-B-47-19068 give good results. Also, an ultraviolet hardenable resin can be used for the support.

These supports may be transparent or opaque according to the purpose. Also, a colored transparent support colored by dye(s) or pigment(s) can be used according to the purpose.

The opaque support includes papers which are originally opaque as well as those prepared by adding pigments such as titanium oxide to transparent films and plastic films surface-treated by the method shown in JP-B-47-19068.

The support usually has a subbing layer. Furthermore, for improving the adhesive property, the surface of the support may be subjected to a pretreatment such as corona discharging, ultraviolet irradiation, or flame treatment; etc.

As color photographic materials of this invention suitable for forming color photographic images, there are, for example, ordinary color photographic materials such as, color photographic negative films, color photographic papers, reversal color photographic papers, and reversal color photographic films, and in this invention color photographic papers for printing are particularly suitable.

For the development of the color photographic material, a black and white developer and/or a color developer is used. The color developer is preferably an alkaline aqueous solution containing an aromatic primary amine color developing agent as the main component.

As the color developing agent, aminophenolic compounds are useful and p-phenylenediamine compounds are preferably used. Typical examples thereof are 3-methyl-4-amino-N,N-diethylaniline, 3-methyl-4-amino-N-ethyl-N-β-hydroxyethylaniline, 3-methyl-4-amino-N-ethyl-N-β-methansulfonamidoethylaniline, 3-methyl-4-amino-N-ethyl-N-β-methoxyethylaniline, and the sulfates, hydrochlorides, and p-toluenesulfonates of them. These compounds can be, if necessary, used as a mixture thereof.

The color developer generally contains a pH buffer such as carbonates, borates, or phosphates of an alkali metal, and a development inhibitor or antifoggant such as bromides, iodides, benzimidazoles, benzothiazoles, and mercapto compounds.

Also, if necessary, the color developer may contain preservatives such as hydroxylamines, diethylhydroxylamines, sulfite hydrazines, phenylsemicarbazides, triethanolamines, catecholsulfonic acids, triethylenediamine(1,4-diazabicyclo[2,2,2]octane); organic solvents such as ethylene glycol, diethylene glycol; development accelerators such as benzyl alcohol, polyethylene glycol, quaternary ammonium salts, amines; dye-forming couplers, competing couplers; auxiliary developing agents such as 1-phenyl-3-pyrazolidone; fogging agents such as sodium boron hydride; tackifiers; various chelating agents such as, typically, aminopolycarboxylic acids, aminopolyphosphonic acids, alkylphosphonic acids, phosphonocarboxylic acids (e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid), and the salts of these acids.

Also, in the practice of reversal processing, a color development is usually performed after black and white development. The black and white developer contains conventional black and white developing agents such as dihydroxybenzenes (e.g., hydroquinone), 3-pyrazolidones (e.g., 1-phenyl-3-pyrazolidone), and aminophenols (e.g., N-methyl-p-aminophenol) alone or in combination.

The pH of the color developer and the black and white developer is generally from 9 to 12.

The amount of the replenisher for the developer depends on the kind of the color photographic material being processed but is generally less than 3 liters per square meter of the color photographic material, and can be reduced below 500 ml by reducing the concentration of bromide ions in the replenisher.

In the case of reducing the amount of the replenisher, it is preferred that the contact area of the developer with air is reduced for preventing evaporation and air oxidation. Also, the amount of the replenisher can be reduced by restraining the accumulation of bromide ions in the developer.

After color development, the color photographic material is usually bleached. The bleaching process may be performed simultaneously with a fix process (bleach-fix process or blix process) or separately from the fixing process. For more rapid processing, a blix process can be performed after the bleaching process. Furthermore, a process of performing bleaching using two connected baths, a process of performing fixing before the blix process, or a process of performing bleaching after the blix process can be optionally practiced in this invention.

Examples of the bleaching agent are compounds of multi-valent metals such as iron(III), cobalt(III), chromium (VI), copper (II); peracids; quinones; and nitro compounds; Typical examples thereof ferricyanides, dichromates, organic complex salts of iron(III) or cobalt(III) (e.g., complex salts of aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid; or citric acid, tartaric acid, and malic acid); persulfates; bromates; permanganates; and nitrobenzenes. Of these compounds, ethylenediaminetetraacetic acid iron(III) complex salts, aminopolycarboxylic acid iron(III) complex salts, and persulfates are preferred for the prevention of environmental pollution.

Furthermore, aminopolycarboxylic acid iron(III) complex salts are particularly useful for both the bleaching solution and the blixing solution.

The pH of the bleaching solution or the blixing solution using the aminopolycarboxylic acid iron(III) complex salt is usually from 5.5 to 8, but may be lower than this range for rapid processing.

The bleaching solution, blixing solution, and the prebaths thereof can, if necessary, contain a bleach accelerator. Specific examples of the useful bleach accelerator are the compounds having a mercapto group or a disulfide group described in U.S. Pat. No. 3,893,858, West German Patents 1,290,812 and 2,059,988, JP-A-53-32736, JP-A-53-57831, JP-A-53-37418, JP-A-53-95630, JP-A-53-95631, JP-A-53-104232, JP-A-124424, JP-A-53-141623, and JP-A-53-28426, and *Research Disclosure*, No. 17129 (July, 1978); thiazolidine derivatives described in JP-A-50-140129; thiourea derivatives described in JP-B-45-8506, JP-A-52-20832 and JP-A-53-32735, U.S. Pat. No. 3,706,561; iodides described in West German Patent 1,127,715, JP-A-58-16235; polyoxyethylene compounds described in West German Patents 966,410 and 2,748,430; polyamine compounds described in JP-B-45-8836; other compounds described in JP-A-49-42434, JP-A-49-59644, JP-A-53-94927, JP-A-54-35727, JP-A-55-26506, and JP-A-58-163940; and bromide ions.

Of these compounds, the compounds having a mercapto group or a disulfide group are preferred due to their large accelerating effect, and in particular, the compounds described in U.S. Pat. No. 3,893,858, West German Patent 1,290,812, and JP-A-53-95630 are preferred, furthermore, compounds described in U.S. Pat. No. 4,552,834 are also preferred.

The bleach accelerator may be added to a color photographic material.

The bleach accelerators are particularly effective in the case of blixing the color photographic material for camera use.

As a fixing agent, there are thiosulfates, thiocyanates, thioether compounds, thioureas, or a large amount of iodides, but thiosulfates are usually used and, in particular, ammonium thiosulfate can be most widely used. As a preservative for the blixing solution, sulfites, hydrogensulfites or carbonylhydrogensulfite addition products are preferred.

After desilvering, the silver halide color photographic material of this invention is generally washed and/or stabilized.

The amount of wash water can be widely selected according to the use of the characteristics of photographic materials (according to, for example, a coupler used), the temperature of wash water, the number of wash tanks (stage number), the replenishing system (such as countercurrent system, normal current system) and other conditions. Among them, the relation of the number of wash tanks and the amount of water can be obtained by the method described in *Journal of the Society of Motion Picture and Television Engineers*, Vol. 64, 248 to 253 (May, 1955).

According to the multistage countercurrent system described in this article, the amount of wash water can be greatly reduced but the increase of residence time of water in the tanks produces the problem that bacteria grow and scum formed attaches to color photographic materials. As a means for solving this problem, a method for reducing the contents of calcium ions and magnesium ions described in JP-A-62-288838 can be very effectively used in this invention. Also, isothiazolone compounds and thiabendazoles described in JP-A-57-8542, chlorine containing sterilizers such as chlorinated sodium isocyanurate, benzotriazoles, and the sterilizers described in Hiroshi Horiguchi, *Bookin Boobaizai no Kagaku* (*Chemistry of Antibacterial and Antifungal Agents, Biseibutsu no Mekkin, Sakkin, Boobai Gijutsu* (*Antibacterial and Antifungal Technique of Microorganisms*), edited by Eiseigijutsu Kai, and *Bookin Boobai zai Jiten* (*Antibacterial and Antifungal Handbook*), edited by Nippon Bookin Boobai Gakkai can be used.

The pH of wash water for processing the color photographic materials of this invention is usually from 4 to 9, and preferably from 5 to 8. The temperature and the time for washing can be suitably selected according to the characteristics and the use of the color photographic materials being processed, but is generally selected in the ranges of from 15° C. to 45° C., from 10 minutes to 20 seconds, and preferably from 25° C. to 40° C., and from 5 minutes to 30 seconds.

Furthermore, the color photographic material can be processed by a stabilization solution without washing. For such a stabilization process, the methods described in JP-A-57-8543, JP-A-58-14834, and JP-A-60-220345 can be employed in this invention.

Also, a stabilization process may be performed after washing and an example of the stabilization bath is a stabilization bath containing formalin and a surface active agent, which is used as the final bath for color photographic materials for camera use. The stabilization solution may also contain the chelating agent and the antifungal agent described above.

The overflow solution formed by the replenisher for the wash water and/or stabilization solution can be re-used in other steps such as the desilvering steps.

The color photographic materials of this invention may contain a color developing agent for simplifying or quickening processing. For this purpose as the color developing agent, it is preferred to use various precursors therefor. For example, there are indoaniline compounds described in U.S. Pat. No. 3,342,597; Schiff base type compounds described in U.S. Pat. No. 3,342,599, and *Research Disclosure*, No. 14,850 and ibid., No. 15,159; aldol compounds described in *Research Disclosure*, No. 13,924; metal complex salts described in U.S. Pat. No. 3,719,492; and urethane compounds described in JP-A-53-135628.

The color photographic materials of this invention may, if necessary, contain various kinds of 1-phenyl-3-pyrazolidones for accelerating the color development. Typical examples of the compounds are described in JP-A-56-64339, JP-A-57-144547, and JP-A-115438.

The processing solutions described above are used at temperature of from 10° C. to 50° C., and typically from 33° C. to 38° C. but a higher temperature may be employed for accelerating the processings or shortening the processing time, or a lower temperature may be employed for improving the image quality or the stability of the processing solutions. Also, for saving silver in the color photographic material, processing using cobalt intensification or hydrogen peroxide intensification described in West German Patent 2,226,770 or U.S. Pat. No. 3,674,499, can be used.

The invention is further described in more detail based on the following examples.

EXAMPLE 1

A silver halide emulsion (1) for the blue-sensitive silver halide emulsion was prepared as follows.

| | |
|---|---|
| Solution 1 | |
| Water | 1000 ml |
| Sodium Chloride | 8.8 g |
| Gelatin | 25 g |
| Solution 2 | |
| Sulfuric Acid (1N) | 20 ml |
| Solution 3 | |
| The compound (1% aqueous solution) of the following formula | 3 ml |

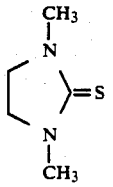

-continued

| | |
|---|---|
| Solution 4 | |
| Potassium Bromide | 14.01 g |
| Sodium Chloride | 1.72 g |
| Water to make | 130 ml |
| Solution 5 | |
| Silver Nitrate | 25 g |
| Water to make | 130 ml |
| Solution 6 | |
| Potassium Bromide | 56.03 g |
| Sodium Chloride | 6.88 g |
| $K_2IrCl_6$ (0.001% aqueous solution) | 1.0 ml |
| Water to make | 285 ml |
| Solution 7 | |
| Silver Nitrate | 100 g |
| Ammonium Nitrate (50%) | 2 ml |
| Water to make | 285 ml |

Solution 1 was heated to 75° C. and Solution 2 and Solution 3 were added thereto. Thereafter, Solution 4 and Solution 5 were simultaneously added to the mixture over a period of 40 minutes. After 10 minutes, Solution 6 and Solution 7 were simultaneously added to the mixture over a period of 25 minutes. After 5 minutes, the temperature thereof was lowered and the mixture was desalted. Then, water and gelatin for dispersion were added to the mixture and the pH thereof was adjusted to 6.2 to provide a mono-dispersed cubic silver chlorobromide emulsion (1) having a mean grain size of 1.01 μm, a coefficient of variation (the value of the standard deviation divided by the mean grain size: $s/\bar{d}$) of 0.08, and containing 80 mol % silver bromide. The emulsion was chemically sensitized with triethylthiourea.

Silver halide emulsion (2) for the blue-sensitive emulsion layer, silver halide emulsions (3) and (4) for the green-sensitive emulsion layer, and silver halide emulsions (5) and (6) for the red-sensitive emulsion layer were also prepared in the same manner as above except changing the chemicals and the amounts thereof, the temperature, and the addition time thereof.

The forms, the mean grain sizes, the halogen compositions, and the coefficients of variation of silver halide particles of the silver halide emulsions (1) to (6) are as follows.

| Emulsion | Form | Mean Grain Size (μm) | Halogen Composition (Br mol %) | Coefficient of Variation |
|---|---|---|---|---|
| (1) | Cubic | 1.01 | 80 | 0.08 |
| (2) | Cubic | 0.70 | 80 | 0.07 |
| (3) | Cubic | 0.52 | 80 | 0.08 |
| (4) | Cubic | 0.40 | 80 | 0.09 |
| (5) | Cubic | 0.40 | 70 | 0.09 |
| (6) | Cubic | 0.36 | 70 | 0.08 |

Then, a multilayer color photographic material having the following layer structure was coated on a paper support having a polyethylene coating on both surfaces thereof. The coating compositions for the layers were prepared as follows.

Preparation of the coating composition for Layer 1

In 27.2 ml of ethyl acetate, 3.8 ml of solvent (Solv-1), and 3.8 ml of solvent (Solv-2) were dissolved 19.1 g of yellow coupler (ExY) and 1.91 g of color image stabilizer (Cpd-1) and the solution was dispersed by emulsification in 185 ml of an aqueous 10% gelatin solution containing 8 ml of an aqueous solution of 10% sodium dodecylbenzenesulfonate. On the other hand, to a mixture of silver halide emulsion (1) and silver halide emulsion (2) 6:4 (mol ratio of silver) was added $5.0\times10^{-4}$ mol of the blue-sensitizing dye shown below per mol of silver, the mixed emulsion was mixed with the aforesaid emulsified dispersion to give the coating composition for Layer 1.

The coating compositions for Layer 2 to Layer 7 were also prepared in a similar manner.

As a gelatin hardening agent for each layer was used 1-oxy-3,5-dichloro-s-triazine sodium salt.

Also, each layer contained the following spectral sensitizing dye.

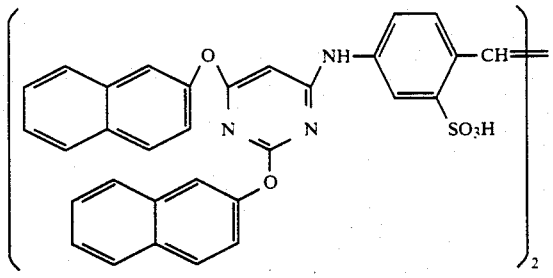

Blue-Sensitive Emulsion Layer:

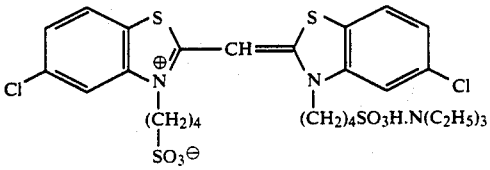

($5.0\times10^{-4}$ mol per mol of the silver halide)

Green-Sensitive Emulsion Layer:

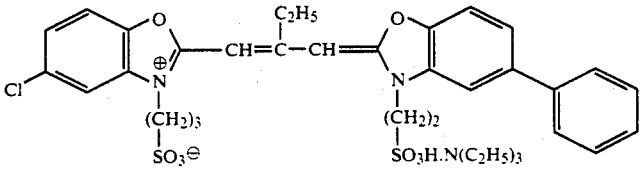

($4.0\times10^{-4}$ mol per mol of the silver halide)

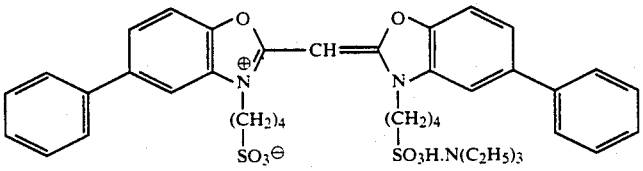

($7.0\times10^{-5}$ mol per mol of the silver halide)

Red-Sensitive Emulsion Layer:

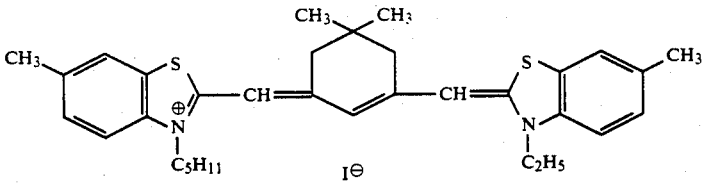

($0.9\times10^{-4}$ mol per mol of the silver halide)

Also, the red-sensitive emulsion layer contained the following compound in an amount of $2.6\times10^{-3}$ mol per mol of the silver halide in the layer.

Also, the blue-sensitive emulsion layer and the green-sensitive emulsion layer 4-hydroxy-6-methyl-1,3,3a,7-tetraazaindene in amounts of $1.2\times10^{-2}$ mol and $1.1\times10^{-2}$ mol, respectively, per mol of the silver halide.

The green-sensitive emulsion layer contained 1-(5-methylureidophenyl)-5-mercaptotetrazole in an amount of $1.0\times10^{-3}$ mol per mol of the silver halide.

The red-sensitive emulsion layer contained 2-amino-5-mercapto-1,3,4-thiadiazole in an amount of $3.0\times10^{-4}$ mol per mol of the silver halide.

Also, the following dyes were used as irradiation inhibiting dyes.

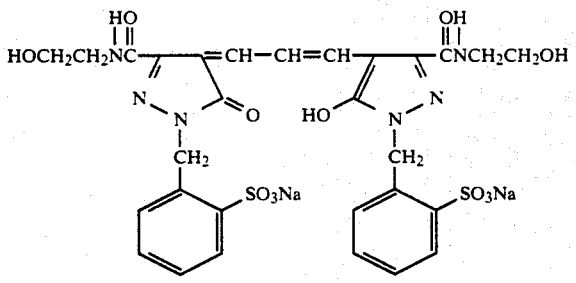

and

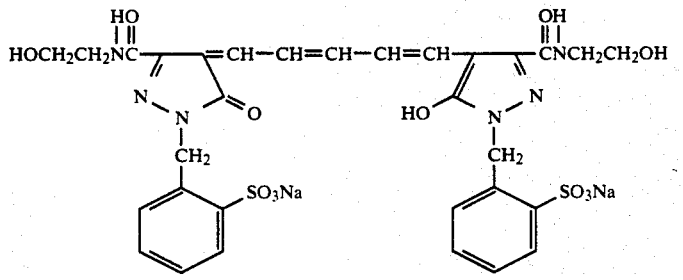

Layer Structure

The composition of each layer is shown below. The numeral shows the coating amount (g/m$^2$), and the coating amount for silver halide emulsions is calculated as silver.

In addition, the polyethylene coating on the emulsion layer side contained a white pigment ($TiO_2$) and a bluish dye (ultramarine blue).

| | |
|---|---|
| Layer 1 (Blue-Sensitive Emulsion Layer) | |
| Silver Halide Emulsions (1) and (2) (6:4) | 0.26 |
| Gelatin (total amount in the layer; the same hereinafter) | 1.20 |
| Yellow Coupler (ExY) | 0.66 |
| Color Image Stabilizer (Cpd-1) | 0.07 |
| Antifogging Agent (Cpd-2) | 0.02 |
| Solvent (Solv-1) | 0.13 |
| Solvent (Solv-2) | 0.13 |
| Layer 2 (Color Mixing Inhibition Layer) | |
| Gelatin | 1.34 |
| Color Mixing Inhibitor (Cpd-3) | 0.04 |
| Solvent (Solv-3) | 0.10 |
| Solvent (Solv-4) | 0.10 |
| Layer 3 (Green-Sensitive Emulsion Layer) | |
| Silver Halide Emulsions (3) and (4) (1:1) | 0.14 |
| Gelatin | 1.30 |
| Magenta Coupler (ExM-1) | 0.27 |
| Color Image Stabilizer (Cpd-5) | 0.16 |
| Solvent (Solv-3) | 0.21 |
| Solvent (Solv-5) | 0.33 |
| Layer 4 (Ultraviolet Absorption Layer) | |
| Gelatin | 1.44 |
| Ultraviolet Absorbent (UV-1) | 0.53 |

-continued

| | |
|---|---|
| Color Mixing Absorbent (Cpd-2) | 0.05 |
| Solvent (Solv-2) | 0.26 |
| Layer 5 (Red-Sensitive Emulsion Layer) | |
| Silver Halide Emulsions (5) and (6) (1:2) | 0.20 |
| Gelatin | 0.89 |
| Cyan Coupler (Exc-1) | 0.21 |
| Polymer (Cpd-1) | 0.21 |
| Color Image Stabilizer (Cpd-7) | 0.07 |
| Antifoggant (Cpd-2) | 0.01 |
| Solvent (Solv-1) | 0.19 |

Coating composition of Layer 5 was prepared as follows:

The cyan coupler, the polymer, the color image stabilizer and the antifoggant were dissolved into ethyl acetate, and the thus obtained solution was emulsified to disperse it in a gelatin solution. The emulsified dispersion obtained was added to the mixture of Emulsions (5) and (6).

| | |
|---|---|
| Layer 6 (Ultraviolet Absorption Layer) | |
| Gelatin | 0.47 |
| Ultraviolet Absorbent (UV-1) | 0.17 |
| Solvent (Solv-2) | 0.08 |
| Layer 7 (Protective Layer) | |
| Gelatin | 1.25 |
| Acryl-Modified Copolymer of Polyvinyl Alcohol (modified degree 17%) | 0.05 |
| Fluid Paraffin | 0.02 |

The compounds for making the color photographic paper were as follows.

(ExY)

-continued
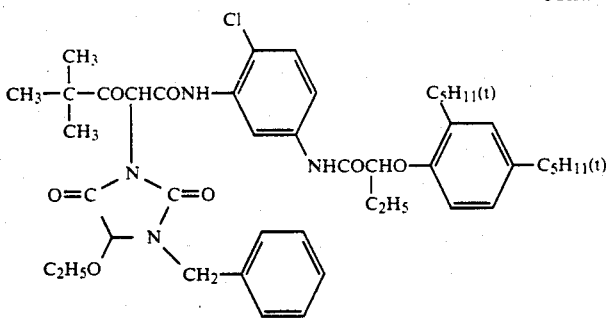
(ExM-1)
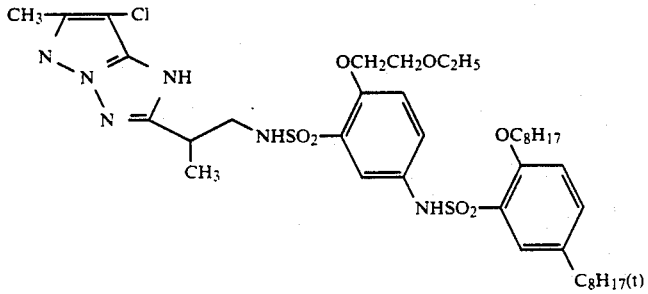
(ExC-1) (Corresponding to C-2)
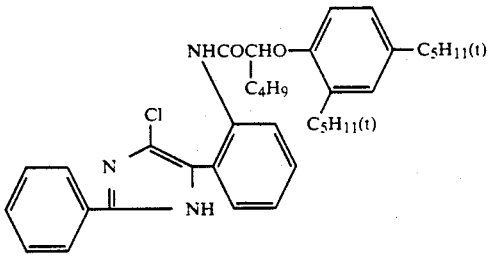
(Cpd-1) (Corresponding to P-57)
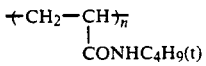
Mean molecular weight: 60,000
(Cpd-2)
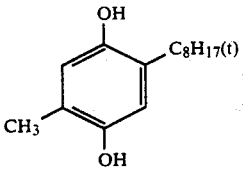
(Cpd-3)
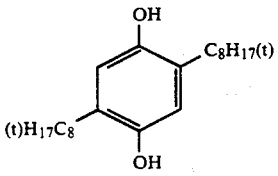
(Cpd-5)

-continued
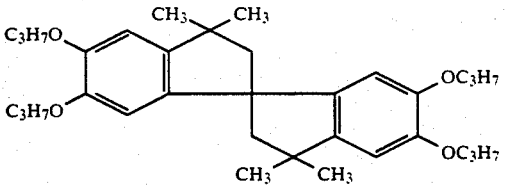
(Cpd-7)
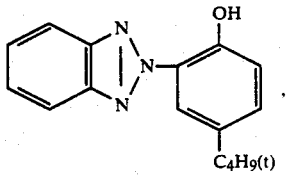
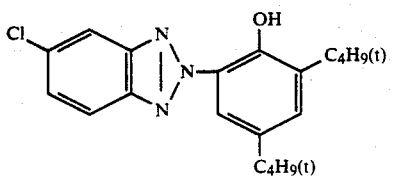
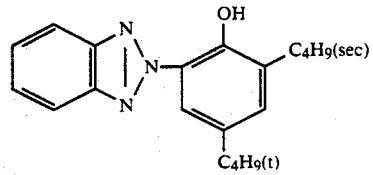
Mixture of 4:2:5 (weight ratio)
(UV-1)
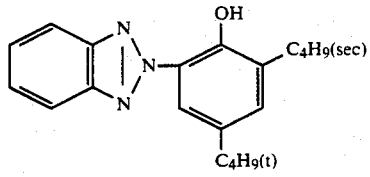
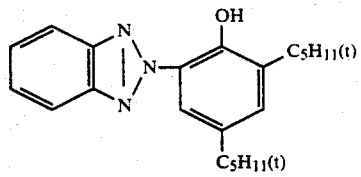
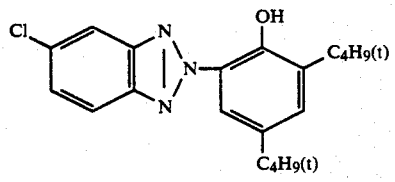
Mixture of 12:10:3 (weight ratio)
(Solv-1)
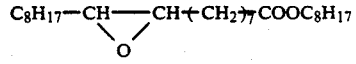
(Solv-2)
$O{=}P{+}O{-}C_9H_{19}\text{-iso})_3$ -continued (Solv-3)

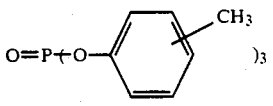

(Solv-4)

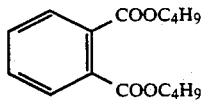

(Solv-5)

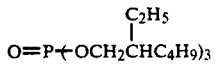

The sample thus prepared was Sample 101.

Also, by following the same procedure as above while changing the cyan coupler and the dispersing polymer in Layer 5 of Sample 101 as shown in Table 1 below, Samples 102 to 116 were prepared.

TABLE 1

| Sample | Cyan Coupler Compound | Cyan Coupler Amount | Polymer Compound | Polymer Amount |
|---|---|---|---|---|
| 102 | C-2 | 0.35 mmol/m$^2$ | P-3 | Equivalent weight to the coupler |
| 103 | C-2 | 0.35 mmol/m$^2$ | P-129 | Equivalent weight to the coupler |
| 104 | C-2 | 0.35 mmol/m$^2$ | P-60 | Equivalent weight to the coupler |
| 105 | C-3 | 0.35 mmol/m$^2$ | P-57 | Equivalent weight to the coupler |
| 106 | C-21 | 0.35 mmol/m$^2$ | P-57 | Equivalent weight to the coupler |
| 107 | C-7 | 0.35 mmol/m$^2$ | P-57 | Equivalent weight to the coupler |
| 108 | C-37 | 0.35 mmol/m$^2$ | P-57 | Equivalent weight to the coupler |
| 109 | C-38 | 0.35 mmol/m$^2$ | P-57 | Equivalent weight to the coupler |
| 110 | C-2 | 0.35 mmol/m$^2$ | — | — |
| 111 | C-3 | 0.35 mmol/m$^2$ | — | — |
| 112 | C-21 | 0.35 mmol/m$^2$ | — | — |
| 113 | C-7 | 0.35 mmol/m$^2$ | — | — |
| 114 | C-37 | 0.35 mmol/m$^2$ | — | — |
| 115 | C-38 | 0.35 mmol/m$^2$ | — | — |
| 116 | Comparison Compound A | 0.60 mmol/m$^2$ | — | — |

Samples 102 to 109: Samples of this invention
Samples 110 to 116: Comparison samples

| | | |
|---|---|---|
| Molecular weight of | P-3 | 100,000 |
| | P-129 | 80,000 |
| | P-60 | 70,000 |
| | P-57 | 60,000 |

COMPARISON EXAMPLE A

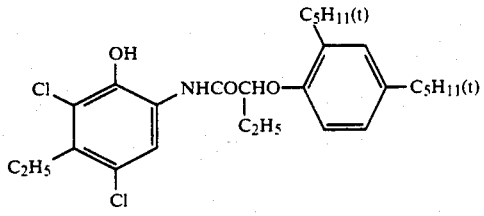

After imagewise exposure, each of the Samples 101 to 115 was processed by the following processing steps.

| Processing Step | Temperature | Time |
|---|---|---|
| Color Development | 38° C. | 100 sec. |
| Blix | 35° C. | 60 sec. |
| Rinse (1) | 33-35° C. | 20 sec. |
| Rinse (2) | 33-35° C. | 20 sec. |
| Rinse (3) | 33-35° C. | 20 sec. |
| Drying | 70-80° C. | 50 sec. |

The compositions of the processing solutions used were as follows.

| | Tank Soln. |
|---|---|
| Color Developer | |
| Water | 800 ml |
| Diethylenetriaminepentaacetic Acid | 1.0 g |
| Nitrilotriacetic Acid | 2.0 g |
| 1-Hydroxyethylidene-1,1-diphosphonic Acid | 2.0 g |
| Benzyl Alcohol | 16 ml |
| Diethylene glycol | 10 ml |
| Sodium Sulfite | 2.0 g |
| Potassium Bromide | 0.5 g |
| Potassium Carbonate | 30 g |
| N-Ethyl-N-(β-methanesulfonamidoethyl)-3-methyl-4-aminoaniline Sulfate | 5.5 g |
| Hydroxylamine Sulfate | 2.0 g |
| Brightening Agent (Whitex4, trade name, made by Sumitomo Chemical Company, Limited) | 1.5 g |
| Water to make | 1000 ml |
| pH (25° C.) | 10.20 |
| Blix Solution | |
| Water | 400 ml |

-continued

| | Tank Soln. |
|---|---|
| Ammonium Thiosulfate (70%) | 80 ml |
| Ammonium Sulfite | 24 g |
| Ethylenediaminetetraacetic Acid Iron(III) Ammonium Salt | 30 g |
| Ethylenediaminetetraacetic Acid Di-Sodium Salt | 5 g |
| Water to make | 1000 ml |
| pH (25° C.) | 6.50 |

Rinsing Solution

Ion-exchanged water (contents of calcium and magnesium each being less than 3 ppm).

The fastness of each sample after processing to heat and heat-humidity was determined by the following tests. That is, the extent of fading of each sample thus processed was determined after keeping the sample for one month in the dark at 60° C. or after keeping the sample for 15 days in the dark at 60° C. and 70% relative humidity, shown by the reduction rate of density from the initial density of 1.5 in percent. The results obtained are shown by Table 2.

TABLE 2

| Sample | After 1 month at 60° C. (%) | After 15 days at 60° C., 70% (%) |
|---|---|---|
| 101 | 3 | 3 |
| 102 | 4 | 5 |
| 103 | 4 | 4 |
| 104 | 3 | 4 |
| 105 | 2 | 3 |
| 106 | 2 | 4 |
| 107 | 3 | 2 |
| 108 | 2 | 2 |
| 109 | 2 | 3 |
| 110 | 30 | 36 |
| 111 | 25 | 35 |
| 112 | 29 | 38 |
| 113 | 26 | 33 |
| 114 | 27 | 30 |
| 115 | 26 | 31 |

Samples 101 to 109: Samples of this invention.

Samples 110 to 115: Comparison Samples.

As is clear from the results shown in the above table, it can be seen that by using the couplers and the polymers defined in this invention, the heat fastness and heat-humidity fastness of the images formed are greatly improved.

For determining the color reproducibility, through a photographed and processed color negative film (Super HR 100, trade name, made by Fuji Photo Film Co., Ltd.) Samples 101 to 116 were exposed using a color printer and each sample was processed by the above processing process.

When the color prints thus obtained were compared with each other, the color prints obtained from Samples 101 to 115 containing the cyan coupler of this invention very clearly reproduced, in particular, the blue and green of the object as compared with the color print obtained from Sample 116 containing a phenol derivative cyan coupler.

Furthermore, when these color prints were subjected to a fading test for 30 days using a fluorescent lamp fade-o-meter (15,000 lux), the cyan portions of the color prints formed by the samples containing no polymers according to this invention slightly faded but no fading was observed on the cyan portions of the color prints formed from the samples containing both the cyan coupler and the polymer for use in this invention.

EXAMPLE 2

Each of Samples 101 to 116 prepared as in Example 1 was exposed through an optical wedge and then processed by the following processing process.

| Processing Step | Temperature | Time |
|---|---|---|
| Color Development | 38° C. | 100 sec. |
| Blix | 30–34° C. | 60 sec. |
| Rinse (1) | 30–34° C. | 20 sec. |
| Rinse (2) | 30–34° C. | 20 sec. |
| Rinse (3) | 30–34° C. | 20 sec. |
| Drying | 70–80° C. | 50 sec. |

(The rinse was performed by a three tank countercurrent system of Rinse (3) to Rinse (1).)

The composition of the processing solutions were as follows.

| | |
|---|---|
| Color Developer | |
| Water | 800 ml |
| Diethylenetriaminepentaacetic Acid | 1.0 g |
| 1-hydroxyethylidene-1,1-diphosphonic Acid (60% aqueous solution) | 2.0 g |
| Nitrilotriacetic Acid | 2.0 g |
| Triethylenediamine(1,4-diazabicyclo[2,2,2]octane) | 5.0 g |
| Potassium Bromide | 0.5 g |
| Potassium Carbonate | 30 g |
| N-Ethyl-N-(β-methanesulfonamidoethyl)-3-methyl-4-aminoaniline Sulfate | 5.5 g |
| Diethylhydroxylamine | 4.0 g |
| Brightening Agent (Unitex-CK, trade name, made by Chiba-Geigy Corporation) | 1.5 g |
| Water to make | 1000 ml |
| pH (25° C.) | 10.25 |
| Blix Solution | |
| Water | 400 ml |
| Ammonium Thiosulfate (70% aqueous solution) | 200 ml |
| Sodium Sulfite | 20 g |
| Ethylenediaminetetraacetic Acid Iron(III) Ammonium Salt | 60 g |
| Ethylenediaminetetraacetic Acid Di-Sodium Salt | |
| Water to make | 1000 ml |
| pH (25° C.) | 7.00 |

Rinsing Solution

Ion-exchanged water (calcium and magnesium each being less than 3 ppm).

When the fastness of each sample after processing to heat, humidity-heat, and light was determined in the same manner as in Example 1, it was confirmed that the fastness to heat, humidity-heat, and light was greatly improved in the case of using the coupler and the polymer defined in this invention.

EXAMPLE 3

A multilayer color photographic material (Sample 301) having the layer structure shown below on a paper support having polyethylene coating on both surfaces thereof was prepared. The coating compositions for the layers were prepared as follows.

Preparation of Coating Composition for Layer 1

In 27.2 ml of ethyl acetate and 7.7 ml (8.0 g) of a high boiling solvent (Solv-1) were dissolved 19.1 g of yellow coupler (ExY-1) and 4.4 g of color image stabilizer (Cpd-1) and the solution was dispersed by emulsification in 185 ml of an aqueous 10% gelatin solution containing 8 ml of an aqueous solution of 10% sodium dodecylbenzenesulfonate.

The emulsified dispersion was mixed with Emulsion 7 and Emulsion 8 and the gelatin concentration was adjusted to composition shown below to provide the coating composition for Layer 1.

The coating compositions for Layer 2 to Layer 7 were also prepared in the same manner to Layer 1.

Each layer contained 1-oxy-3,5-dichloro-s-triazine sodium salt as a gelatin hardening agent.

Also, compound (Cpd-2) shown below was used as a thickener.

Layer Structure

The composition of each layer is shown below. The numeral shows the coating amount ($g/m^2$), wherein the coating amount for silver halide emulsion is calculated as the amount of silver.

Support

Polyethylene laminated paper having on the emulsion layer side a polyethylene laminer containing a white pigment ($SiO_2$) and a bluish dye.

| | |
|---|---|
| Layer 1 (Blue-Sensitive Emulsion Layer) | |
| Mono-Dispersed Silver Chlorobromide Emulsion (EM-7) spectrally sensitized by sensitizing dye (ExS-1) | 0.15 |
| Mono-Dispersed Silver Chlorobromide Emulsion (EM-8) spectrally sensitized by sensitizing dye (ExS-1) | 0.15 |
| Gelatin | 1.86 |
| Yellow Coupler (ExY-1) | 0.82 |
| Color Image Stabilizer (Cpd-1) | 0.19 |
| Solvent (Solv-1) | 0.35 |
| Layer 2 (Color Mixing Inhibition Layer) | |
| Gelatin | 0.99 |
| Color Mixing Inhibitor (Cpd-3) | 0.08 |
| Layer 3 (Green-Sensitive Emulsion Layer) | |
| Mono-Dispersed Silver Chlorobromide Emulsion (EM-9) spectrally sensitized by sensitizing dyes (ExS-2, 3) | 0.12 |
| Mono-Dispersed Silver Chlorobromide Emulsion (EM-10) spectrally sensitized by sensitizing dyes (ExS-2, 3) | 0.24 |
| Gelatin | 1.24 |
| Magenta Coupler (ExM-1) | 0.39 |
| Color Image Stabilizer (Cpd-4) | 0.25 |
| Color Image Stabilizer (Cpd-5) | 0.12 |
| Solvent (Solv-2) | 0.25 |
| Layer 4 (Ultraviolet Absorption Layer) | |
| Gelatin | 1.60 |
| Ultraviolet Absorbents (Cpd-6/Cpd-7/Cpd-8 = 3/2/6 by weight ratio) | 0.70 |
| Color Mixing Inhibitor (Cpd-9) | 0.05 |
| Solvent (Solv-3) | 0.42 |
| Layer 5 (Red Sensitive Emulsion Layer) | |
| Mono-Dispersed Silver Chlorobromide Emulsion (EM-11) spectrally sensitized by sensitizing dyes (ExS-4, 5) | 0.07 |
| Mono-Dispersed Silver Chlorobromide Emulsion (EM-12) spectrally sensitized by sensitizing dyes (ExS-4, 5) | 0.16 |
| Gelatin | 0.92 |
| Cyan Coupler (ExC-1) | 0.21 |
| Color Image Stabilizers (Cpd-17/Cpd-8/Cpd-10 = 3/4/2 by weight ratio) | 0.17 |
| Polymer (Cpd-11) | 0.21 |
| Solvent (Solv-1) | 0.20 |
| Layer 6 (Ultraviolet Absorption Layer) | |
| Gelatin | 0.54 |
| Ultraviolet Absorbents (Cpd-6/Cpd-8/Cpd-10 = 1/5/3 by weight ratio) | 0.21 |
| Solvent (Solv-4) | 0.08 |
| Layer 7 (Protective Layer) | |
| Gelatin | 1.33 |
| Acryl-Modified Copolymer of Polyvinyl Alcohol (modified degree 17%) | 0.17 |
| Fluid Paraffin | 0.03 |

Also, in this case, compounds Cpd-12 and Cpd-13 were used as irradiation inhibiting dyes. Furthermore, each layer contained Alkanol XC (trade name, made by DuPont), sodium alkylbenzenesulfonate, succinic acid ester, and Magefacx F-120 (trade name, made by Dainippon Ink and Chemicals, Inc.) as emulsion-dispersing agent and coating aid. Also, 1-(5-methylureidophenyl)-5-mercaptotetrazole and 4-hydroxy-6-methyl-1,3,3a,7-tetraazaindene were used as stabilizers for silver halide.

The details of the silver halide particles in the emulsions used for making the sample were as follows.

| Emulsion | Form | Grain Size (μm) | Br Content (mol %) | Coeff. of Variation |
|---|---|---|---|---|
| EM 7 | Cubic | 1.1 | 1.0 | 0.10 |
| EM 8 | Cubic | 0.8 | 1.0 | 0.10 |
| EM 9 | Cubic | 0.45 | 1.5 | 0.09 |
| EM 10 | Cubic | 0.34 | 1.5 | 0.09 |
| EM 11 | Cubic | 0.45 | 1.5 | 0.09 |
| EM 12 | Cubic | 0.34 | 1.6 | 0.10 |

The compounds used for the sample are shown below.

ExY-1

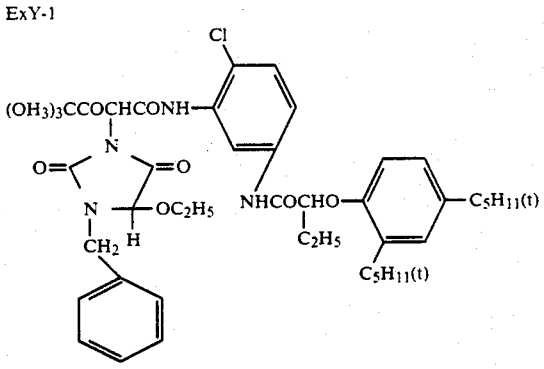

ExM-1

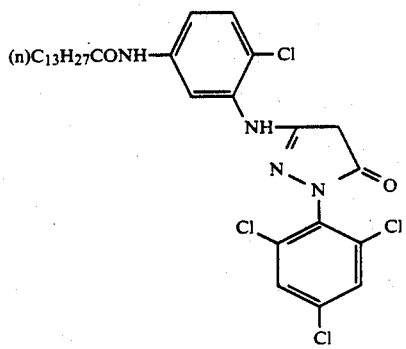

ExC-1 (corresponding to Compound C-2)

-continued
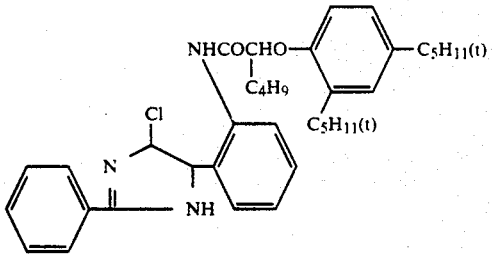
Cpd-1
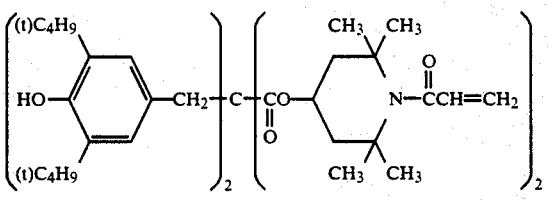
Cpd-2
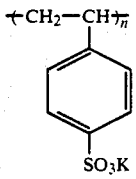
Cpd-3
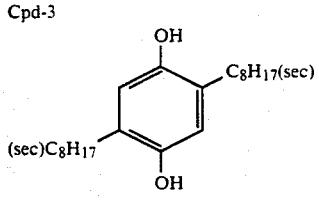
Cpd-4
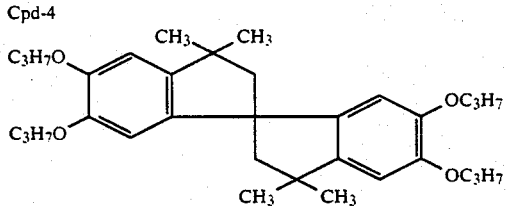
Cpd-5
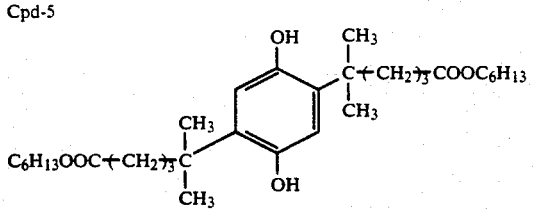
ExS-1
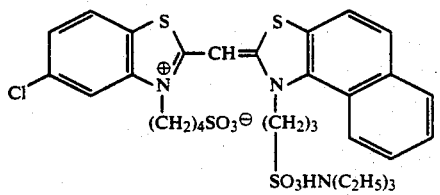
$6 \times 10^{-4}$ mol/mol-Ag
ExS-2
-continued
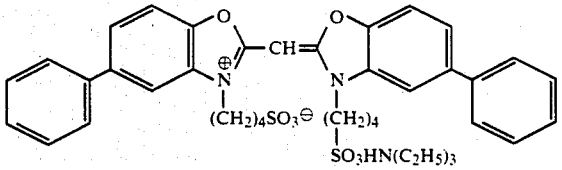
$8 \times 10^{-5}$ mol/mol-Ag
ExS-3
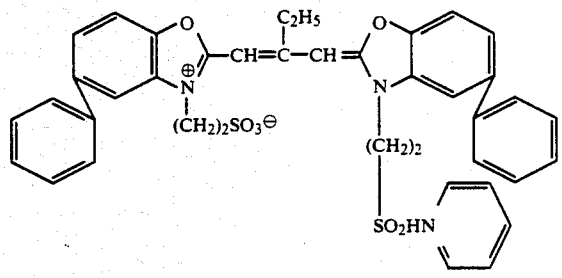
$4 \times 10^{-4}$ mol/mol-Ag
ExS-4
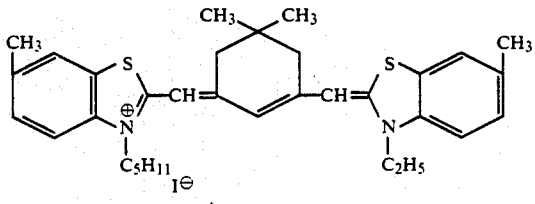
$1.8 \times 10^{-4}$ mol/mol-Ag
ExS-5
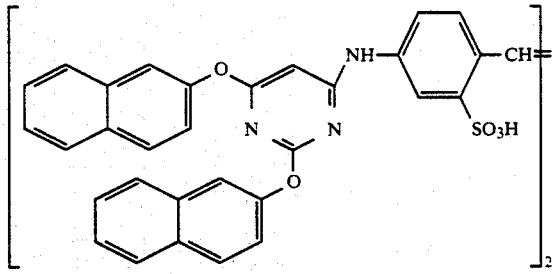
Cpd-6
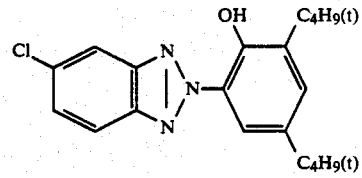
Cpd-7
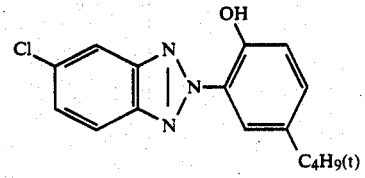
Cpd-8

-continued

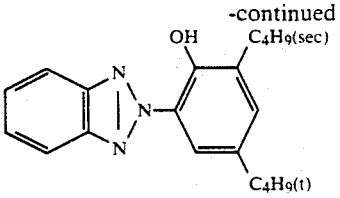

Cpd-9

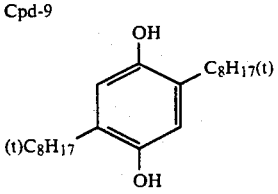

Cpd-10

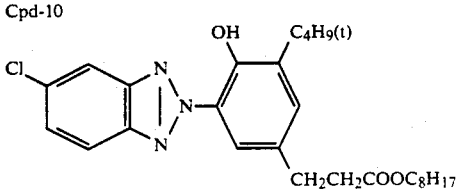

Cpd-11 (corresponding to Compound P-57)

$\leftarrow CH_2-\underset{\underset{CONHC_4H_9(t)}{|}}{CH}\rightarrow_n$ (n = 100 ~ 1000)

Molecular weight 100.000

Cpd-12

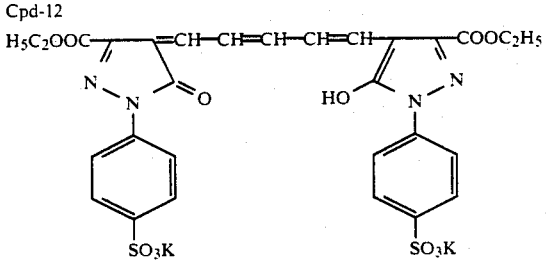

Cpd-13

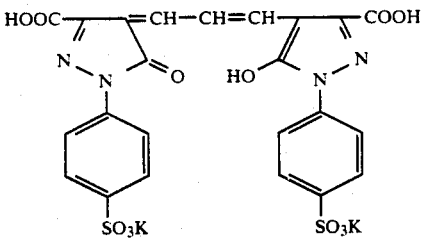

(Solv-1)

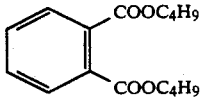

(Solv-2)

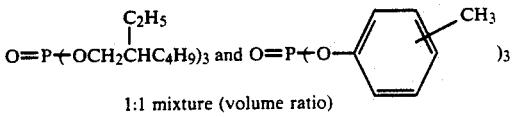

1:1 mixture (volume ratio)

(Solv-3)

$O=P\leftarrow O-C_9H_{19}(iso))_3$ (Solv-4)

-continued

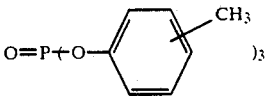

Then, by following the same procedure as the case of preparing Sample 301 except that the cyan coupler and the dispersing polymer for Layer 5 of Sample 301 were changed as shown in Table 3 below, Samples 302 to 310 were prepared.

TABLE 3

| | Cyan Coupler | | Polymer | |
|---|---|---|---|---|
| Sample | Compound | Coated Amount | Compound | Coated Amount |
| 302 | C-2 | 0.35 mmol/m² | P-3 | Equivalent weight to the coupler |
| 303 | C-2 | 0.35 mmol/m² | P-129 | Equivalent weight to the coupler |
| 304 | C-7 | 0.35 mmol/m² | P-57 | Equivalent weight to the coupler |
| 305 | C-7 | 0.35 mmol/m² | P-3 | Equivalent weight to the coupler |
| 306 | C-37 | 0.35 mmol/m² | P-57 | Equivalent weight to the coupler |
| 307 | C-2 | 0.35 mmol/m² | — | — |
| 308 | C-7 | 0.35 mmol/m² | — | — |
| 309 | C-37 | 0.35 mmol/m² | — | — |
| 310 | B* | 0.60 mmol/m² | — | — |

B*: Comparison Compound B shown below
Samples 301 to 306: Samples of this invention
Samples 307 to 310: Comparison samples.

COMPARISON COMPOUND B

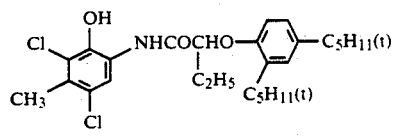

and

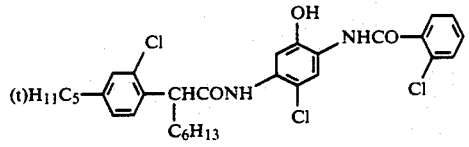

1:1 Mixture (mol ratio).

Each of the aforesaid Samples 301 to 310 was exposed through an optical wedge and processed by the following processing process.

| Processing Step | Temperature | Time |
|---|---|---|
| Color Development | 35° C. | 45 sec. |
| Blix | 30-36° C. | 45 sec. |
| Stabilization (1) | 30-37° C. | 20 sec. |
| Stabilization (2) | 30-37° C. | 20 sec. |
| Stabilization (3) | 30-37° C. | 20 sec. |
| Stabilization (4) | 30-37° C. | 30 sec. |

-continued

| Processing Step | Temperature | Time |
|---|---|---|
| Drying | 70–85° C. | 60 sec. |

The stabilization was performed by a 4-tank counter-current system of Stabilization (4) to Stabilization (1).

The compositions of the processing solutions were as follows.

| | |
|---|---|
| Color Developer | |
| Water | 800 ml |
| Ethylenediaminetetraacetic Acid | 2.0 g |
| Triethanolamine | 8.0 g |
| Sodium Chloride | 1.4 g |
| Potassium Carbonate | 25 g |
| N-Ethyl-N-(β-methanesulfonamidoethyl)-3-methyl-4-aminoaniline Sulfate | 5.0 g |
| N,N-Diethylhydroxylamine | 4.2 g |
| 5,6-Dihydroxybenzene-1,2,4-trisulfonic Acid | 0.3 g |
| Brightening Agent (4,4'-diaminostilbene series) | 2.0 g |
| Water to make | 1000 ml |
| pH (25° C.) | 10.10 |
| Blix Solution | |
| Water | 400 ml |
| Ammonium Thiosulfate (70% aqueous solution) | 100 ml |
| Sodium Sulfite | 18 g |
| Ethylenediaminetetraacetic Acid Iron(III) Ammonium Salt | 55 g |
| Ethylenediaminetetraacetic Acid Di-Sodium Salt | 3 g |
| Glacial Acetic Acid | 8 g |
| Water to make | 1000 ml |
| pH (25° C.) | 5.5 |
| Stabilizing Solution | |
| Formalin (37% aqueous solution) | 0.1 g |
| Formalin-Copper Sulfite Addition Product | 0.7 g |
| 5-Chloro-2-methyl-4-isothiazoline-3-one | 0.02 g |
| 2-Methyl-4-isothiazoline-3-one | 0.01 g |
| Copper Sulfate | 0.005 g |
| Water to make | 1000 ml |
| pH (25° C.) | 4.0 |

The fastness of each sample processed to heat, humidity-heat, and light was determined in the same manner as in Example 1, and it was confirmed that by using the couplers and the polymers defined in this invention, the fastness to heat, humidity-heat, and light were greatly improved.

Furthermore, when the color reproducibility of each sample was determined in the same manner as in Example 1, the color prints obtained by using Samples 301 to 307 of this invention showed greatly improved color reproducibility of blue and green as compared to Sample 310 (comparison).

EXAMPLE 4

A multilayer color photographic material (Sample 401) was prepared by successively forming Layer 1 (the lowermost layer) to Layer 7 (the uppermost layer) on a paper having a polyethylene coating on both surfaces thereof, the paper support being subjected to a corona discharging treatment. The coating compositions of the layers were prepared as follows. In addition, the couplers, color image-stabilizers, etc., used for the coating compositions are described below.

The coating composition for Layer 1 was prepared in the following manner.

That is, a mixture obtained by adding 600 ml of ethyl acetate as an auxiliary solvent to a mixture of 200 g of the yellow coupler shown below, 93.3 g of fading inhibitor (r) shown below, 10 g of high-boiling point solvent (p), and 5 g of solvent (q) each shown below was heated to 60° C. to dissolve the components and the solution was mixed with 3,300 ml of an aqueous 5% gelatin solution containing 330 ml of an aqueous solution of 5% alkanol B (trade name of alkyl naphthalenesulfonate, made by DuPont). Then, the resultant mixture was emulsified using a colloid mill to provide a coupler dispersion. After distilling off ethyl acetate from the dispersion at reduced pressure, the dispersion was added to 1,400 g of a silver chlorobromide emulsion (containing 96.7 g of silver and 170 g of gelatin) containing a senstizing dye for the blue-sensitive emulsion layer and 1-methyl-2-mercapto-5-acetylamino-1,3,4-triazole and 2,600 g of an aqueous 10% gelatin solution was added to the mixture to provide the coating composition.

The coating compositions for other layers were also prepared in a similar manner.

Layer Structure

The composition of each layer is shown below. The numeral shows the coating amount (g/m$^2$), wherein the coating amount for silver halide emulsion is calculated as the amount of silver.

| | |
|---|---|
| Layer 1 (Blue-Sensitive Emulsion Layer) | |
| Silver Chlorobromide Emulsion (AgBrCl: silver bromide 80 mol %) | 290 (Ag amount) |
| Yellow Coupler | 600 |
| Fading Inhibitor (r) | 280 |
| Solvent (p) | 30 |
| Solvent (q) | 15 |
| Gelatin | 1800 |
| Layer 2 (Color Mixing Inhibiting Layer) | |
| Silver Bromide Emulsion (non-subjected to after-ripening, mean grain size 0.05 μm) | 10 |
| Color Mixing Inhibitor (s) | 55 |
| Solvent (p) | 30 |
| Solvent (q) | 15 |
| Gelatin | 800 |
| Layer 3 (Green-Sensitive Emulsion Layer) | |
| Silver Chlorobromide Emulsion (AgBrCl: silver bromide 70 mol %) | 305 (Ag amount) |
| Magenta Coupler | 670 |
| Fading Inhibitor (t) | 150 |
| Fading Inhibitor (u) | 10 |
| Solvent (p) | 200 |
| Solvent (q) | 10 |
| Gelatin | 1400 |
| Layer 4 (Color Mixing Inhibiting Layer) | |
| Color Mixing Inhibitor (s) | 65 |
| Ultraviolet Absorbent (n) | 450 |
| Ultraviolet Absorbent (o) | 230 |
| Solvent (p) | 50 |
| Solvent (q) | 50 |
| Gelatin | 1700 |
| Layer 5 (Red-Sensitive Emulsion Layer) | |
| Silver Chlorobromide Emulsion (AgBrCl: silver bromide 70 mol %) | 210 (Ag amount) |
| Cyan Coupler | 340 |
| Fading Inhibitor (r) | 250 |
| Polymer (v) | 340 |
| Solvent (p) | 160 |
| Solvent (q) | 100 |
| Gelatin | 1800 |
| Layer 6 (Ultraviolet Absorption Layer) | |
| Ultraviolet Absorbent (n) | 260 |
| Ultraviolet Absorbent (o) | 70 |
| Solvent (p) | 300 |
| Solvent (q) | 100 |
| Gelatin | 700 |
| Layer 7 (Protective Layer) | |

-continued

| Gelatin | 620 |
|---|---|

The compounds used for making the sample were as follows.
n: 2-(2-Hydroxy-3,5-di-tert-amylphenyl)benzotriazole
o: 2-(2-Hydroxy-3,5-di-tert-butylphenyl)benzotriazole
p: Di(2-ethylhexyl) Phthalate
q: Dibutyl Phthalate
r: 2,5-Di-tert-amylphenyl-3,5-di-tert-butylhydroxy Benzoate
s: 2,5-Di-tert-octylhydroquinone
t: 1,4-Di-tert-amyl-2,5-dioctyloxybenzene
u: 2,2'-Methylenebis-(4-methyl-6-tert-butylphenol
v: $(-CH_2-\underset{\underset{CONHC_4H_9(t)}{|}}{CH})_n$ (corresponding to Compund P-57) Mean molecular weight 70,000

Also, for the silver halide emulsion layers were used the following sensitizing dyes.

Blue-Sensitive Emulsion Layer: Anhydro-5-methoxy-5'-methyl-3,3'-disulfopropylselenacyanine Hydroxide Green-sensitive Emulsion Layer: Anhydroxide-9-ethyl-5,5'-diphenyl-3,3'-disulfoethyloxacarbocyanine Hydroxide Red-Sensitive Emulsion Layer: 3,3'-Diethyl-5-methoxy-9,9'-(2,2-dimethyl-1,3-propano)thiadicarbocyanine Iodide Also, for each emulsion layer was used the following compound as a stabilizer:

1-Methyl-2-mercapto-5-acetylamino-1,3,4-triazole

Also, the following compounds were used as irradiation inhibiting dyes:

4-(3-Carboxy-5-hydroxy-4-(3-(3-carboxy-5-oxo-1-(4-sulfonaphthophenyl)-2-pyrazolin-4-iridene)-propenyl)-1-pyrazolyl)benzene Sulfonate.Dipotassium salt.

N,N'-(4,8-Dihydroxy-9,10-dioxo-3,7-disulfonatoanthracene-1,5-diyl)bis(aminomethane sulfonate)tetrasodium Salt.

Furthermore, 1,2-bis(vinylsulfonyl)ethane was used for each layer as a hardening agent.

The couplers used for the sample were as follows.

Yellow Coupler:

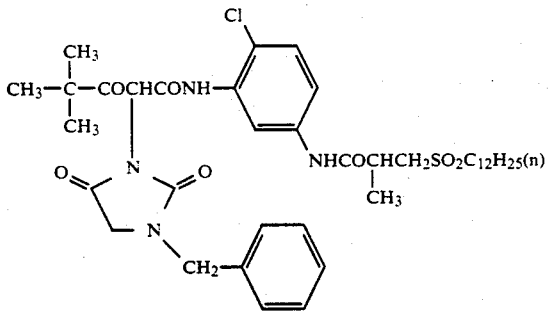

Magenta Coupler:

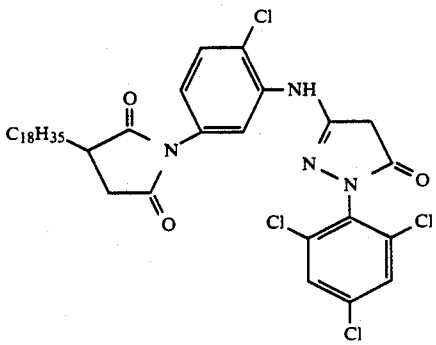

-continued

Cyan Coupler (corresponding to Compound C-2):

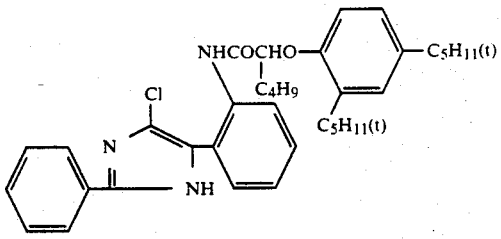

Then by following the same procedure for preparing Sample 401 except that the dispersing polymer for Layer 5 of Sample 401 was not added, or the dispersing polymer for Layer 5 was not added and Comparison compounds C were used in place of the cyan coupler for Layer 5, Samples 402 and 403 were prepared, respectively.

COMPARISON COMPOUNDS C

A 1:1 mixture (mol ratio) of

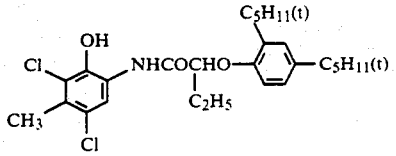

and

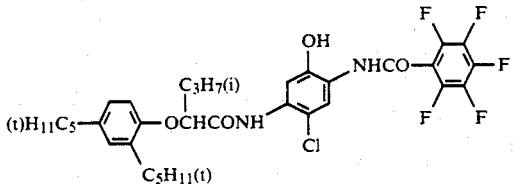

Each of Samples 401 to 403 was exposed through a photographed and processed color negative film using a color printer and processed by the following processing steps.

| Processing Step | Temperature | Time |
|---|---|---|
| Color Development | 38° C. | 3 min. 30 sec. |
| Blix | 30–35° C. | 1 min. 30 sec. |
| Stabilization (1) | 30–35° C. | 1 min. 00 sec. |
| Stabilization (2) | 30–35° C. | 1 min. 00 sec. |
| Stabilization (3) | 30–35° C. | 1 min. 00 sec. |
| Drying | 70–80° C. | 1 min. 30 sec. |

The stabilization was performed by a 3 tank counter-current system of Stabilization (3) to Stabilization (1).

The compositions of the processing solutions were as follows.

| Color Developer | |
|---|---|
| Water | 800 ml |
| Hydroxyethoxyiminodiacetic Acid | 4.0 g |
| 1-Hydroxyethylidene-1,1-diphosphonic Acid (60% aqueous solution) | 1.0 g |
| Magnesium Chloride | 0.8 g |
| Benzyl Alcohol | 15 ml |
| Diethylene Glycol | 15 ml |

-continued

| | |
|---|---|
| Potassium Sulfite | 2.0 g |
| Potassium Bromide | 1.1 g |
| Potassium Carbonate | 30 g |
| N-Ethyl-N-(β-methanesulfonamidoethyl)-4-aminoaniline Sulfate | 5.5 g |
| Hydroxyamine Sulfate | 3.0 g |
| Brightening Agent (4,4'-diaminostilbene Compound) | 1.0 g |
| Water to make | 1000 ml |
| pH (25° C.) | 10.20 |
| Blix Solution | |
| Water | 400 ml |
| Ammonium Thiosulfate (70% aqueous solution) | 100 ml |
| Ammonium Sulfite (40% aqueous solution) | 27.5 ml |
| Ethylenediaminetetraacetic Acid Iron(III) Ammonium Salt | 60 g |
| Ethylenediaminetetraacetic Acid Di-Sodium Salt | 3 g |
| Water to make | 1000 ml |
| pH (25° C.) | 7.10 |
| Stabilization Solution | |
| 1-Hydroxyethylidene-1,1-diphosphonic Acid (60% aqueous solution) | 1.6 ml |
| Bismuth Chloride | 0.3 g |
| Polyvinylpyrrolidone | 0.3 g |
| Aqueous Ammonia (26%) | 2.5 ml |
| Nitrilotriacetic Acid | 1.0 g |
| 5-Chloro-2-methyl-4-isothiazolin-3-one | 0.05 g |

-continued

| | |
|---|---|
| 2-Octyl-4-isothiazolin-3-one | 0.05 g |
| Brightening Agent (4,4'-diaminostilbene compound) | 1.0 g |
| Water to make | 1000 ml |
| pH (25° C.) | 7.5 |

When the fastness of the color print of each sample after processing to heat, humidity-heat, and light was determined as in Example 1, it was confirmed that in the case of using the coupler and the polymer defined in this invention, the fastness was greatly improved.

EXAMPLE 5

A multilayer color photographic material (Sample 501) having the following layer structure on a paper support having a polyethylene coating on both surfaces was prepared. The polyethylene coating on the emulsion layer side contained a white pigment ($TiO_2$) and a slight amount of ultramarine blue as a bluish dye.

Layer Structure

The compositions of the layers are shown below. The numerals are the coating amounts ($g/m^2$), wherein the amount of silver halide emulsion is calculated as the amount of silver.

| | |
|---|---|
| Layer 1 (Gelatin Layer) | |
| Gelatin | 1.30 |
| Layer 2 (Antihalation Layer) | |
| Black Colloidal Silver | 0.10 |
| Gelatin | 0.70 |
| Layer 3 (Low-Speed Red-Sensitive Layer) | |
| Silver Iodobromide Emulsion (AgBrI particles: silver iodide 5.0 mol %, mean grain size 0.4 μm) spectrally sensitized by red sensitizing dyes (*1 and *2) | 0.15 |
| Gelatin | 1.00 |
| Cyan Coupler (*3) | 0.16 |
| Polymer (*4) | 0.16 |
| Fading Inhibitors (*5, *6, and *7) | 0.10 |
| Coupler Solvents (*8 and *9) | 0.06 |
| Layer 4 (High-Speed Red-Sensitive Layer) | |
| Silver Iodobromide Emulsion (AgBrI particles: silver iodide 6.0 mol %, mean grain size 0.7 μm) spectrally sensitized by red sensitizing dyes (*1 and *2) | 0.15 |
| Gelatin | 1.00 |
| Cyan Coupler (*3) | 0.24 |
| Polymer (*4) | 0.24 |
| Fading Inhibitors (*5, *6, and *7) | 0.15 |
| Coupler Solvents (*8 and *9) | 0.10 |
| Layer 5 (Interlayer) | |
| Magenta Colloidal Silver | 0.02 |
| Gelatin | 1.00 |
| Color Mixing Inhibitor (*10) | 0.08 |
| Color Mixing Inhibitor Solvents (*11 and *12) | 0.16 |
| Polymer Latex (*13) | 0.10 |
| Layer 6 (Low-Speed Green-Sensitive Layer) | |
| Silver Iodobromide Emulsion (AgBrI particles: silver iodide 2.5 mol %, mean grain size 0.4 μm) spectrally sensitized by green sensitizing dyes (*14) | 0.10 |
| Gelatin | 0.80 |
| Magenta Coupler (*15) | 0.10 |
| Fading Inhibitor (*16) | 0.10 |
| Stain Inhibitor (*17) | 0.01 |
| Stain Inhibitor (*18) | 0.001 |
| Coupler Solvents (*11 and *19) | 0.15 |
| Layer 7 (High-Speed Green-Sensitive Layer) | |
| Silver Iodobromide Emulsion (AgBrI particles: silver iodide 3.5 mol %, mean grain size 0.9 μm) spectrally sensitized by green sensitizing dyes (*14) | 0.10 |
| Gelatin | 0.80 |
| Magenta Coupler (*15) | 0.10 |
| Fading Inhibitor (*16) | 0.01 |
| Stain Inhibitor (*17) | 0.01 |
| Stain Inhibitor (*18) | 0.001 |
| Coupler Solvents (*11 and *19) | 0.15 |
| Layer 8 (Yellow Filter Layer) | |
| Yellow Colloidal Silver | 0.20 |
| Gelatin | 1.00 |

-continued

| | |
|---|---|
| Color Mixing Inhibitor (*10) | 0.06 |
| Color Mixing Inhibitor Solvents (*11 and *12) | 0.15 |
| Polymer Latex (*13) | 0.10 |
| Layer 9 (Low-Speed Blue-Sensitive Layer) | |
| Silver Iodobromide Emulsion (AgBrI particles: silver iodide 2.5 mol %, mean grain size 0.5 μm) spectrally sensitized by blue sensitizing dyes (*20) | 0.15 |
| Gelatin | 0.50 |
| Yellow Coupler (*21) | 0.20 |
| Stain Inhibitor (*18) | 0.001 |
| Coupler Solvent (*9) | 0.05 |
| Layer 10 (High-Speed Blue-Sensitive Layer) | |
| Silver Iodobromide Emulsion (AgBrI particles: silver iodide 2.5 mol %, mean grain size 1.2 μm) spectrally sensitized by blue sensitizing dyes (*20) | 0.25 |
| Gelatin | 1.00 |
| Yellow Coupler (*21) | 0.40 |
| Stain Inhibitor (*18) | 0.002 |
| Coupler Solvent (*9) | 0.10 |
| Layer 11 (Ultraviolet Absorption Layer) | |
| Gelatin | 1.50 |
| Ultraviolet Absorbents (*22, *6, and *7) | 1.00 |
| Color Mixing Inhibitor (*23) | 0.006 |
| Color Mixing Inhibitor Solvent (*9) | 0.15 |
| Irradiation Inhibiting Dye (*24) | 0.02 |
| Irradiation Inhibiting Dye (*25) | 0.02 |
| Layer 12 (Protective Layer) | |
| Fine Grain Silver Chlorobromide (AgBrCl particles: silver chloride 97 mol %, mean grain size 0.2 μm) | 0.07 |
| Gelatin | 1.50 |
| Gelatin Hardening Agent (*26) | 0.17 |

The compounds used for the sample were as follows.

*1: 5,5-Dichloro-3,3'-di(3-sulfobutyl)-9-ethylthiacarbocyanine Sodium Salt
*2: Triethylammonium-3-[2-{2-[3-(3-sulfopropyl)naphtho(1,2-d)thiazoline-2-indenemethyl]-1-butenyl}-3-naphtho(1,2-d)thiazoline]propane Sulfonate
*3: Compound C-2
*4: Compound P-57 (M.W.: 60,000)
*5: 2-(2-Hydroxy-3-sec-5-t-butylphenyl)benzotriazole
*6: 2-(2-Hydroxy-5-t-butylphenyl)benzotriazole
*7: 2-(2-Hydroxy-3,5-di-t-butylphenyl)-6-chlorobenzotriazole
*8: Di(2-ethylhexyl) Phthalate
*9: Trinonyl Phosphate
*10: 22-5-Di-t-octylhydroquinone
*11: Tricresyl Phosphate
*12: Dibutyl Phosphate
*13: Polyethyl Acrylate
*14: 5,5'-Diphenyl-9-ethyl-3,3'-disulfopropyloxacarbocyanine Sodium Salt
*15: 7-Chloro-6-methyl-2-[1-{2-octyloxy-5-(2-octyloxy-5-t-octylbenzenesulfonamido}2-propyl]-1H-pyrazolo[1,5-b][1,2,4}triazole
*16: 3,3,3',3'-Tetramethyl-5,6,5',6'-tetrapropoxy-1,1'-bis-spiroindane
*17: 3-(2-Ethylhexyloxycarbonyloxy)-1-(3-hexadecyloxyphenyl)-2-pyrazoline
*18: 2-Methyl-5-t-octylhydroquinone
*19: Trioctyl Phosphate
*20: Triethylammonium-3-[2-(3-benzylrhodanin-5-iridene)-3-benzoxazolynyl]propane Sulfonate
*21: α-Pivaloyl-α-[(2,4-dioxo-1-benzyl-5-ethoxyhydantoin-3-yl)-2-chloro-5-(α-2,4-di-t-amylphenoxy)butaneamido]acetoanilide
*22: 5-Chloro-2-(2-hydroxy-3-t-butyl-5-t-octyl)phenylbenzotriazole
*23: 2,5-Di-sec-octylhydroquinone

*24:

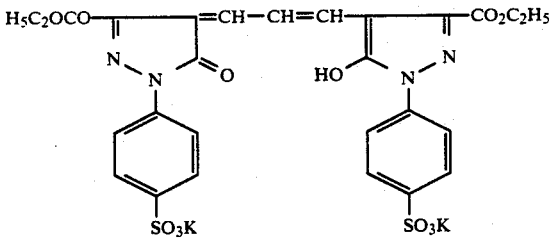

*25:

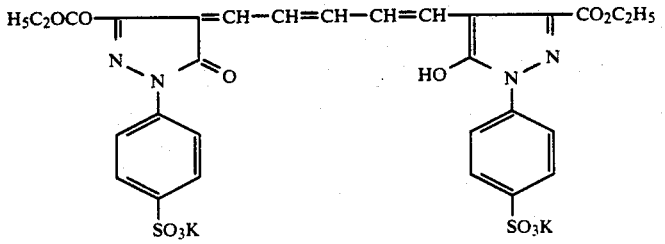

-continued

*26: 1,2-Bis(vinylsulfonylacetamido)ethane

Then, by following the same procedure as in the case of preparing Sample 501 except that the dispersing polymers for Layer 3 and Layer 4 of Sample 501 were not added and that the dispersing polymers for Layers 3 and 4 were not added and comparison compound D was used in place of the cyan coupler for the layers, Samples 502 and 503 were prepared, respectively.

COMPARISON COMPOUND D

2:1 Mixture (by weight ratio) of 2-[α-(2,4-di-t-amylphenoxy)hexaneamido]-4,6-dichloro-5-ethylphenol and 2-[2-chlorobenzoylamido]-4-chloro-5-[α-(2-chloro-4-t-amylphenoxy)octaneamido]-phenol.

| | |
|---|---|
| The coating amount for Layer 3 | 0.21 g/m$^2$ |
| The coating amount for Layer 4 | 0.30 g/m$^2$ |

Each of Samples 501 to 503 thus prepared was exposed through a photographed and processed color reversal film and processed by the following processing steps.

| Processing Step | Temperature | Time |
|---|---|---|
| First Development | 38° C. | 75 sec. |
| First Wash | 33° C. | 90 sec. |
| Reversal Exposure | (100 lux) | 15 sec. |
| Color Development | 38° C. | 135 sec. |
| Second Wash | 33° C. | 45 sec. |
| Blix | 38° C. | 120 sec. |
| Wash | 33° C. | 135 sec. |
| Drying | 75° C. | 45 sec. |

The compositions of the processing solutions were as follows.

| First Development | |
|---|---|
| Nitrilo-N,N,N-trimethylenephosphonic Acid.Penta-Sodium Salt | 1.0 g |
| Diethylenetriaminepentaacetic Acid. Penta-Sodium Salt | 3.0 g |
| Potassium Sulfite | 30.0 g |
| Potassium Thiocyanate | 1.2 g |
| Potassium Carbonate | 35.0 g |
| Potassium Hydroquinone monosulfate | 25.0 g |
| 1-Phenyl-4-hydroxymethyl-3-Pyrazolidone | 2.0 g |
| Potassium Bromide | 0.5 g |
| Potassium Iodide | 5.0 mg |
| Water to make | 1000 ml |
| pH (25° C.) | 9.60 |

The pH was adjusted with hydrochloric acid or potassium hydroxide.

| Color Developer | |
|---|---|
| Benzyl Alcohol | 15.0 ml |
| Diethylene Glycol | 12.0 ml |
| 3,6-Dithia-1,8-octanediol | 0.20 g |
| Nitrilo-N,N,N-trimethylenephosphonic Acid.Penta-Sodium Salt | 0.5 g |
| Diethylenetriaminepentaacetic Acid. Penta-Sodium Salt | 2.0 g |
| Sodium Sulfite | 2.0 g |
| Hydroxylamine Sulfate | 3.0 g |
| N-Ethyl-N-(β-methanesulfonamidoethyl)- | 5.0 g |

-continued

| Color Developer | |
|---|---|
| 3-methylaminoaniline Sulfate | |
| Brightening Agent (diaminostilbene compound) | 1.0 g |
| Potassium Bromide | 0.5 g |
| Potassium Iodide | 1.0 mg |
| Water to make | 1000 ml |
| pH (25° C.) | 10.25 |

The pH was adjusted with hydrochloric acid or potassium hydroxide.

| Blix Solution | |
|---|---|
| Ethylenediaminetetraacetic Acid. Di-Sodium salt.Di-hydrate | 5.0 g |
| Ethylenediaminetetraacetic Acid. Fe(III).Ammonium salt.Mono-Hydrate | 80.0 g |
| Sodium Sulfite | 15.0 g |
| Ammonium Thiosulfate (700 g/liter) | 160 ml |
| 2-Mercapto-1,3,4-triazole | 0.5 g |
| Water to make | 1000 ml |
| pH (25° C.) | 6.50 |

The pH was adjusted with acetic acid or aqueous ammonia.

When the fastness to heat, humidity-heat, and light and the color reproducibility were determined for the reversal print of each sample after processing, it was confirmed that in the case of using the coupler and the polymer defined in this invention, both properties were satisfactory.

EXAMPLE 6

A multilayer color photographic film (Sample 601) having the layer structure shown below on a cellulose triacetate film support having a subbing layer was prepared.

Compositions of Layers

The compositions of the layers are shown below. The coating amount is shown in g/m$^2$ unit of silver for silver halide and colloidal silver; in g/m$^2$ units for couplers, additives, and gelatin; and as mol per mol of silver halide in the same layer for sensitizing dyes.

| | |
|---|---|
| Layer 1 (Antihalation Layer) | |
| Black Colloidal Silver | 0.2 |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0.05 |
| Layer 2 (Interlayer) | |
| Gelatin | 1.0 |
| UV-1 | 0.03 |
| ExC-4 | 0.02 |
| ExF-1 | 0.004 |
| Solv-1 | 0.1 |
| Solv-2 | 0.1 |
| Layer 3 (Low-Speed Red-Sensitive Emulsion Layer) | |
| Silver Iodobromide Emulsion (AgBrI particles: AgI 4 mol %, uniform AgI type, | 1.2 (Ag |

-continued

| | |
|---|---|
| sphere-corresponding diam. 0.5 μm, coeff. of variation of sphere-corresponding diam. 20%, tabular grains, diam./thickness 3.0) | amount) |
| Silver Iodobromide Emulsion (AgBrI particles: AgI 3 mol %, uniform AgI type, sphere-corresponding diam. 0.3 μm coeff. of variation of sphere-corresponding diam. 15%, tabular grains, diam./thickness 1.0) | 0.6 (Ag amount) |
| Gelatin | 1.00 |
| ExS-1 | $4 \times 10^{-4}$ |
| ExS-2 | $5 \times 10^{-5}$ |
| ExC-1 | 0.05 |
| ExC-2 | 0.50 |
| ExC-3 | 0.03 |
| ExC-4 | 0.12 |
| ExC-5 | 0.01 |
| Polymer | 0.20 |
| Layer 4 (High-Speed Red-Sensitive Emulsion Layer) | |
| Silver Iodobromide Emulsion (AgBrI particles: AgI 6 mol %, interior high AgI content type of core/shell of 1/1, sphere-corresponding diam. 0.7 μm, coeff. of variation of sphere-corresponding diam. 15%, tabular grains, diam./thickness 5.0) | 0.7 (Ag amount) |
| Gelatin | 1.00 |
| ExS-1 | $3 \times 10^{-4}$ |
| ExS-2 | $2.3 \times 10^{-5}$ |
| ExC-6 | 0.11 |
| ExC-7 | 0.05 |
| ExC-4 | 0.05 |
| Solv-1 | 0.05 |
| Solv-3 | 0.05 |
| Layer 5 (Interlayer) | |
| Gelatin | 0.5 |
| Cpd-1 | 0.1 |
| Solv-1 | 0.05 |
| Layer 6 (Low-Speed Green-Sensitive Emulsion Layer) | |
| Silver Iodobromide Emulsion (AgBrI particles: AgI 4 mol %, surface high AgI type of core/shell of 1/1, sphere-corresponding diam. 0.5 μm, coeff. of variation of sphere-corresponding diam. 15%, tabular grains, diam./thickness 4.0) | 0.35 (Ag amount) |
| Silver Iodobromide Emulsion (AgBrI particles: AgI 3 mol %, uniform AgI type sphere-corresponding diam. 0.3 μm, coeff. of variation of sphere-corresponding diam. 25%, spherical grains, diam./thickness 1.0) | 0.20 (Ag amount) |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.02 |
| ExM-11 | 0.03 |
| Solv-1 | 0.3 |
| Solv-4 | 0.05 |
| Layer 7 (High-Speed Green-Sensitive Emulsion Layer) | |
| Silver Iodobromide Emulsion (AgBrI particles: AgI 4 mol %, interior high AgI content type of core/shell of 1/3, sphere-corresponding diam. 0.7 μm, coeff. of variation of sphere-corresponding diam. 20%, tabular grains, diam./thickness 5.0) | 0.8 (Ag amount) |
| Gelatin | 0.5 |
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |
| ExM-14 | 0.01 |
| Solv-1 | 0.2 |

-continued

| | |
|---|---|
| Solv-4 | 0.01 |
| Layer 8 (Interlayer) | |
| Gelatin | 0.5 |
| Cpd-1 | 0.05 |
| Solv-1 | 0.02 |
| Layer 9 (Donnor Layer of Interlayer Effect for Red-sensitive Emulsion Layer) | |
| Silver Iodobromide Emulsion (AgBrI particles: AgI 2 mol %, interior high AgI content type of core/shell of 2/1, sphere-corresponding diam. 1.0 μm, coeff. of variation of sphere-corresponding diams. 15%, tabular grains, diam./thickness 6.0) | 0.35 (Ag amount) |
| Silver Iodobromide Emulsion (AgBrI particles: AgI 2 mol %, interior high AgI content type of core/shell of 1/1, sphere-corresponding diam. 0.4 μm, coeff. of variation of sphere-corresponding diam. 30%, tabular grains, diam./thickness 6.0) | 0.20 (Ag amount) |
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |
| Layer 10 (Yellow Filter Layer) | |
| Yellow Colloidal Silver | 0.05 |
| Gelatin | 0.5 |
| Cpd-2 | 0.13 |
| Solv-1 | 0.13 |
| Cpd-1 | 0.10 |
| Layer 11 (Low-Speed Blue-Sensitive Emulsion Layer) | |
| Silver Iodobromide Emulsion (AgBrI particles: AgI 4.5 mol %, uniform AgI type, sphere-corresponding diam. 0.7 μm, coeff. of variation of sphere-corresponding diam. 15%, tabular grains, diam./thickness 7.0) | 0.3 (Ag amount) |
| Silver Iodobromide Emulsion (AgBrI particles: AgI 3 mol %, uniform AgI type, sphere-corresponding diam. 0.3 μm, coeff. of variation of sphere-corresponding diam. 25%, tabular grains, diam./thickness 7.0) | 0.15 (Ag amount) |
| Gelatin | 0.15 |
| ExS-6 | $2 \times 10^{-4}$ |
| ExC-16 | 0.05 |
| ExC-2 | 0.10 |
| ExC-3 | 0.02 |
| ExY-13 | 0.07 |
| ExY-15 | 1.0 |
| Solv-1 | 0.20 |
| Layer 12 (High-Speed Blue-Sensitive Emulsion Layer) | |
| Silver Iodobromide Emulsion (AgBrI particles: AgI 10 mol %, interior high AgI content type, sphere-corresponding diam. 1.0 μm, coeff. of variation of sphere-corresponding diam. 25%, multiple twin tabular grains, diam/thickness 2.0) | 0.5 (Ag amount) |
| Gelatin | 0.5 |
| ExS-6 | $1 \times 10^{-4}$ |
| ExY-15 | 0.20 |
| ExY-13 | 0.01 |
| Solv-1 | 0.10 |
| Layer 13 (First Protective Layer) | |
| Gelatin | 0.8 |
| UV-4 | 0.1 |
| UV-5 | 0.15 |
| Solv-1 | 0.01 |
| Solv-2 | 0.01 |
| Layer 14 (Second Protective Layer) | |
| Fine Grain Silver Iodobromide Emulsion (AgBrI particles: AgI 2 mol %, uniform AgI type sphere-corresponding diam. 0.07 μm) | 0.5 |
| Gelatin | 0.45 |
| Polymethyl Methacrylate Particles (diameter 1.5 μm) | 0.2 |
| H-1 | 0.4 |

-continued
| | |
|---|---|
| Cpd-5 | 0.5 |
| Cpd-6 | 0.5 |
Also, each emulsion layer contained Compound Cpd-3 (0.04 g/m$^2$) as a stabilizer for the emulsion and a surface active agent Cpd-4 (0.02 g/m$^2$) as a coating aid.
The compounds used for the sample were as follows.
UV-1
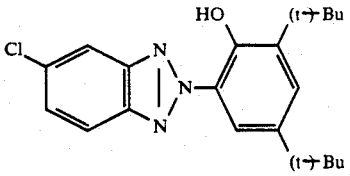
UV-2
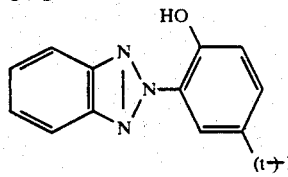
(Bu = butyl group)
UV-3
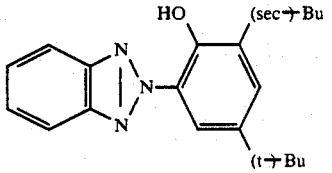
UV-4
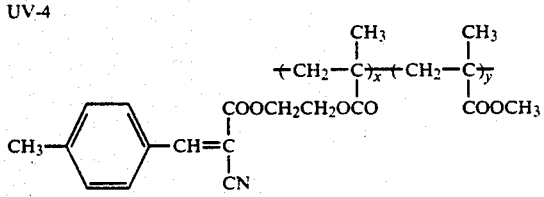
(X/Y = 7/3 (weight ratio))
UV-5
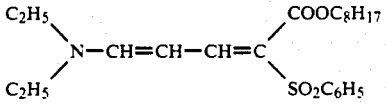
Solv-1
Tricresyl phosphate
Solv-2
Dibutyl Phthalate
Solv-3
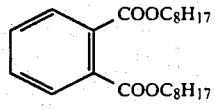
Solv-4
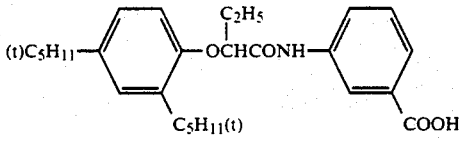
Cpd-1
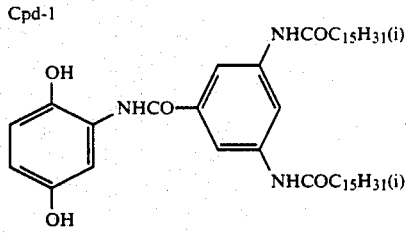
Cpd-2
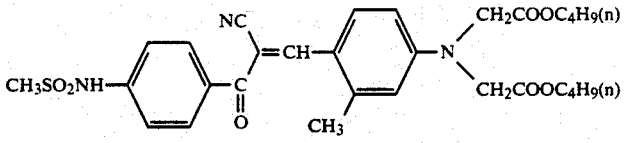
Cpd-3
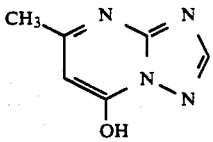
Cpd-4
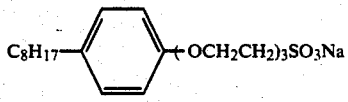
Cpd-5
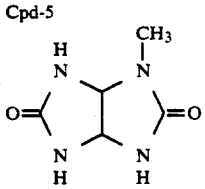
Cpd-6
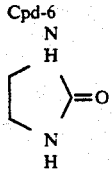
ExC-1

-continued
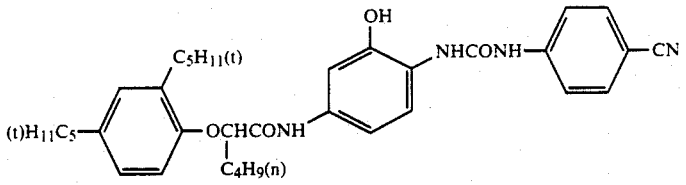
ExC-2 (corresponding to Compound C-2)
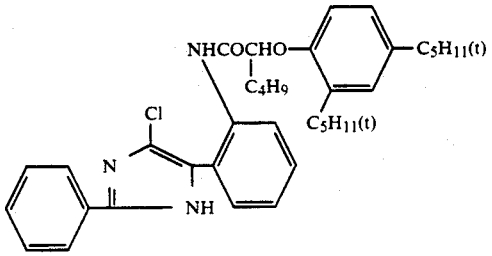
ExC-3
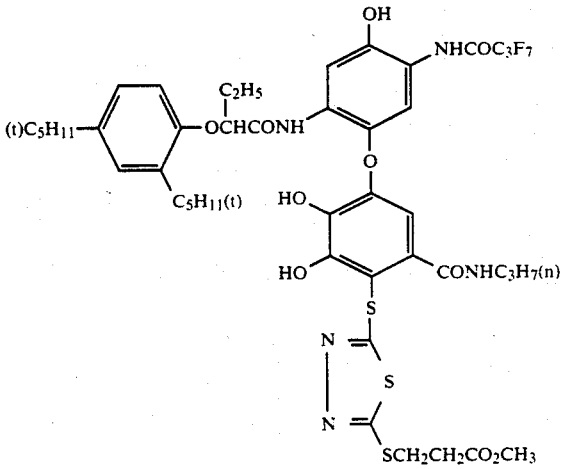
ExC-4
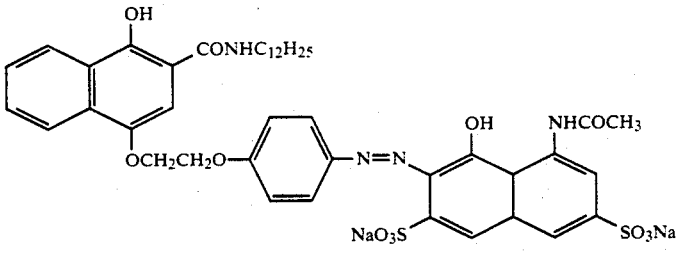
ExC-5
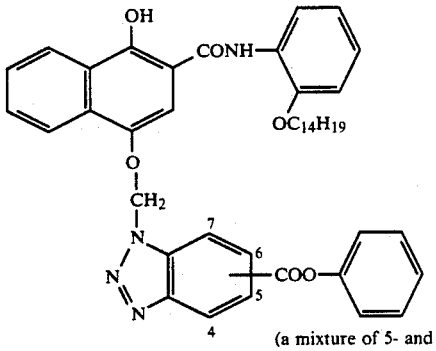
(a mixture of 5- and 6-substituted compounds)
ExC-6

-continued
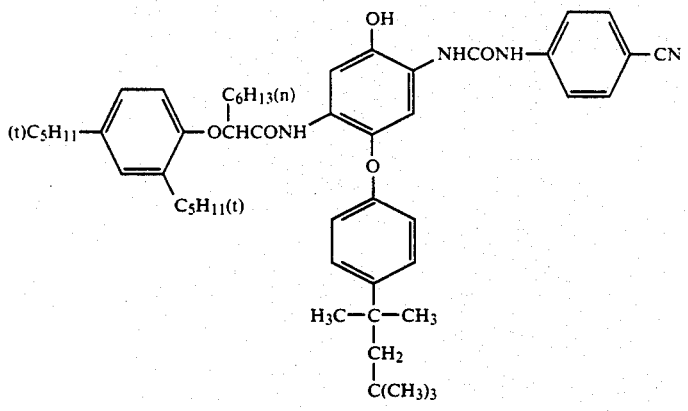
ExC-7
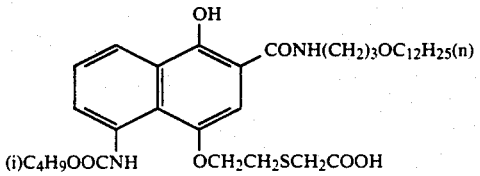
ExM-8
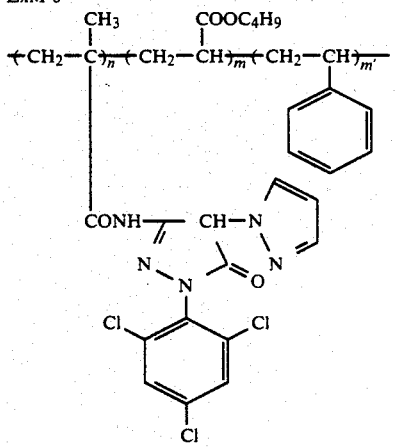
n = 50 m = 25 m' = 25
mol. wt. about 20,000
ExM-9
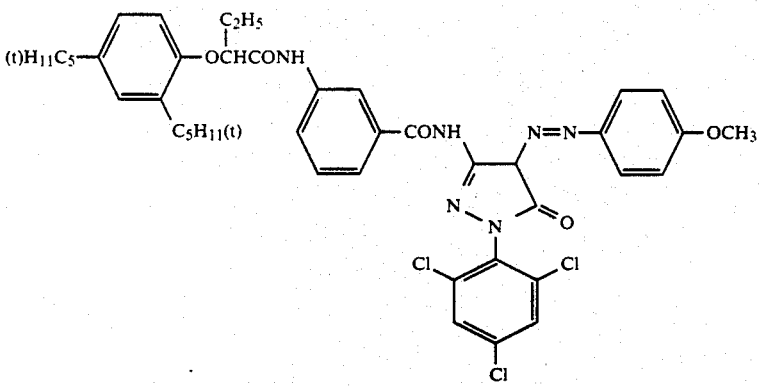
ExM-10
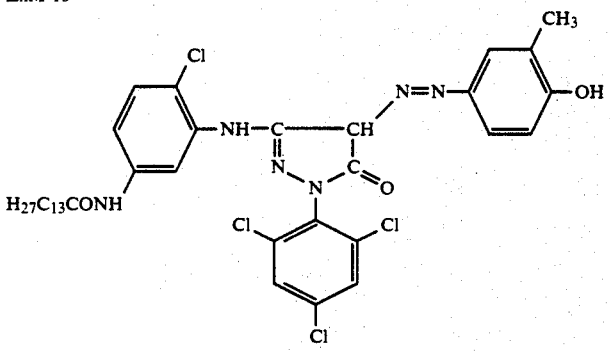

-continued
ExY-11
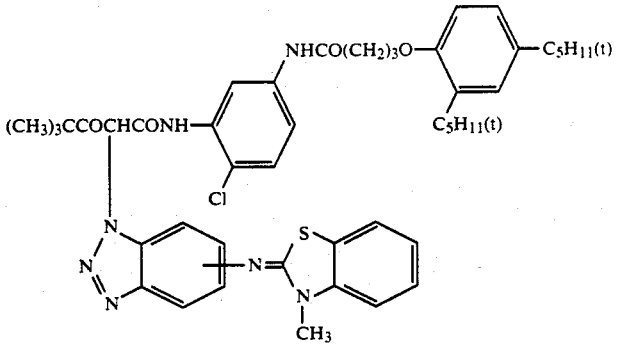
ExM-12
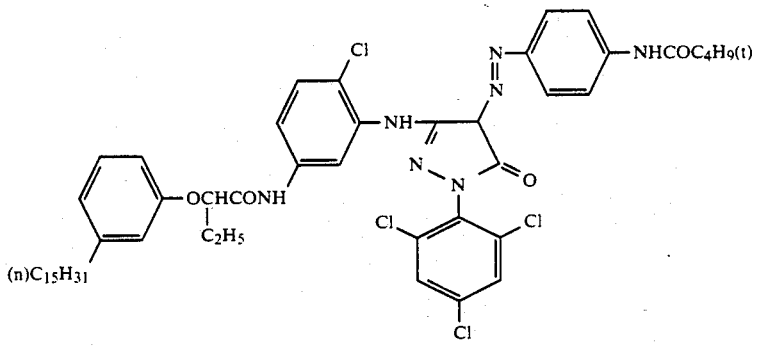
ExY-13
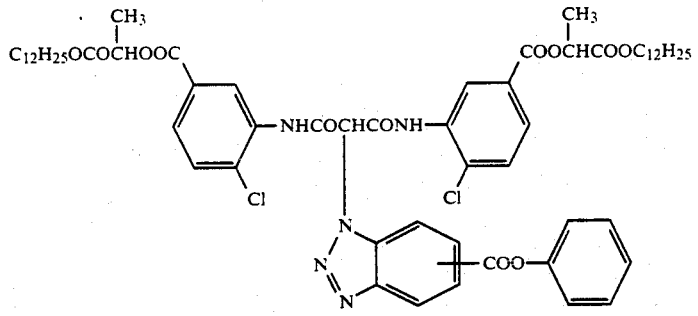
ExM-14
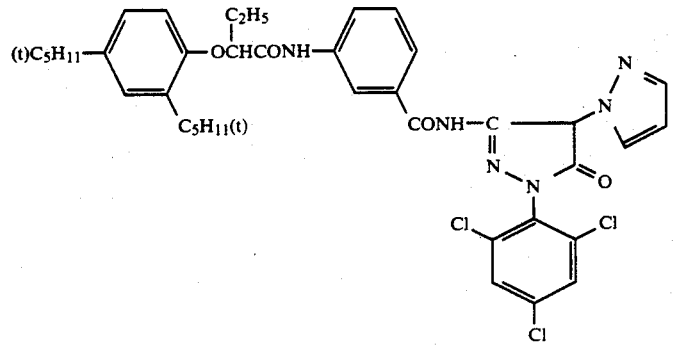
ExY-15
ExC-16

-continued
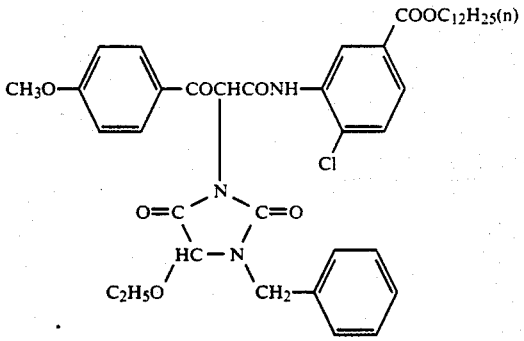
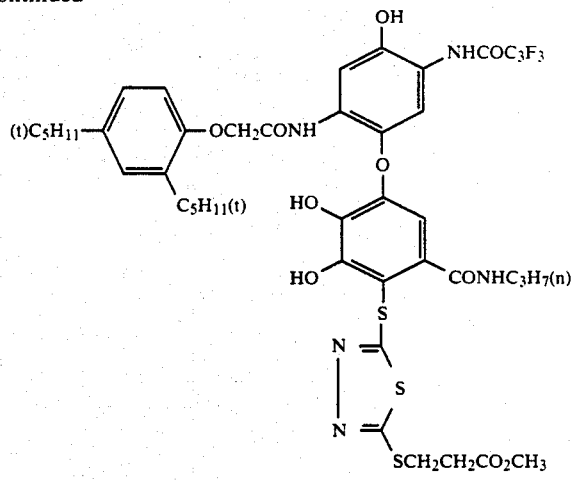
Polymer (corresponding to Compound P-57)
$\leftarrow CH_2-CH)_n$
$\quad\quad | $
$\quad\quad CONHC_4H_9(t)$
Mean mol. weight: 60,000
ExS-1
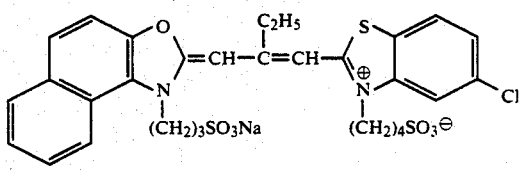
ExS-2
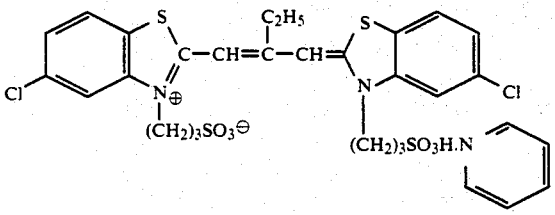
ExS-3
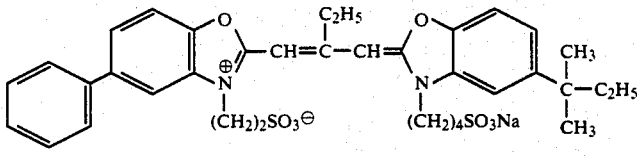
ExS-4
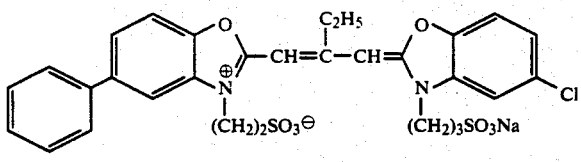
ExS-5
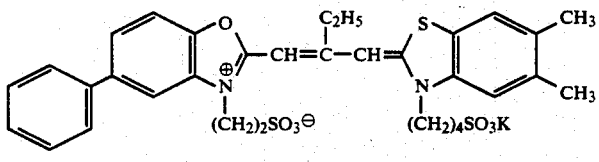
ExS-6
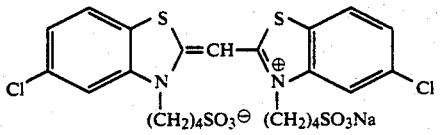
H-1
$CH_2=CH-SO_2-CH_2-CONH-CH_2$
$\quad\quad\quad\quad\quad\quad\quad\quad\quad\quad\quad\quad\quad\quad\quad\quad |$
$CH_2=CH-SO_2-CH_2-CONH-CH_2$ -continued ExF-1

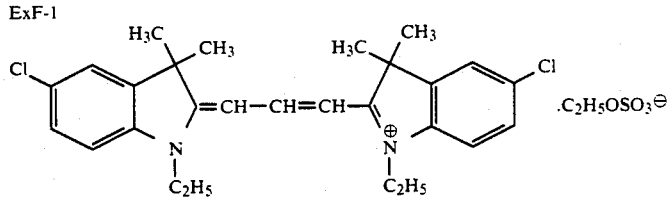

Then, by following the same procedure as for preparing Sample 601 except that the dispersing polymer for Layer 3 of Sample 601 was not added and the dispersing polymer was not added and the comparison Compound E shown below was used in place of the cyan coupler ExC-2 for Layer 3, Comparison Samples 602 and 603 were prepared, respectively.

COMPARISON COMPOUND E

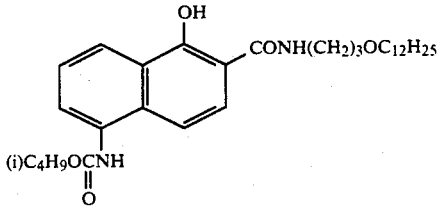

Sample 601 and Sample 602 thus prepared were imagewise exposed and processed by the following process.

| Processing Step | Temperature | Time |
|---|---|---|
| Color Development | 38° C. | 3 min. 15 sec. |
| Bleach | 38° C. | 1 min. 00 sec. |
| Blix | 38° C. | 3 min. 15 sec. |
| Wash (1) | 35° C. | 40 sec. |
| Wash (2) | 35° C. | 1 min. 00 sec. |
| Stabilization | 38° C. | 40 sec. |
| Drying | 55° C. | 1 min. 15 sec. |

The compositions of the processing solutions used for the processing steps were as follows.

| | |
|---|---|
| Color Developer | |
| Diethylenetriaminepentaacetic Acid | 1.0 g |
| 1-Hydroxyethylidene-1,1-di-phosphonic Acid | 3.0 g |
| Sodium Sulfite | 4.0 g |
| Potassium Carbonate | 30.0 g |
| Potassium Bromide | 1.4 g |
| Potassium Iodide | 1.5 mg |
| Hydroxyethylamine Sulfate | 2.4 g |
| 4-(N-ethyl-N-β-hydroxyethylamino)-2-methylaniline Sulfate | 4.5 g |
| Water to make | 1.0 liter |
| pH | 10.05 |
| Bleach Solution | |
| Ethylenediaminetetraacetic Acid Ferric Ammonium Salt Di-Hydrate | 12.00 g |
| Ethylenediamine tetraacetic Acid Di-Sodium Salt | 10.0 g |
| Ammonium Bromide | 100.0 g |
| Ammonium Nitrate | 10.0 g |
| Bleach Accelerator (shown below) | 0.005 mol |

-continued

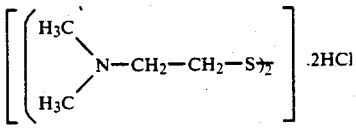

| | |
|---|---|
| Aqueous Ammonia (27%) | 15.0 ml |
| Water to make | 1.0 liter |
| pH | 6.3 |
| Blix Solution | |
| Ethylenediaminetetraacetic Acid Ferric Ammonium Salt Di-Hydrate | 50.0 g |
| Ethylenediaminetetraacetic Acid Di-Sodium Salt | 5.0 g |
| Sodium Sulfite | 12.0 g |
| Aqueous Solution of Ammonium Thiosulfate (70%) | 240.0 ml |
| Aqueous Ammonia (27%) | 6.0 ml |
| Water to make | 1.0 liter |
| pH | 7.2 |

Wash Water

City water was passed through a mixed bed type column packed with an H-type strong acid cation-exchange resin (Amberlite IR-120B, trade name, made by Rhome and Haas Co.) and an OH type anion-exchange resin (Amberlite IR-400) to reduce the concentrations of calcium ions and magnesium ions below 3 mg/liter each and 20 mg/liter of sodium dichloroisocyanurate and 0.15 g/liter of sodium sulfate were added thereto. The pH of the solution was in the range of from 6.5 to 7.5.

| Stabilization Solution | |
|---|---|
| Formalin (37% aqueous solution) | 2.0 ml |
| Polyoxyethylene-p-monononyl Phenyl Ether (mean molecular weight 10) | 0.3 g |
| Ethylenediaminetetraacetic Acid Di-Sodium Salt | 0.05 g |
| Water to make | 1.0 liter |
| pH | 5.0 to 8.0 |

When the fastness of each sample thus processed to heat, humidity-heat, and light were determined, it was confirmed that the fastness was greatly improved in Sample 601 using the coupler and the polymer defined in this invention as compared to Comparison Sample 602.

Then, each of Samples 601 to 603 was cut into 35 mm in width, used to photograph a standard object, and processed by the above processing steps to provide a color negative film.

Then, the color negative film was printed on a color photographic paper using a color printer and the color photographic paper was processed to provide three kinds of color prints. The results showed that the color prints obtained from Samples 601 and 602 were clearly excellent in color reproducibility as compared to the color print obtained from Sample 603.

EXAMPLE 7

When the same procedure as Example 6 was followed while the following processing steps were employed, and then the fastness of Samples 601 to 602 to heat, humidity-heat, and light and also the color reproducibly of Samples 601 to 603 were determined in the same manner as in Example 6, almost the same results as in Example 6 were obtained.

| Processing Step | Temperature | Time |
|---|---|---|
| Color Development | 40° C. | 2 min. 30 sec. |
| Blix | 40° C. | 3 min. 00 sec. |
| Wash (1) | 35° C. | 20 sec. |
| Wash (2) | 35° C. | 20 sec. |
| Stabilization | 35° C. | 20 sec. |
| Drying | 65° C. | 50 sec. |

The compositions of the processing solutions used are shown below.

| | |
|---|---|
| Color Developer | |
| Diethylenetriaminepentaacetic Acid | 2.0 g |
| 1-Hydroxyethylidene-1,1-di-phosphonic Acid | 3.0 g |
| Sodium Sulfite | 4.0 g |
| Potassium Carbonate | 30.0 g |
| Potassium Bromide | 1.4 g |
| Potassium Iodide | 1.5 mg |
| Hydroxyethylamine Sulfate | 2.4 g |
| 4-(N-ethyl-N-β-hydroxyethylamino)-2-methylaniline Sulfate | 4.5 g |
| Water to make | 1.0 liter |
| pH | 10.05 |
| Blix Solution | |
| Ethylenediaminetetraacetic Acid Ferric Ammonium Salt Di-Hydrate | 90.0 g |
| Ethylenediaminetetraacetic Acid Di-Sodium Salt | 5.0 g |
| Sodium Sulfite | 12.0 g |
| Aqueous Solution of Ammonium Thiosulfate (70%) | 260.0 ml |
| Acetic Acid (98%) | 5.0 ml |
| Bleach Accelerator shown below | 0.01 mol |

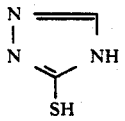

| | |
|---|---|
| Water to make | 1.0 liter |
| pH | 6.0 |

Wash Water

Same as used in Example 6.

Stabilization Solution

Same as in Example 6.

EXAMPLE 8

A multilayer color photographic material having the following layers on a cellulose triacetate film was prepared (Sample 801).

Layer Structure

The compositions of the layers are shown below. The numerals are the coating amounts in g/m² units, wherein the amount of silver halide is calculated as the amount of silver.

| | |
|---|---|
| Layer 1 (Antihalation Layer) | |
| Black Colloidal Silver | 0.30 |
| Gelatin | 2.50 |
| UV-1 | 0.05 |
| UV-2 | 0.10 |
| UV-3 | 0.10 |
| Solv-1 | 0.10 |
| Layer 2 (Interlayer) | 0.50 |
| Gelatin | |
| Layer 3 (Low-Speed Red-Sensitive Emulsion Layer) | |
| Mono-Dispersed Silver Iodobromide Emulsion (AgBrI particles: AgI 4 mol %, cubic, mean grain size 0.3 μm, s/d = 0.15) | 0.50 |
| ExS-1 | $1.40 \times 10^{-3}$ |
| ExS- | $6.00 \times 10^{-5}$ |
| Gelatin | 0.80 |
| ExC-1 | 0.20 |
| Dispersing Polymer | 0.10 |
| Solv-2 | 0.10 |
| Layer 4 (Medium-Speed Red-Sensitive Emulsion Layer) | |
| Mono-Dispersed Silver Iodobromide Emulsion (AgBrI particles: AgI 2.5 mol %, tetradecahedral, mean grain size 0.45 μm, s/d = 0.15) | 0.50 |
| ExS-1 | $1.60 \times 10^{-3}$ |
| ExS-2 | $6.00 \times 10^{-5}$ |
| Gelatin | 1.00 |
| ExC-1 | 0.30 |
| Polymer | 0.15 |
| Solv-2 | 0.20 |
| Layer 5 (High-Speed Red-Sensitive Emulsion Layer) | |
| Mono-Dispersed Silver Iodobromide Emulsion (AgBrI particles: AgI 2.5 mol %, tetradecahedral, mean grain size 0.60 μm, s/d = 0.15) | 0.30 |
| ExS-1 | $1.60 \times 10^{-3}$ |
| ExS-2 | $6.00 \times 10^{-5}$ |
| Gelatin | 0.70 |
| ExC-1 | 0.20 |
| Polymer | 0.10 |
| Solv-2 | 0.12 |
| Layer 6 (Interlayer) | |
| Gelatin | 1.0 |
| Cpd-1 | 0.1 |
| Solv-1 | 0.03 |
| Solv-2 | 0.08 |
| Solv-3 | 0.12 |
| Cpd-2 | 0.25 |
| Layer 7 (Low-Speed Green-Sensitive Emulsion Layer) | |
| Silver Iodobromide Emulsion (AgBrI particles: AgI 3.0 mol %, normal crystal-twin mixture, mean grain size 0.3 μm) | 0.65 |
| ExS-3 | $3.30 \times 10^{-3}$ |
| ExS-4 | $1.50 \times 10^{-3}$ |
| Gelatin | 1.50 |
| ExM-1 | 0.10 |
| ExM-2 | 0.25 |
| Solv-2 | 0.30 |
| Layer 8 (High-Speed Green-Sensitive Emulsion Layer) | |
| Tabular Grain Silver Iodobromide Emulsion (AgBrI particles: AgI 2.5 mol %, grains having diam./thickness ratio of at least 5 accounting for 50% of the projected area of whole grains, mean thickness of grains 0.15 μm) | 0.70 |
| ExS-3 | $1.30 \times 10^{-3}$ |
| ExS-4 | $5.00 \times 10^{-4}$ |
| Gelatin | 1.00 |
| ExM-3 | 0.25 |
| Cpd-3 | 0.10 |
| Cpd-4 | 0.05 |
| Solv-2 | 0.05 |
| Layer 9 (Interlayer) | 0.50 |
| Gelatin | |
| Layer 10 (Yellow Filter Layer) | |
| Yellow Colloidal Silver | 0.10 |
| Gelatin | 1.00 |
| Cpd-1 | 0.05 |

-continued

| | |
|---|---|
| Solv-1 | 0.03 |
| Solv-2 | 0.07 |
| Cpd-2 | 0.10 |
| Layer 11 (Low-Speed Blue-Sensitive Emulsion Layer) | |
| Silver Iodobromide Emulsion (AgBrI particles: AgI 2.5 mol %, normal crystal-twin mixture, mean grain size 0.7 μm) | 0.55 |
| ExS-5 | $1.00 \times 10^{-3}$ |
| Gelatin | 0.90 |
| ExY-1 | 0.50 |
| Solv-2 | 0.10 |
| Layer 12 (High-Speed Blue-Sensitive Emulsion Layer) | |
| Tabular Grain Silver Iodobromide Emulsion (AgBrI particles: AgI 2.5 mol %, grains having diam./thickness ratio of at least 5 accounting for 50% of the projected area of whole grains, mean thickness of grains 0.13 μm) | 1.00 |
| ExS-5 | $1.70 \times 10^{-3}$ |
| Gelatin | 2.00 |
| ExY-1 | 1.00 |
| Solv-2 | 0.20 |
| Layer 13 (Ultraviolet Absorption Layer) | |
| Gelatin | 1.50 |
| UV-1 | 0.02 |
| UV-2 | 0.04 |
| UV-3 | 0.04 |
| Cpd-5 | 0.30 |
| Solv-1 | 0.30 |
| Cpd-6 | 0.10 |
| Layer 14 (Protective Layer) | |
| Fine Grain Silver Iodobromide (silver iodide 1 mol %, mean grain size 0.05 μm) | 0.10 |
| Gelatin | 2.00 |
| H-1 | 0.30 |

The compounds used for the sample were as follows.

ExS-1

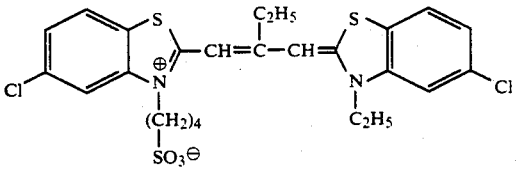

ExS-2

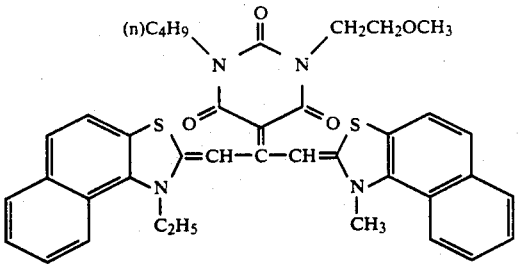

ExS-3

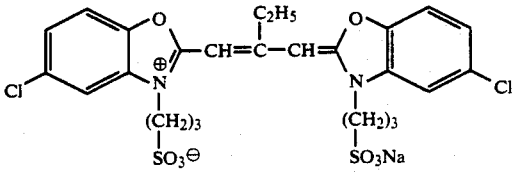

ExS-4

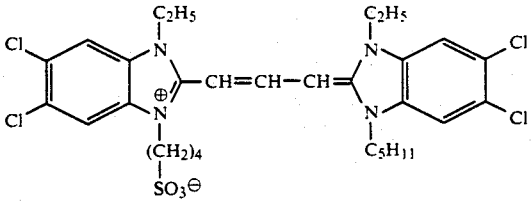

ExS-5

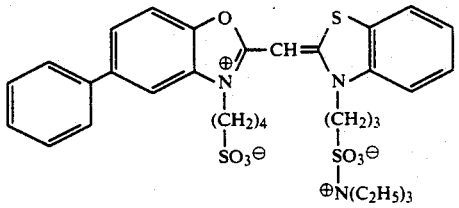

UV-1

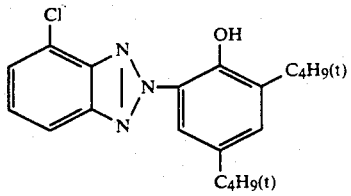

UV-2

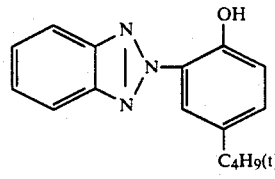

UV-3

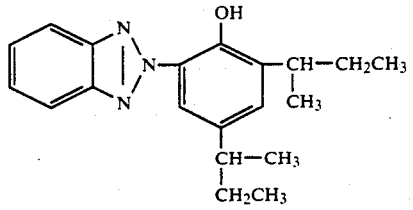

Cpd-1

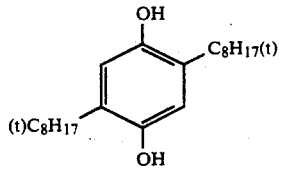

Cpd-2 Polyethyl Acrylate

Cpd-3

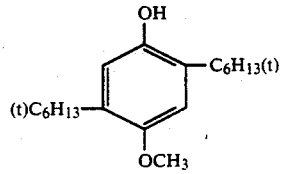

Cpd-4

-continued

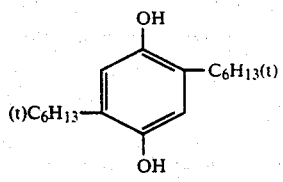

Cpd-5

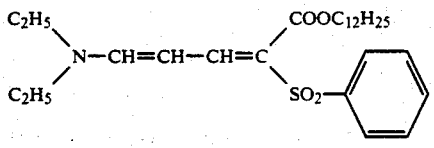

Cpd-6

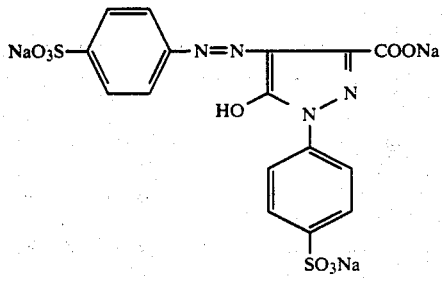

ExC-1 (corresponding to Compound C-2)

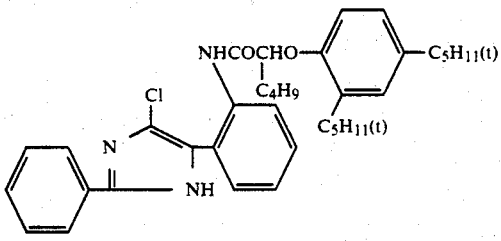

Polymer (corresponding to Compound P-57)

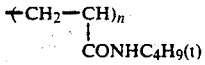

Mean mol. weight: 60,000

ExM-1

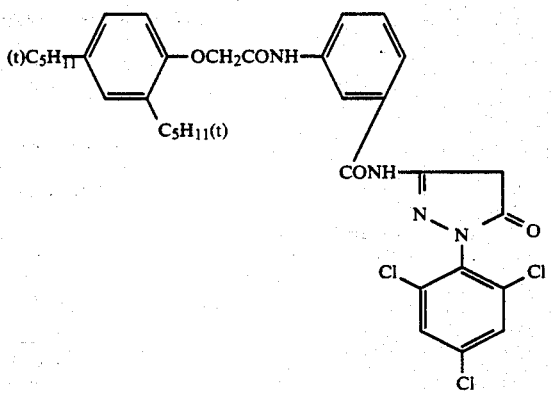

ExM-2

-continued

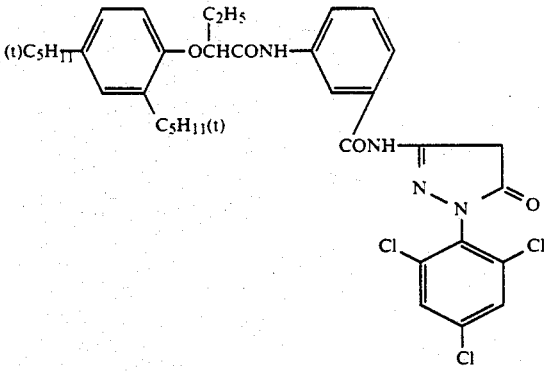

ExM-3

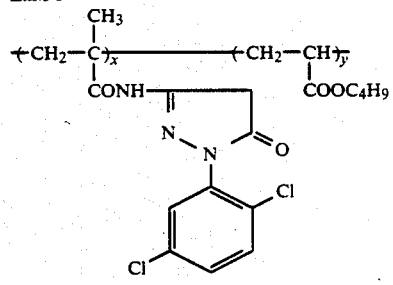

ExY-1:

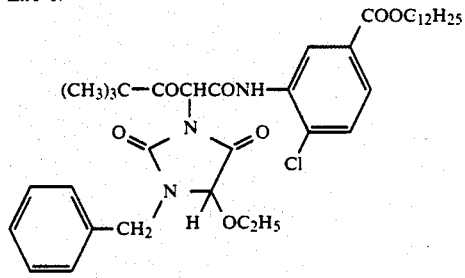

Solv-1: Dibutyl Phthalate
Solv-2: Tricresyl Phosphate
Solv-3: Trinonyl Phosphate
H-1: 1,2-Bis(vinylslfonylacetamido)ethane Then, by following the same procedure as for preparing Sample 801 except that the dispersing polymer for Layer 3 to Layer 5 of Sample 801 was not added and that the dispersing polymer for these layers was not added and Comparison Compound F shown below was used in place of the cyan coupler for these layers, Samples 802 and 803 were prepared, respectively.

COMPARISON COMPOUND F

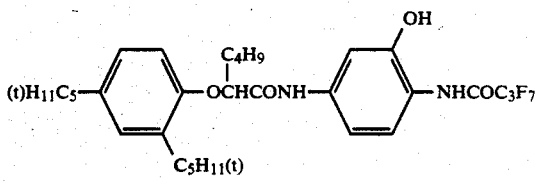

Each of Samples 801 to 803 was cut into 35 mm widths, used to photograph a standard object, and processed by the following processing steps.

When the fastness to heat, humidity-heat, and light and the color reproducibility were determined for each color slide obtained, it was confirmed that in the case of using the coupler and the polymer defined in this invention, both properties were satisfied.

| Processing Step | Temperature | Time |
|---|---|---|
| First Development | 38° C. | 6 min. |
| Wash | 38° C. | 2 min. |
| Reversal | 38° C. | 2 min. |
| Color Development | 38° C. | 6 min. |
| Control of pH | 38° C. | 2 min. |
| Bleach | 38° C. | 6 min. |
| Fix | 38° C. | 4 min. |
| Wash | 38° C. | 4 min. |
| Stabilization | 25° C. | 1 min. |

The compositions of the processing solutions used for the processing steps were as follows.

| First Developer | |
|---|---|
| Nitrilo-N,N,N-trimethylenephosphonic Acid.Penta-Sodium Salt | 2.0 g |
| Sodium Sulfite | 30 g |
| Hydroquinone.Potassium Monosulfonate | 20 g |
| Potassium Carbonate | 33 g |
| 1-phenyl-4-methyl-4-hydroxymethyl-3-pyrazolidone | 2.0 g |
| Potassium Bromide | 2.5 g |
| Potassium Thiocyanate | 1.2 g |
| Potassium Iodide | 2.0 mg |
| Water to make | 1000 ml |
| pH | 9.60 |

The pH was adjusted with hydrochloric acid or potassium hydroxide.

| Reversal Solution | |
|---|---|
| Nitrilo-N,N,N-trimethylenephosphonic Acid.Penta-Sodium Salt | 3.0 g |
| Stannous Chloride.Di-Hydrate | 1.0 g |
| p-Aminophenol | 0.1 g |
| Sodium Hydroxide | 8 g |
| Glacial Acetic Acid | 15 ml |
| Water to make | 1000 ml |
| pH | 6.00 |

The pH of the above solution was adjusted with hydrochloric acid or sodium hydroxide.

| Color Developer | |
|---|---|
| Nitrilo-N,N,N-trimethylenephosphonic Acid.Penta-Sodium Salt | 2.0 g |
| Sodium Sulfite | 7.0 g |
| Tri-Sodium Phosphate.12$H_2O$ | 36 g |
| Potassium Bromide | 1.0 g |
| Sodium Hydroxide | 3.0 g |
| Citrazinic Acid | 1.5 g |
| N-Ethyl-N-(β-methanesulfonamidethyl)-3-methyl-4-aminoaniline Sulfate | 11 g |
| 3,6-Dithiaoctane-1,8-diol | 1.0 g |
| Water to make | 1000 ml |
| pH | 11.80 |

The pH was adjusted with hydrochloric acid or sodium hydroxide.

| Control Solution | |
|---|---|
| Ethylenediaminetetraacetic Acid. Di-Sodium Salt.Di-Hydrate | 8.0 g |
| Sodium Sulfite | 12 g |
| 1-Thioglycerol | 0.4 ml |
| Water to make | 1000 ml |

-continued

| Control Solution | |
|---|---|
| pH | 6.20 |

The pH was adjusted with hydrochloric acid or sodium hydroxide.

| Bleach Solution | |
|---|---|
| Ethylenediaminetetraacetic Acid. Di-Sodium Salt.Di-Hydrate | 2.0 g |
| Ethylenediaminetetraacetic Acid. Fe(III).Ammonium Salt.Di-Hydrate | 120 g |
| Potassium Nitrate | 100 g |
| Ammonium Bromide | 10 g |
| Water to make | 1000 ml |
| pH | 5.70 |

The pH was adjusted with hydrochloric acid or sodium hydroxide.

| Fix Solution | |
|---|---|
| Ammonium Thiosulfate | 80 g |
| Sodium Sulfite | 5.0 g |
| Sodium Hydrogensulfite | 5.0 g |
| Water to make | 1000 ml |
| pH | 6.60 |

The pH was adjusted with hydrochloric acid or aqueous ammonia.

| Stabilization Solution | |
|---|---|
| Formalin (37% aqueous solution) | 5.0 ml |
| Polyoxyethylene-p-mononylphenyl Ether (mean molecular weight 10) | 0.5 ml |
| Water to make | 1000 ml |
| pH | not adjusted |

EXAMPLE 9

Each of Samples 301 to 310 prepared in the same manner as in Example 3 was exposed through an optical wedge and processed by the following process.

| Processing Step | Temperature | Time |
|---|---|---|
| Color Development | 35° C. | 45 sec. |
| Blix | " | 30 sec. |
| Washing (1) | " | " |
| Washing (2) | " | " |
| Washing (3) | " | " |
| Drying | 75° C. | 60 sec. |

The compositions of the processing solutions were as follows.

| Color Developer | |
|---|---|
| Water | 800 ml |
| Ethylenediamine-N,N,N',N'-tetra-methylene phosphonic acid | 3.0 g |
| Triethanolamine | 8.0 g |
| Sodium chloride | 1.4 g |
| Potassium Carbonate | 25 g |
| N-Ethyl-N-(β-methansulfonamido-ethyl)-3-methyl-4-amino aniline sulfate | 5.0 g |
| N,N-Bis(carboxymethyl)hydrazine | 5.0 g |
| Brightening Agent (Whitex 4. Trade name, made by Sumitomo Chemical Co., Ltd.) | 1.0 g |
| Water to make | 1,000 ml |

-continued

| | |
|---|---|
| pH (25° C.) | 10.05 |
| Blix Solution | |
| Water | 700 ml |
| Ammonium Thiosulfate Aqueous Solution (700 g/l) | 100 ml |
| Ammonium Sulfite | 18 g |
| Ethylenediaminetetraacetic Acid Iron (III) Ammonium Salt Di-Hydrate | 55 g |
| Ethylenediaminetetraacetic Acid Di-Sodium Salt | 3 g |
| Ammonium Bromide | 40 g |
| Glacial Acetic Acid | 8 g |
| Water to make | 1,000 ml |
| pH (25° C.) | |

Two blix solutions each having pH 5.5 and pH 4.5 were obtained by adjusting the pH of the solutions with hydrochloric acid or an aqueous ammonia.

Rinsing Solution

City water treated with ion-exchange resin to reduce the concentrations of calcium and magnesium to not higher than 3 ppm (dielectric constant: 5 μs/cm) was used.

After treatment the silver amounts remained at the Dmax portion of Samples were measured using a fluorescent X ray.

Samples 301 to 310 which were treated with the blix solution having pH 5.5 had silver remained in an amount of from 2.0 to 3.0 $\mu g/m^2$. These Samples exhibited slightly poor desilvering property in this blix solution. On the other hand, Samples 301 to 310 which were treated with the blix solution having pH 4.5 had silver remained in an amount of not more than 1.0 $\mu g/m^2$. These Samples exhibited excellent desilvering property in this blix solution.

In order to determine re-coloring property, cyan densities of the Dmax portion of Samples immediately after the treatment were measured using Mackbes densitometer. After treatment of the Samples with treating composition CN-16 N-2 (trade name, manufactured by Fuji Photo film Co.) at 30° C. for 4 minutes to change the cyan leuco compound to the cyan dye, the densities were measured again.

Samples 1 to 10 which were treated with the blix solution having pH 5.5 scarcely exhibited the difference between densities of each Samples 1 to 10 before and after treatment with the treatment composition CN-16 N-2.

Among Samples treated with the blix solution having pH 4.5, Samples 307 to 309 exhibited extremely large density reduction immediately after the treatment, however, the Samples 301 to 306 of the present invention which contained polymers scarcely exhibited the density reduction, and they were superior than Sample 10.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one silver halide photographic emulsion layer containing an emulsified dispersion of oleophilic fine particles obtained by dispersing a solution containing at least one cyan coupler represented by formula (I) and at least one water-insoluble and organic solvent-soluble polymer;

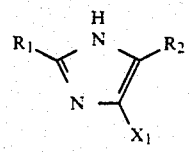

(I)

wherein $R_1$ and $R_2$ each represents an aromatic group, a heterocyclic group, an aromatic amino group, a heterocyclic amino group, an aliphatic amino group, an acylamino group, a sulfonamido group, a carbamoyl group, a sulfamoyl group, a ureido group, an aliphatic oxycarbonyl group, an aromatic oxycarbonyl group, an aliphatic oxycarbonylamino group, an aromatic oxycarbonylamino group, a carboxy group, or a cyano group; and $X_1$ represents hydrogen or an atom or a group capable of being released by a coupling reaction with the oxidation product of a color developing agent; provided that $R_2$ and $X_1$ each may be linked to form a 5- to 7-membered ring; said coupler may form a dimer or higher polymer at $R_1$, $R_2$, or $X_1$; excluding that $R_1$ and $R_2$ are a combination of groups selected from carboxy groups, and cyano groups.

2. The silver halide color photographic material as claimed in claim 1, wherein $X_1$ in formula (I) represents hydrogen, a halogen atom, a sulfo group, an alkoxy group, an aryloxy group, an acyloxy group, a heterocyclic oxy group, an alkylthio group, an arylthio group, or a heterocyclic thio group.

3. The silver halide color photographic material as claimed in claim 1, wherein a substituent for groups represented by $R_1$, $R_2$ (excluding carboxy group and cyano group) is selected from the group consisting of an alkyl group, an aryl group, a heterocyclic group, an alkoxy group, an aryloxy group, an alkenyloxy group, an acyl group, an ester group, an amido group, a carbamoyl group, a sulfamoyl group, a sulfamido group, a sulfamoylamino group, a carbamoylamino group, an imido group, a ureido group, an aliphatic or aromatic sulfonyl group, an aliphatic or aromatic thio group, a hydroxy group, a cyano group, a carboxy group, a nitro group, a sulfo group, or a halogen atom.

4. The silver halide color photographic material as claimed in claim 1, wherein the water-insoluble and organic solvent-soluble homopolymer or copolymer has a glass transition point of at least 60° C.

5. The silver halide color photographic material as claimed in claim 1, wherein the water-insoluble and organic solvent-soluble homopolymer or copolymer has a glass transition point of at least 90° C.

6. The silver halide color photographic material as claimed in claim 1, wherein the water-insoluble and organic solvent soluble polymer contains a recurring unit which has at least one group selected from the group consisting of

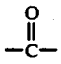

group,

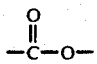

group and

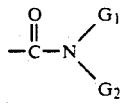

group, wherein $G_1$ and $G_2$ each represents hydrogen, a substituted or unsubstituted alkyl group, or a substituted or unsubstituted aryl group and at least one of $G_1$ and $G_2$ represents a substituted or unsubstituted alkyl group or a substituted or unsubstituted aryl group in the main chain or a side chain of polymer.

7. The silver halide color photographic material as claimed in claim 1, wherein the polymer is able to provide a viscosity of not greater than 5,000 Cps to a solution containing 30 g of said polymer in 100 ml of an auxiliary solvent (at 25° C.)

8. The silver halide color photographic material as claimed in claim 1, wherein the molecular weight of said polymer is not greater than 150,000.

9. The silver halide color photographic material as in claim 1, wherein the ratio of the polymer to the cyan coupler is 1/20 to 20/1 (by weight).

10. The silver halide color photographic material as in claim 1, wherein the amount of said cyan coupler is from $2\times10^{-3}$ to $5\times10^{-1}$ mol per mol of the silver halide in the silver halide emulsion layer containing the coupler.

11. The silver halide color photographic material as in claim 1, wherein the mean particle size of the oleophilic fine particles in from 0.04 to 2 μm.

12. The silver halide color photographic material as in claim 1, wherein said at least one silver halide photographic emulsion layer is provided by using a silver halide photographic emulsion obtained by dispersing a solution containing the polymer and the cyan coupler into water or an aqueous hydrophilic colloid solution, and then adding the dispersion to an silver halide photographic emulsion.

* * * * *